US008366109B2

(12) United States Patent
Soltys

(10) Patent No.: US 8,366,109 B2
(45) Date of Patent: Feb. 5, 2013

(54) SYSTEM AND METHOD TO HANDLE PLAYING CARDS, EMPLOYING ELEVATOR MECHANISM

(75) Inventor: Richard Soltys, Mercer Island, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 1035 days.

(21) Appl. No.: 11/480,273

(22) Filed: Jun. 30, 2006

(65) Prior Publication Data

US 2007/0241498 A1 Oct. 18, 2007

Related U.S. Application Data

(60) Provisional application No. 60/791,513, filed on Apr. 12, 2006.

(51) Int. Cl.
*A63F 9/08* (2006.01)

(52) U.S. Cl. ..... 273/149 R; 273/149 P

(58) Field of Classification Search ..... 273/149 R, 273/149 P

See application file for complete search history.

(56) References Cited

U.S. PATENT DOCUMENTS

| | | | | |
|---|---|---|---|---|
| 1,727,800 | A | 9/1929 | Albert | |
| 1,890,504 | A | 12/1932 | Ferguson, Jr. | |
| 2,567,223 | A | 9/1951 | Maher et al. | |
| 2,663,418 | A | 12/1953 | Grunwald | 206/62 |
| 2,694,662 | A | 11/1954 | Hunter, Jr. | 154/121 |
| 2,731,271 | A | 1/1956 | Brown | |
| 3,222,071 | A | 12/1965 | Lang | 273/149 |
| 3,312,473 | A | 4/1967 | Friedman et al. | 273/149 |
| 3,377,070 | A | 4/1968 | Nottoli | 273/149 |
| 3,493,728 | A | 2/1970 | Braden, Jr. et al. | |
| 3,561,756 | A | 2/1971 | Barnett | 271/41 |
| 3,667,759 | A | 6/1972 | Barr | 273/152.1 |
| 3,690,670 | A | 9/1972 | Cassady et al. | 273/149 P |
| 3,751,041 | A | 8/1973 | Seifert | 273/149 P |
| 3,752,962 | A | 8/1973 | Greskovics | 235/61.11 D |

(Continued)

FOREIGN PATENT DOCUMENTS

| | | | |
|---|---|---|---|
| DE | 44 39 502 | C1 | 9/1995 |
| DE | 197 48 930 | A1 | 5/1998 |

(Continued)

OTHER PUBLICATIONS

English Translation of German Patent No. DE 197 48 930, publication date of May 14, 1998, inventor: Markeev.

(Continued)

*Primary Examiner* — William Pierce
(74) *Attorney, Agent, or Firm* — Seed IP Law Group PLLC

(57) ABSTRACT

A card shoe handling device includes a playing card output receiver including a playing card support surface and a ceiling at least partially disposed relatively over the playing card support surface. The playing card output receiver is sized and positioned to receive a number of playing cards handled by the playing card handling system. The playing card handling system also includes an elevator mechanism operable to selectively move the playing card output receiver between a lowered position and a raised position, where in the lowered position the ceiling limits access from an exterior of the playing card handling system to the playing cards carried by the card support surface of the playing card output receiver and in the raised position the ceiling does not limit access from the exterior of the playing card handling system to at least some of the playing cards carried by the playing card output receiver.

32 Claims, 23 Drawing Sheets

U.S. PATENT DOCUMENTS

| | | | | |
|---|---|---|---|---|
| 3,814,436 | A | 6/1974 | Boren | 273/149 P |
| 3,897,954 | A | 8/1975 | Erickson et al. | 273/149 R |
| 3,929,339 | A | 12/1975 | Mattioli | 273/148 A |
| 4,031,376 | A | 6/1977 | Corkin, Jr. | 235/156 |
| 4,241,921 | A | 12/1980 | Miller | 273/148 A |
| 4,244,582 | A | 1/1981 | Raees et al. | 273/293 |
| 4,310,160 | A | 1/1982 | Willette et al. | 273/149 R |
| 4,373,726 | A | 2/1983 | Churchill et al. | 273/138 A |
| 4,377,285 | A | 3/1983 | Kadlic | 273/148 A |
| 4,448,419 | A | 5/1984 | Telnaes | 273/143 R |
| 4,457,512 | A | 7/1984 | Stevenson | 273/148 A |
| 4,497,488 | A | 2/1985 | Plevyak et al. | 273/149 R |
| 4,512,580 | A * | 4/1985 | Matviak | 273/148 A |
| 4,531,187 | A | 7/1985 | Uhland | 364/412 |
| 4,531,909 | A | 7/1985 | Takeshita | 432/37 |
| 4,534,562 | A | 8/1985 | Cuff et al. | 273/149 P |
| 4,586,712 | A | 5/1986 | Lorber et al. | 273/149 R |
| 4,592,377 | A | 6/1986 | Paulsen et al. | 133/5 R |
| 4,636,846 | A | 1/1987 | Villarreal | 358/100 |
| 4,659,082 | A | 4/1987 | Greenberg | 273/149 R |
| 4,662,637 | A | 5/1987 | Pfeiffer | 273/149 P |
| 4,667,959 | A | 5/1987 | Pfeiffer et al. | 273/149 R |
| 4,693,480 | A | 9/1987 | Smith | 273/296 |
| 4,725,079 | A | 2/1988 | Koza et al. | 283/73 |
| 4,728,108 | A | 3/1988 | Neuwahl | 273/296 |
| 4,750,743 | A | 6/1988 | Nicoletti | 273/148 A |
| 4,770,421 | A | 9/1988 | Hoffman | 273/149 R |
| 4,807,884 | A | 2/1989 | Breeding | 273/149 R |
| 4,817,528 | A | 4/1989 | Baker | 101/395 |
| 4,822,050 | A | 4/1989 | Normand et al. | 273/149 P |
| 4,832,341 | A | 5/1989 | Muller et al. | 273/139 |
| 4,832,342 | A | 5/1989 | Plevyak et al. | 273/149 R |
| 4,885,700 | A | 12/1989 | Kondziolka et al. | 364/519 |
| 4,948,138 | A | 8/1990 | Pease et al. | 273/138 A |
| 4,951,950 | A | 8/1990 | Normand et al. | 273/149 P |
| 4,969,648 | A | 11/1990 | Hollinger et al. | 273/149 R |
| 4,995,615 | A | 2/1991 | Cheng | 273/292 |
| 4,998,737 | A | 3/1991 | Lamle | 273/296 |
| 5,000,453 | A | 3/1991 | Stevens et al. | 273/149 R |
| 5,039,102 | A | 8/1991 | Miller | 273/148 R |
| 5,053,612 | A | 10/1991 | Pielemeier et al. | 235/462 |
| 5,067,713 | A | 11/1991 | Soules et al. | 273/149 P |
| 5,096,197 | A | 3/1992 | Embury | 273/149 R |
| 5,110,134 | A | 5/1992 | Laughlin et al. | 273/293 |
| 5,114,153 | A | 5/1992 | Rosenwinkel et al. | 273/292 |
| 5,121,921 | A | 6/1992 | Friedman et al. | 273/149 P |
| 5,157,602 | A | 10/1992 | Fields et al. | 364/412 |
| 5,179,517 | A | 1/1993 | Sarbin et al. | 364/410 |
| 5,186,464 | A | 2/1993 | Lamle | 273/149 R |
| 5,199,710 | A | 4/1993 | Lamle | 273/149 R |
| 5,224,712 | A | 7/1993 | Laughlin et al. | 273/304 |
| 5,240,140 | A | 8/1993 | Huen | 221/13 |
| 5,258,837 | A | 11/1993 | Gormley | 358/140 |
| 5,259,907 | A | 11/1993 | Soules et al. | 156/277 |
| 5,261,667 | A | 11/1993 | Breeding | 273/149 R |
| 5,275,411 | A | 1/1994 | Breeding | 273/149 R |
| 5,303,921 | A | 4/1994 | Breeding | 273/149 R |
| 5,312,104 | A | 5/1994 | Miller | 273/148 R |
| 5,344,146 | A | 9/1994 | Lee | 273/149 R |
| 5,356,145 | A | 10/1994 | Verschoor | 273/149 R |
| 5,362,053 | A | 11/1994 | Miller | 273/148 R |
| 5,374,061 | A | 12/1994 | Albrecht | 273/149 R |
| 5,382,024 | A | 1/1995 | Blaha | 273/149 R |
| 5,386,103 | A | 1/1995 | DeBan et al. | 235/379 |
| 5,397,133 | A | 3/1995 | Penzias | 273/439 |
| 5,398,932 | A | 3/1995 | Eberhardt et al. | 273/138 A |
| 5,416,308 | A | 5/1995 | Hood et al. | 235/454 |
| 5,417,431 | A | 5/1995 | Gluck | 273/293 |
| 5,431,399 | A | 7/1995 | Kelley | 273/149 P |
| 5,445,377 | A | 8/1995 | Steinbach | 273/149 R |
| 5,487,544 | A | 1/1996 | Clapper, Jr. | 273/138 A |
| 5,505,449 | A | 4/1996 | Eberhardt et al. | 273/138 A |
| 5,507,489 | A | 4/1996 | Reibel et al. | 273/138 A |
| 5,511,784 | A | 4/1996 | Furry et al. | 273/143 R |
| 5,518,249 | A | 5/1996 | Sines et al. | 273/304 |
| 5,575,475 | A | 11/1996 | Steinbach | 273/149 R |
| 5,580,311 | A | 12/1996 | Haste, III | 463/29 |
| 5,584,483 | A | 12/1996 | Sines et al. | 273/149 R |
| 5,605,334 | A | 2/1997 | McCrea, Jr. | 273/309 |
| 5,605,504 | A | 2/1997 | Huang | 463/22 |
| 5,613,680 | A | 3/1997 | Groves et al. | 273/138.2 |
| 5,632,483 | A | 5/1997 | Garczynski et al. | 273/148 R |
| 5,643,086 | A | 7/1997 | Alcorn et al. | 463/29 |
| 5,654,050 | A | 8/1997 | Whalen-Shaw | 428/35.7 |
| 5,655,961 | A | 8/1997 | Acres et al. | 463/27 |
| 5,669,816 | A | 9/1997 | Garczynski et al. | 463/12 |
| 5,676,372 | A | 10/1997 | Sines et al. | 273/149 R |
| 5,681,039 | A | 10/1997 | Miller | 273/148 R |
| 5,683,085 | A | 11/1997 | Johnson et al. | 273/149 R |
| 5,685,543 | A | 11/1997 | Garner | 273/148 A |
| 5,692,748 | A | 12/1997 | Frisco et al. | 273/149 R |
| 5,695,189 | A | 12/1997 | Breeding et al. | 273/149 R |
| 5,698,839 | A | 12/1997 | Jagielinski et al. | 235/493 |
| 5,707,287 | A | 1/1998 | McCrea, Jr. | 463/27 |
| 5,711,525 | A | 1/1998 | Breeding | 273/292 |
| 5,718,427 | A | 2/1998 | Cranford et al. | 273/149 R |
| 5,722,893 | A | 3/1998 | Hill et al. | 463/47 |
| 5,735,525 | A | 4/1998 | McCrea, Jr. | 273/309 |
| 5,737,418 | A | 4/1998 | Saffari et al. | 380/9 |
| 5,766,074 | A | 6/1998 | Cannon et al. | 463/16 |
| 5,769,458 | A | 6/1998 | Carides et al. | 283/102 |
| 5,770,533 | A | 6/1998 | Franchi | 463/42 |
| 5,772,505 | A | 6/1998 | Garczynski et al. | 463/12 |
| 5,779,545 | A | 7/1998 | Berg et al. | 463/22 |
| 5,779,546 | A | 7/1998 | Meissner et al. | 463/25 |
| 5,788,573 | A | 8/1998 | Baerlocher et al. | 463/16 |
| 5,791,988 | A | 8/1998 | Nomi | 463/11 |
| 5,803,808 | A | 9/1998 | Strisower | 463/11 |
| 5,803,809 | A | 9/1998 | Yoseloff | 463/13 |
| 5,830,064 | A | 11/1998 | Bradish et al. | 463/22 |
| 5,830,068 | A | 11/1998 | Brenner et al. | 463/42 |
| 5,831,669 | A | 11/1998 | Adrain | 348/143 |
| 5,842,921 | A | 12/1998 | Mindes et al. | 463/16 |
| 5,850,447 | A | 12/1998 | Peyret | 380/25 |
| 5,863,249 | A | 1/1999 | Inoue | 463/20 |
| 5,871,400 | A | 2/1999 | Yfantis | 463/22 |
| 5,895,048 | A | 4/1999 | Smith, Jr. | 273/293 |
| 5,911,626 | A | 6/1999 | McCrea, Jr. | 463/27 |
| 5,919,091 | A | 7/1999 | Bell et al. | 463/25 |
| 5,941,769 | A | 8/1999 | Order | 463/12 |
| 5,941,771 | A | 8/1999 | Haste, III | 463/17 |
| 5,944,310 | A | 8/1999 | Johnson et al. | 273/149 R |
| 5,945,654 | A | 8/1999 | Huang | 235/449 |
| 5,949,050 | A | 9/1999 | Fosbenner et al. | 235/449 |
| 5,954,654 | A | 9/1999 | Eaton et al. | 600/462 |
| 5,967,893 | A | 10/1999 | Lawrence et al. | 463/10 |
| 5,971,851 | A | 10/1999 | Pascal et al. | 463/24 |
| 5,989,122 | A | 11/1999 | Roblejo | 463/22 |
| 6,010,404 | A | 1/2000 | Walker et al. | 463/21 |
| 6,019,368 | A | 2/2000 | Sines et al. | 273/149 R |
| 6,039,650 | A | 3/2000 | Hill | 463/47 |
| 6,042,150 | A | 3/2000 | Daley | 283/86 |
| 6,062,981 | A | 5/2000 | Luciano, Jr. | 463/26 |
| 6,068,258 | A | 5/2000 | Breeding et al. | 273/149 R |
| 6,068,552 | A | 5/2000 | Walker et al. | 463/21 |
| 6,093,103 | A | 7/2000 | McCrea, Jr. | 463/27 |
| 6,104,815 | A | 8/2000 | Alcorn et al. | 380/251 |
| 6,106,396 | A | 8/2000 | Alcorn et al. | 463/29 |
| 6,117,009 | A | 9/2000 | Yoseloff | 463/20 |
| 6,117,012 | A | 9/2000 | McCrea, Jr. | 463/27 |
| 6,126,166 | A | 10/2000 | Lorson et al. | 273/148 R |
| 6,139,014 | A | 10/2000 | Breeding et al. | 273/149 R |
| 6,145,838 | A | 11/2000 | White | 273/295 |
| 6,149,154 | A | 11/2000 | Grauzer et al. | 273/149 R |
| 6,149,522 | A | 11/2000 | Alcorn et al. | 463/29 |
| 6,152,822 | A | 11/2000 | Herbert | 463/22 |
| 6,152,824 | A | 11/2000 | Rothschild et al. | 463/42 |
| 6,159,096 | A | 12/2000 | Yoseloff | 463/20 |
| 6,165,069 | A | 12/2000 | Sines et al. | 463/12 |
| 6,166,763 | A | 12/2000 | Rhodes et al. | 348/143 |
| 6,186,892 | B1 | 2/2001 | Frank et al. | 463/19 |
| 6,193,607 | B1 | 2/2001 | Kay | 463/22 |
| 6,196,547 | B1 | 3/2001 | Pascal et al. | 273/292 |
| 6,217,447 | B1 | 4/2001 | Lofink et al. | 463/12 |
| 6,219,836 | B1 | 4/2001 | Wells et al. | 717/11 |
| 6,234,898 | B1 | 5/2001 | Belamant et al. | 463/25 |
| 6,250,632 | B1 | 6/2001 | Albrecht | 273/149 R |

6,251,014 B1 6/2001 Stockdale et al. ..... 463/16
6,254,096 B1 7/2001 Grauzer et al. ..... 273/149 R
6,254,484 B1 7/2001 McCrea, Jr. ..... 463/27
6,264,561 B1 7/2001 Saffari et al. ..... 463/42
6,267,248 B1 7/2001 Johnson et al. ..... 209/547
6,267,671 B1 7/2001 Hogan ..... 463/25
6,275,586 B1 8/2001 Kelly ..... 380/46
6,293,546 B1 9/2001 Hessing et al. ..... 273/138.2
6,293,864 B1 9/2001 Romero ..... 463/12
6,299,167 B1 10/2001 Sines et al. ..... 273/149 R
6,299,170 B1 10/2001 Yoseloff ..... 273/292
6,299,536 B1 10/2001 Hill ..... 463/47
6,312,334 B1 11/2001 Yoseloff ..... 463/25
6,313,871 B1 11/2001 Schubert ..... 348/143
6,315,664 B1 11/2001 Baerlocher et al. ..... 463/21
6,325,373 B1 12/2001 Breeding et al. ..... 273/149 R
6,346,044 B1 2/2002 McCrea, Jr. ..... 463/27
6,357,746 B1 3/2002 Sadowski ..... 273/148 R
6,361,044 B1 3/2002 Block et al. ..... 273/149 R
6,371,482 B1 4/2002 Hall, Jr. ..... 273/138.1
6,386,973 B1 5/2002 Yoseloff ..... 463/13
6,394,900 B1 5/2002 McGlone et al. ..... 463/20
6,394,902 B1 5/2002 Glavich ..... 463/20
6,402,142 B1 6/2002 Warren et al. ..... 273/149 R
6,403,908 B2 6/2002 Stardust et al. ..... 209/587
6,406,023 B1 6/2002 Rowe ..... 273/292
6,406,369 B1 6/2002 Baerlocher et al. ..... 463/20
6,409,595 B1 6/2002 Uihlein et al. ..... 463/29
6,409,602 B1 6/2002 Wiltshire et al. ..... 463/42
6,413,162 B1 7/2002 Baerlocher et al. ..... 463/20
6,425,824 B1 7/2002 Baerlocher et al. ..... 463/16
6,439,996 B2 8/2002 LeMay et al. ..... 463/29
6,446,864 B1 9/2002 Kim et al. ..... 235/382
6,457,715 B1 10/2002 Friedman ..... 273/274
6,460,848 B1 10/2002 Soltys et al. ..... 273/149 R
6,464,581 B1 10/2002 Yoseloff et al. ..... 463/20
6,468,156 B1 10/2002 Hughs-Baird et al. ..... 463/25
6,471,208 B2 10/2002 Yoseloff et al. ..... 273/143 R
6,485,366 B1 11/2002 Rowe ..... 463/13
6,488,581 B1 12/2002 Stockdale ..... 463/29
6,488,585 B1 12/2002 Wells et al. ..... 463/43
6,502,116 B1 12/2002 Kelly et al. ..... 708/250
6,508,709 B1 1/2003 Karmarkar ..... 463/42
6,508,710 B1 1/2003 Paravia et al. ..... 463/42
6,514,140 B1 2/2003 Storch ..... 463/25
6,517,435 B2 2/2003 Soltys et al. ..... 463/25
6,517,436 B2 2/2003 Soltys et al. ..... 463/29
6,517,437 B1 2/2003 Wells et al. ..... 463/30
6,520,857 B2 2/2003 Soltys et al. ..... 463/29
6,527,271 B2 3/2003 Soltys et al. ..... 273/148 R
6,530,836 B2 3/2003 Soltys et al. ..... 463/29
6,530,837 B2 3/2003 Soltys et al. ..... 463/29
6,533,276 B2 3/2003 Soltys et al. ..... 273/148 R
6,533,662 B2 3/2003 Soltys et al. ..... 463/25
6,533,664 B1 3/2003 Crumby ..... 463/42
6,543,770 B1 4/2003 Kaji et al. ..... 273/148 R
6,561,897 B1 5/2003 Bourbour et al. ..... 463/13
6,568,678 B2 5/2003 Breeding et al. ..... 273/149 R
6,575,833 B1 6/2003 Stockdale ..... 463/29
6,578,847 B1 6/2003 Hedrick et al. ..... 273/138.2
6,579,179 B2 6/2003 Poole et al. ..... 463/25
6,579,180 B2 6/2003 Soltys et al. ..... 463/25
6,579,181 B2 6/2003 Soltys et al. ..... 463/25
6,581,747 B1 6/2003 Charlier et al. ..... 194/214
6,582,301 B2 6/2003 Hill ..... 463/11
6,588,750 B1 7/2003 Grauzer et al. ..... 273/149 R
6,588,751 B1 7/2003 Grauzer et al. ..... 273/149 R
6,595,857 B2 7/2003 Soltys et al. ..... 463/29
6,599,185 B1 7/2003 Kaminkow et al. ..... 463/16
6,629,184 B1 9/2003 Berg et al. ..... 710/306
6,629,889 B2 10/2003 Mothwurf ..... 463/25
6,638,161 B2 10/2003 Soltys et al. ..... 463/12
6,641,484 B2 11/2003 Oles et al. ..... 463/47
6,651,981 B2 11/2003 Grauzer et al. ..... 273/149 R
6,651,982 B2 11/2003 Grauzer et al. ..... 273/149 R
6,652,379 B2 11/2003 Soltys et al. ..... 463/22
6,655,684 B2 12/2003 Grauzer et al. ..... 273/149 R
6,659,460 B2 12/2003 Blaha et al. ..... 273/149 R
6,663,490 B2 12/2003 Soltys et al. ..... 463/25
6,675,152 B1 1/2004 Prasad et al. ..... 705/64
6,676,127 B2 1/2004 Johnson et al. ..... 273/149 R
6,676,516 B2 1/2004 Baerlocher et al. ..... 463/25
6,676,522 B2 1/2004 Rowe et al. ..... 463/42
6,685,567 B2 2/2004 Cockerille et al. ..... 463/43
6,685,568 B2 2/2004 Soltys et al. ..... 463/47
6,688,979 B2 2/2004 Soltys et al. ..... 463/25
6,698,756 B1 3/2004 Baker et al. ..... 273/149 R
6,698,759 B2 3/2004 Webb et al. ..... 273/292
6,712,693 B1 3/2004 Hettinger ..... 463/20
6,712,696 B2 3/2004 Soltys et al. ..... 463/25
6,719,288 B2 4/2004 Hessing et al. ..... 273/149 R
6,726,205 B1 4/2004 Purton ..... 273/148 R
6,728,740 B2 4/2004 Kelly et al. ..... 708/250
6,729,956 B2 5/2004 Wolf et al. ..... 463/25
6,729,961 B1 5/2004 Millerschone ..... 463/30
6,752,312 B1 6/2004 Chamberlain et al. ..... 235/375
6,758,751 B2 7/2004 Soltys et al. ..... 463/29
6,823,419 B2 11/2004 Berg et al. ..... 710/306
6,846,238 B2 1/2005 Wells ..... 463/39
6,857,961 B2 2/2005 Soltys et al. ..... 463/47
6,866,586 B2 3/2005 Oberberger et al. ..... 463/42
6,889,979 B2 5/2005 Blaha et al. ..... 273/149 R
6,896,618 B2 5/2005 Benoy et al. ..... 463/25
6,905,411 B2 6/2005 Nguyen et al. ..... 463/25
6,923,719 B2 8/2005 Wolf ..... 463/16
6,955,599 B2 10/2005 Bourbour et al. ..... 463/13
6,962,530 B2 11/2005 Jackson ..... 463/29
6,964,612 B2 11/2005 Soltys et al. ..... 463/47
6,991,544 B2 1/2006 Soltys et al. ..... 463/42
7,011,309 B2 3/2006 Soltys et al. ..... 273/149 R
7,029,009 B2 4/2006 Grauzer et al. ..... 273/149 P
7,036,818 B2 5/2006 Grauzer et al. ..... 273/149 R
7,073,791 B2 7/2006 Grauzer et al. ..... 273/149 R
7,137,627 B2 11/2006 Grauzer et al. ..... 273/149 R
7,255,344 B2 8/2007 Grauzer et al. ..... 273/149 R
1,034,402 A1 7/2012 Hardy
2002/0049909 A1 4/2002 Jackson et al. ..... 713/188
2002/0063389 A1 5/2002 Breeding et al. ..... 273/292
2002/0116615 A1 8/2002 Nguyen et al. ..... 713/168
2002/0147042 A1 10/2002 Vuong et al. ..... 463/40
2002/0163125 A1 11/2002 Grauzer et al. ..... 273/149 R
2002/0187821 A1 12/2002 Soltys et al. ..... 463/11
2003/0032474 A1 2/2003 Kaminkow ..... 463/25
2003/0036425 A1 2/2003 Kaminkow et al. ..... 463/25
2003/0064774 A1 4/2003 Fujimoto et al. ..... 463/16
2003/0083126 A1 5/2003 Paulsen ..... 463/25
2003/0130032 A1 7/2003 Martinek et al. ..... 463/29
2003/0144965 A1 7/2003 Prasad et al. ..... 705/65
2003/0176209 A1 9/2003 Soltys et al. ..... 463/13
2003/0176218 A1 9/2003 LeMay et al. ..... 463/25
2003/0203755 A1 10/2003 Jackson ..... 463/42
2003/0228912 A1 12/2003 Wells et al. ..... 463/43
2004/0033095 A1 2/2004 Saffari et al. ..... 400/120.01
2004/0043820 A1 3/2004 Schlottmann ..... 463/43
2004/0067789 A1 4/2004 Grauzer et al. ..... 463/11
2004/0068654 A1 4/2004 Cockerille et al. ..... 713/168
2004/0092310 A1 5/2004 Brosnan et al. ..... 463/42
2004/0100026 A1 5/2004 Haggard ..... 273/304
2004/0108255 A1 6/2004 Johnson ..... 209/547
2004/0108654 A1 6/2004 Grauzer et al. ..... 273/148 R
2004/0147314 A1 7/2004 LeMay et al. ..... 463/30
2004/0169332 A1 9/2004 Grauzer et al. ..... 273/149 R
2004/0207156 A1 10/2004 Soltys et al. ..... 273/292
2004/0224777 A1 11/2004 Smith et al. ..... 463/47
2005/0012270 A1 1/2005 Schubert et al. ..... 273/149 R
2005/0023752 A1 2/2005 Grauzer et al. ..... 273/149 R
2005/0026680 A1 2/2005 Gururajan ..... 463/25
2005/0026681 A1 2/2005 Grauzer et al. ..... 463/29
2005/0026682 A1 2/2005 Grauzer et al. ..... 463/29
2005/0040594 A1 2/2005 Krenn et al. ..... 273/149 R
2005/0051955 A1 3/2005 Schubert et al. ..... 273/149 R
2005/0051965 A1 3/2005 Gururajan ..... 273/292
2005/0054408 A1 3/2005 Steil et al. ..... 463/11
2005/0059479 A1 3/2005 Soltys et al. ..... 463/29
2005/0062226 A1 3/2005 Schubert et al. ..... 273/149 R
2005/0062227 A1 3/2005 Grauzer et al. ..... 273/149 R
2005/0073102 A1 4/2005 Yoseloff et al. ..... 273/292
2005/0093230 A1 5/2005 Grauzer et al. ..... 273/149 R

| | | | | |
|---|---|---|---|---|
| 2005/0101367 | A1 | 5/2005 | Soltys et al. | 463/12 |
| 2005/0121852 | A1 | 6/2005 | Soltys et al. | 273/149 P |
| 2005/0137005 | A1 | 6/2005 | Soltys et al. | 463/13 |
| 2005/0164761 | A1 | 7/2005 | Tain | 463/13 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0001217 | A1 | 1/2006 | Soltys et al. | 273/292 |

FOREIGN PATENT DOCUMENTS

| | | | |
|---|---|---|---|
| EP | 0 327 069 | A2 | 8/1989 |
| EP | 0 790 848 | | 8/1997 |
| EP | 0 700 980 | B1 | 11/1999 |
| EP | 1 291 045 | A2 | 3/2003 |
| FR | 530732 | | 12/1921 |
| FR | 24238 | | 3/1922 |
| FR | 2 775 196 | | 8/1999 |
| GB | 2 246 520 | A | 2/1992 |
| GB | 2 370 791 | A | 7/2002 |
| GB | 2 380 143 | A | 4/2003 |
| WO | WO 96/36253 | | 11/1996 |
| WO | WO 99/43403 | | 9/1999 |
| WO | WO 02/05914 | A1 | 1/2002 |
| WO | WO 02/051512 | A2 | 7/2002 |
| WO | WO 03/004116 | A1 | 1/2003 |
| WO | WO 03/60846 | A2 | 7/2003 |
| WO | WO 2006/039308 | A2 | 4/2006 |

OTHER PUBLICATIONS

Bulaysky, J., "Tracking the Tables," *Casino Journal*, May 2004, pp. 44-47, accessed Dec. 21, 2005, URL = http://www.ascendgaming.com/cj/vendors_manufacturers_table/Trackin916200411141AM.htm, 5 pages.

Burke, A., "Tracking the Tables," reprinted from *International Gaming & Wagering Business*, Aug. 2003, 4 pages.

Griffin, P., *The Theory of Blackjack*, GBC Press, Las Vegas, Nevada, 1979, 190 pages.

Gros, R., "All You Ever Wanted to Know About Table Games," reprinted from *Global Gaming Business*, Aug. 1, 2003, 2 pages.

Pro, L.V., "Book Review—The Card Counter's Guide to Casino Surveillance," *Blackjack Insider Newsletter*, May 2003, #40, accessed Aug. 25, 2006, URL = http:/bjinsider.com/newsletter_40_surveillance.shtml, 5 pages.

Scarne, J., *Scarne's Encyclopedia of Games*, Harper & Row, New York, 1973, p. 153.

Scarne, J., *Scarne's New Complete Guide to Gambling*, Simon & Schuster, Inc., New York, 1974, pp. 358-359.

Snyder, A., "The High-Tech Eye," excerpt from *Blackjack Forum*, Spring 1997, accessed Dec. 21, 2005, from Casino Software & Services, LLC, URL = http://www.casinosoftware.com/bj_forum.html.

Terdiman, D., "Who's Holding the Aces Now?", reprinted from *Wired News*, Aug. 18, 2003, 2 pages.

Ward, K., "BJ Tracking System has Players Down for the Count," *Gaming Today*, Mar. 5, 2002, accessed Dec. 21, 2005, from Casino Software & Services, LLC, URL = http://www.casinosoftware.com/gaming_today.html.

Winkler, C., "Product Spotlight: MindPlay," reprinted from *Gaming and Leisure Technology*, Fall 2003, 2 pages.

Bally TMS, "MP21—Automated Table Tracking/Features," 2 pages, Nov. 2005.

Bally TMS, "MPBacc—Intelligent Table Tracking/Features," 2 pages, Nov. 2005.

Bally TMS, "MPBacc—Specifications/Specifications," 2 pages, Nov. 2005.

Bravo Gaming Systems, "Casino Table Wager Analysis and Player Tracking System—Table Operations/Unique Features," accessed Apr. 11, 2005, URL = http://www.genesisgaming.com, 4 pages.

Casino Software & Services, LLC., accessed Aug. 25, 2006, URL = http:/casinosoftware.com/home.html, 6 pages.

International Guild of Hospitality & Restaurant Managers, "Shuffle Master, Inc. (NasdagNM:SHFL)," accessed Dec. 30, 2003, URL = http://hospitalityguide.com/Financial/Casinos/Shuffle.htm, 3 pages.

Mikohn, "Mikohn Tablelink—The Industry's Premier Table Tracking Solution Delivers Imprdvements Straight to the Bottom Line," 2 pages, before Jan. 1, 2004.

Mikohn, "Tablelink™, The New Standard in Table Games," before Jan. 1, 2004, 14 pages.

Plaintiffs Declaration of Lawrence Luciano in Opposition to Shuffle Master's Motion for Preliminary Injunction, *Card, LLC* v. *Shuffle Master, Inc*., D. Nev. (No. CV-N-03-0244-ECR-(RAM)), Nov. 24, 2003.

Shuffle Master, Inc., "Shuffle Master Announces New Products; Intelligent Table System to Be Debuted at G2E," Sep. 10, 2003, 2 pages.

* cited by examiner

SYSTEM AND METHOD TO HANDLE PLAYING CARDS, EMPLOYING ELEVATOR MECHANISM

CROSS REFERENCE TO RELATED APPLICATIONS

This application claims the benefit under 35 U.S.C. §119(e) of U.S. Provisional Patent Application Ser. No. 60/791,513, filed Apr. 12, 2006.

BACKGROUND OF THE INVENTION

1. Field of the Invention

This description generally relates to the field of table gaming, and more particularly to a playing card handling system to sort and/or shuffle or otherwise handle playing cards.

2. Description of the Related Art

There are numerous games played with playing cards. For example, blackjack, baccarat, various types of poker, LET IT RIDE®, and/or UNO®, to name a few. Games may be played with one or more standard decks of playing cards. A standard deck of playing cards typically comprises fifty-two playing cards, each playing card having a combination of a rank symbol and a suit symbol, selected from thirteen rank symbols (i.e., 2, 3, 4, 5, 6, 7, 8, 9, 10, J, Q, K, and A) and four suit symbols (i.e., ♡, ♣, ♢, and ♠). Some games may employ sets of playing cards including a fewer or a greater number of playing cards than those comprising a standard deck. Some games may include non-standard playing cards, for example playing cards with symbols other than the rank and suit symbols associated with a standard deck.

In some instances playing card games involve wagering, where money and/or prizes may be won. In other instances playing card games are played without wagering, for fun or recreation. In either case, it is typically desirable to randomize the set of playing cards before dealing the playing cards to the participants (e.g., players and/or dealer). Randomizing is typically referred to as shuffling, which describes the act of riffling or interleaving the corners of two stacks of playing cards by hand.

In other instances, it may be useful to arrange or otherwise sort playing cards into a defined order. For example, it may be desirable to form sorted packs or decks of playing cards after the playing cards are collected from one or more gaming tables in a casino. The packs or decks can then be checked for completeness, and reused, or sold.

Numerous devices and systems have been developed for automatically randomizing or sorting playing cards. One approach attempts to mechanically replicate riffling or interleaving the corners of two stacks of playing cards. Such an approach is shown, for example, in U.S. Pat. Nos. 4,807,884; 5,261,667; 5,275,411; and 5,303,921. Another approach is to separate the playing cards into two distinct stacks and randomly move playing cards from each stack into a third stack. Such an approach is shown, for example, in U.S. Pat. Nos. 5,695,189; 6,068,258; 6,139,014; 6,325,373; and 6,568,678. Yet another approach is to place playing cards into random positions in a stack of playing cards carried by an elevator. Such an approach typically involves a gripper mechanism to support an upper portion of the stack, while the floor of the elevator is dropped to create a space into which the playing card is inserted. Such an approach is shown, for example, in U.S. Pat. Nos. 5,683,085; 5,944,310; 6,651,981; and 6,651,982. A further approach is to insert playing cards into selected compartments, either randomly or in a sorted order. Such an approach is shown, for example, in U.S. Pat. Nos. 6,149,154; 6,254,096; 6,267,248; 6,588,750; 6,588,751; 6,655,684; 6,659,460; 6,676,127; and 6,889,979. Still a further approach is to withdraw or eject playing cards in a random order from an array of playing card receptacles. Such an approach is shown, for example, in U.S. Pat. Nos. 5,382,024; 5,584,483; 5,676,372; 6,019,368; 6,299,167; and 6,698,756.

Whether used for randomizing or sorting, card handling devices must deliver the randomized or sorted playing cards to the user (e.g., dealer). It will typically be desirable to present the playing cards in a highly aligned stack, in a manner that the playing cards are easily and quickly accessible by the user. This may be particularly desirable where the playing cards are delivered at a gaming table in a casino environment. Casinos highly value speed, which maintains customer interest, and which allows the maximum utilization of the casino facilities. Casinos also highly value security. Thus, casinos employ elaborate mechanisms and procedures to prevent players and/or casino personnel (e.g., dealers) from gaining a knowledge of a playing card value before the playing card is dealt. Consequently, devices and methods that facilitate the easy, quick and secure delivery of playing cards are desirable.

SUMMARY OF THE INVENTION

In one embodiment, a playing card handling system comprises: a playing card input receiver sized and positioned to receive a number of playing cards to be handled by the playing card handling system; a playing card output receiver sized and positioned to receive a number of playing cards handled by the playing card handling system, the playing card output receiver comprising a playing card support surface, a ceiling at least partially disposed relatively over the playing card support surface, and at least one member physically coupling the ceiling to the playing card support surface for movement therewith; at least one playing card transport path between the playing card input receiver and the playing card output receiver, along which at least some of the playing cards pass from the playing card input receiver to the playing card output receiver; at least one intermediary playing card receiver positioned in the at least one playing card transport path between the playing card input receiver and the playing card output receiver; and an elevator mechanism physically coupled to the playing card output receiver and operable to selectively move the playing card output receiver between a lowered position and a raised position, where in the lowered position the ceiling limits access from an exterior of the playing card handling system to the playing cards carried by the card support surface of the playing card output receiver and in the raised position the ceiling does not limit access from the exterior of the playing card handling system to at least some of the playing cards carried by the playing card output receiver.

In another embodiment, a playing card handling system comprises: a playing card input receiver positioned to receive a number of playing cards to be ordered by the playing card handling system; a playing card output receiver positioned to provide a number of playing cards ordered by the playing card handling system, the playing card output receiver comprising a playing card support surface, a ceiling at least partially disposed relatively over the playing card support surface, and at least one member physically coupling the ceiling to the playing card support surface for movement therewith; and ordering means for providing the playing cards received in the playing card input receiver to the playing card output receiver in an order different from an order of the playing cards in the playing card input receiver.

In a further embodiment, a method of operating a playing card handling system comprises: receiving a number of playing cards to be handled by the playing card handling system at the playing card input receiver; positioning the input playing card receiver in a lowered position, where in the lowered position a ceiling of the input playing card receiver limits access from an exterior of the playing card handling system to playing cards carried by the playing card output receiver; providing at least some of the playing cards received at the playing card input receiver to the playing card output receiver in an order when the playing card output receiver is in the lowered position different from an order of the playing cards in the playing card input receiver; and positioning the playing card output receiver in a raised position, where in the raised position the ceiling of the playing card output receiver does not limit access from an exterior of the playing card handling system to playing cards carried by the playing card output receiver.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

Figure 1A:
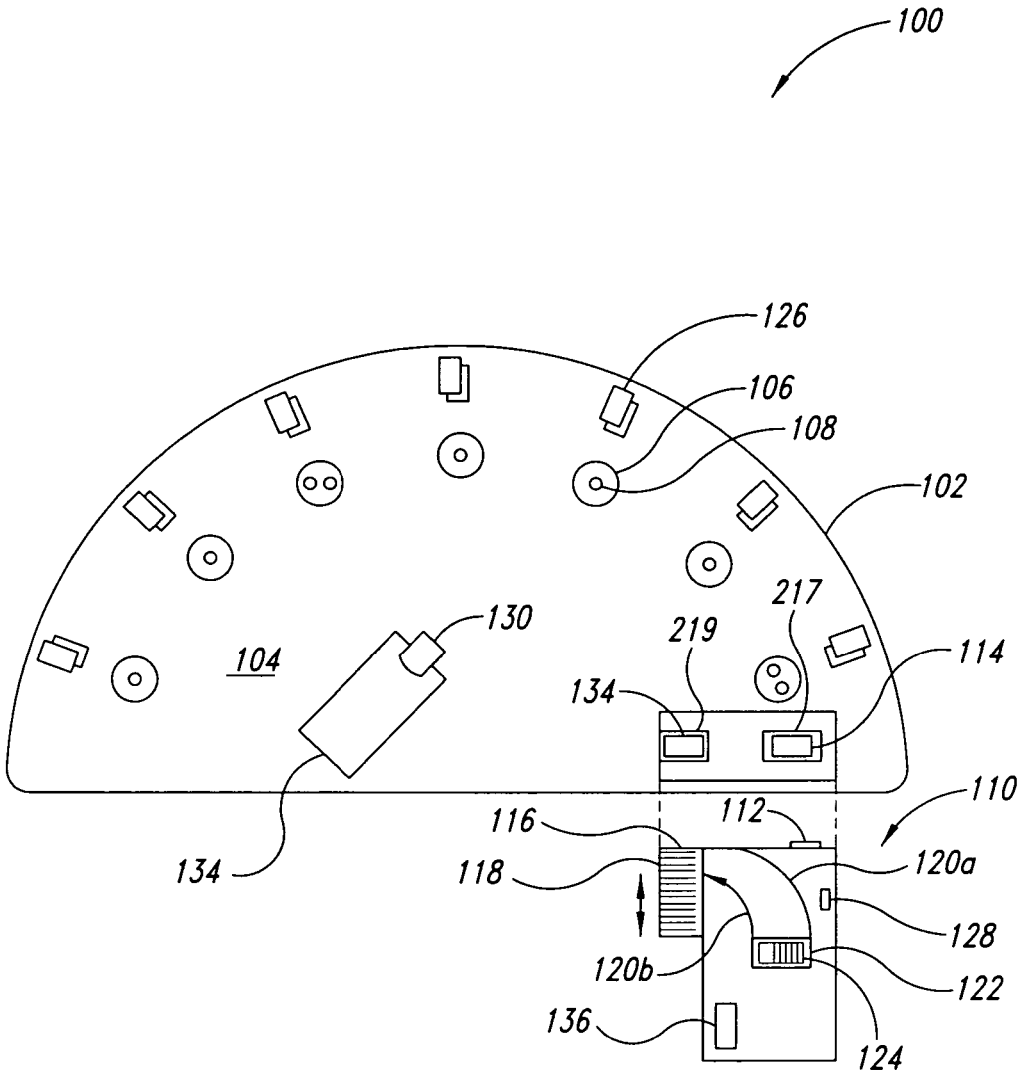
FIG. 1A is a schematic diagram of a gaming environment having a playing card handling system in operation with a gaming table, according to one illustrated embodiment.

In the following description, certain specific details are set forth in order to provide a thorough understanding of various embodiments of the invention. However, one skilled in the art will understand that the invention may be practiced without these details. In other instances, well-known structures associated with computers, computer networks, communications interfaces, sensors and/or transducers, mechanical drive trains, and/or optical and/or radio frequency (RF) readers may not be shown or described in detail to avoid unnecessarily obscuring the description.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the claimed invention.

This description generally relates to a gaming environment having a playing card handling system to arrange, sort, and/or shuffle (e.g., randomize) or otherwise handle playing cards. Other devices or systems associated with gaming, such as those used to automate, enhance, monitor, and/or detect some aspect of a game played at a gaming table, may interface or otherwise communicate with the playing card handling system.

For purposes of clarity and brevity, the playing card handling system described and illustrated herein may reference certain card games such as blackjack, baccarat, various types of poker, LET IT RIDE®, and/or UNO®. However, it is understood and appreciated that this description is generally applicable to a variety of casino-type games and/or gaming tables, or may be generally applicable to other recreational card games. The playing card handling system described herein may be useful in wagering type card games and non-wagering type card games.

In addition, it is understood that the playing card handling system may be capable managing cards that do not necessarily correspond to the standard playing cards, for example cards that are larger or smaller, shaped differently, and/or made from something other than traditional card stock material. Playing cards may include one or more decks of standard playing cards, where each standard deck includes fifty-two (52) playing cards. Standard playing cards typically have uniform backs, and faces which each bear a respective combination of a first primary symbol and a second primary symbol. The first primary symbol may be selected from a standard set of playing card rank symbols (i.e., 2, 3, 4, 5, 6, 7, 8, 9, 10, J, Q, K, and A) and the second primary symbol may be selected from a standard set of playing card suit symbols (i.e., ♡, ♣, ◇, and ♤). In some embodiments, the playing cards may include playing cards other than those found in a complete standard deck, or decks with a greater or less distribution of particular playing cards, for example less face cards or more face cards. In other embodiments, the playing cards may have non-standard symbols (e.g., slot machine symbols such as bars, lemons, cherries), graphics, backings, etc. As discussed below, the symbols may even be modified to add, enhance, or alter the value or significance of the playing card. In one embodiment, the playing cards are dual sided playing cards as described in U.S. patent application Ser. No. 10/902,436, which published on Jun. 2, 2005.

Brief Overview of the Playing Card Handling System

FIG. 1A shows a gaming environment 100 including a gaming table 102 having a surface 104. The surface 104 of the gaming table 102 typically bears a number of demarcations related to the game, for example betting circles 106 (only one called out in Figure) demarcating areas for placing wagers 108 (only one called out in Figure) and player positions spatially associated with respective ones of the betting circles 106.

The gaming environment 100 also includes a playing card handling system 110. The playing card handling system 110 can be coupled to, proximate to, or remotely located from the gaming table 102. For example, the playing card handling system 110 is coupled to the gaming table 102, and may be installed within the gaming table 102, and/or installed partially or fully underneath the surface 104 of the gaming table 102. Also for example, the playing card handling system 110 is installed remotely from the gaming table 102, such as in a restricted area of a casino where decks of playing cards are received, sorted, and repacked.

The playing card handling system 110 includes a playing card input receiver 112, sized and positioned to receive collected cards 114 into the playing card handling system 110. The playing card input receiver 112 may, for example, receive collected cards 114 externally from the playing card handling system 110.

The playing card handling system 110 also includes a playing card output receiver 116 sized and positioned to deliver deliverable cards 118 from the playing card handling system 110. The playing card output receiver 116 may, for example, deliver the deliverable cards 118 externally from the playing card handling system 110.

Playing cards move between the playing card input receiver 112 and the playing card output receiver 116 along one or more playing card transport paths, illustrated by arrows 120*a*, 120*b*. The playing card handling system 110 typically also includes one or more intermediary playing card receivers 122 in the playing card transport path 120*a*, 120*b* between the playing card input receiver 112 and the playing card output receiver 116. The intermediary playing card receivers 122 may, for example, take the form of storage devices such as carousels, arrays, racks, trays, bins or equivalent devices. The intermediary playing card receivers 122 may temporarily hold inventory cards 124 to implement or facilitate the arranging, ordering, sorting and/or shuffling of the playing cards by the playing card handling system 110. A variety of intermediary playing card receivers 122 are discussed in detail below.

While during a game, any given playing card may move from the gaming table 102, completely through the playing card handling system 110 and back onto the gaming table 102, in describing the operation of the playing card handling system 110 it is convenient to refer to playing cards based on the location of the playing cards at a particular moment within the gaming environment 100. Thus, for purposes of clarity, the playing cards may be referenced herein based on their location within the gaming environment 100, as described below with reference to FIGS. 1A and 1B.

During a card game, at least some of the playing cards will be in-play, where the in-play cards 126 are those currently in use by a gaming participant (e.g., player and/or dealer) to form a hand of playing cards according to a set of rules of the particular game being played at the gaming table 102. For example, in blackjack the in-play cards 126 prior to the first hit card being dealt include the cards forming the initial hands (e.g., first two cards dealt to each participant). During and after the card game, the in-play cards 126 are discarded by, and/or collected from, the participants and are referred to as collected cards 114. The collected cards 114 may be returned to the input playing card receiver 112 of the playing card handling system 110, for example by the dealer.

The collected cards 114 are successively moved into the playing card handling system 110 at which point they are referred to as transitional cards 128. The transitional cards 128 are directed along various playing card transport paths (e.g., 120*a*, 120*b*) and may be placed in one or more of the intermediary playing card receivers 122, at which point the playing cards are referred to as inventory cards 124. Additionally or alternatively, as illustrated by the broken line arrows of FIG. 1B, the transitional cards 128 may be moved directly to an arranged or ordered group referred to herein as deliverable cards 118.

From time-to-time, the deliverable cards 118 are provided to a location accessible by a participant at the gaming table, at which point the playing cards are referred to herein as dealable cards 130. For example, the playing cards 130 may be positioned at least partially extending above the surface 104 of the gaming table 102. In some embodiments, the deliverable cards 118 are made accessible only after a determined number of deliverable cards 118 have been grouped together. In some embodiments, the dealable cards 130 are placed in a card shoe 134 before being dealt to participants. The deliverable cards 118, and hence the dealable cards 130, are arranged in a different order or sequence than the order or sequence of collected cards 114 received at the playing card input receiver 112.

In some embodiments, the deliverable cards 118 are arranged in an order that matches at least a portion of a virtual sequence 136. In one embodiment, the virtual sequence 136 comprises electronic data providing an ordered sequence for the deliverable cards 118. The electronic data may, for example, take the form of an ordered list of identifiers, each identifier identifying a respective playing card. For example, the electronic data may take the form of an ordered list of playing card values that represent the rank and/or suit of the playing cards. The playing card values may, for example, take the form of the numbers 0-51, each associated with a respective rank and suit combination. Alternatively, playing card values may, for example, take the form of two numbers, a first number representing a rank (e.g., 0-12) and a second number representing a suit (e.g., 0-3). Alternatively, playing card values may, for example, take the form of numbers that are each uniquely associated with a playing card from a set of playing cards greater than a standard deck of 52 playing cards. Thus, there may be two or more playing cards of the same rank and suit, each of which is identified by a unique identifier such as a serial number. The virtual sequence 136 may comprise a fewer or greater number of playing cards than the number of playing cards in a standard, fifty-two (52) card deck.

In some embodiments, the virtual sequence 136 may be computationally generated (e.g., via a random or pseudo random number generator (RNG)) executed by a suitable controller. Additionally or alternatively, the virtual sequence 136 may be determined from predefined data such as one or more lookup tables. For example, the virtual sequence 136 may comprise a sorted order, such as the order of playing cards in a new deck, prior to shuffling.

Once the virtual sequence 136 is at least partially determined, the playing card handling system 110 arranges or builds the deliverable cards 118 in an order according to at least a portion of the virtual sequence 136. By way of example, the deliverable cards 118 can be selected from the transitional cards 128 or may be come directly from the inventory cards 124. The structural aspects, programmability, and controllability of the playing card handling system 110 is described in more detail below.

Structural Aspects of the Playing Card Handling System

FIGS. 2A-2D show a playing card handling system 200 for handling playing cards according to one illustrated embodiment.

Figure 2A:
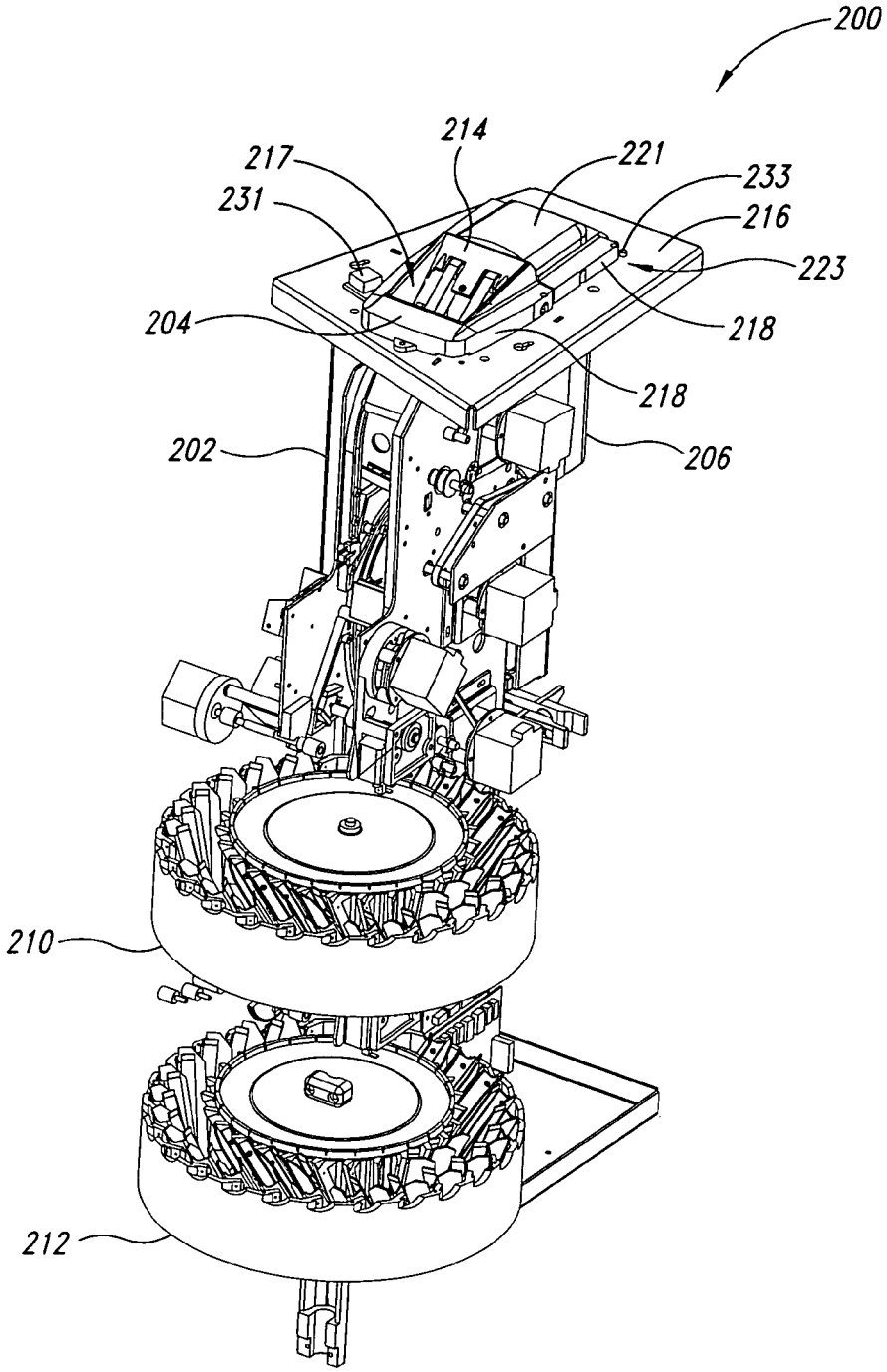
FIG. 2A is a front, top, right side, isometric view of a playing card handling system, according to one illustrated embodiment.
Figure 2B:
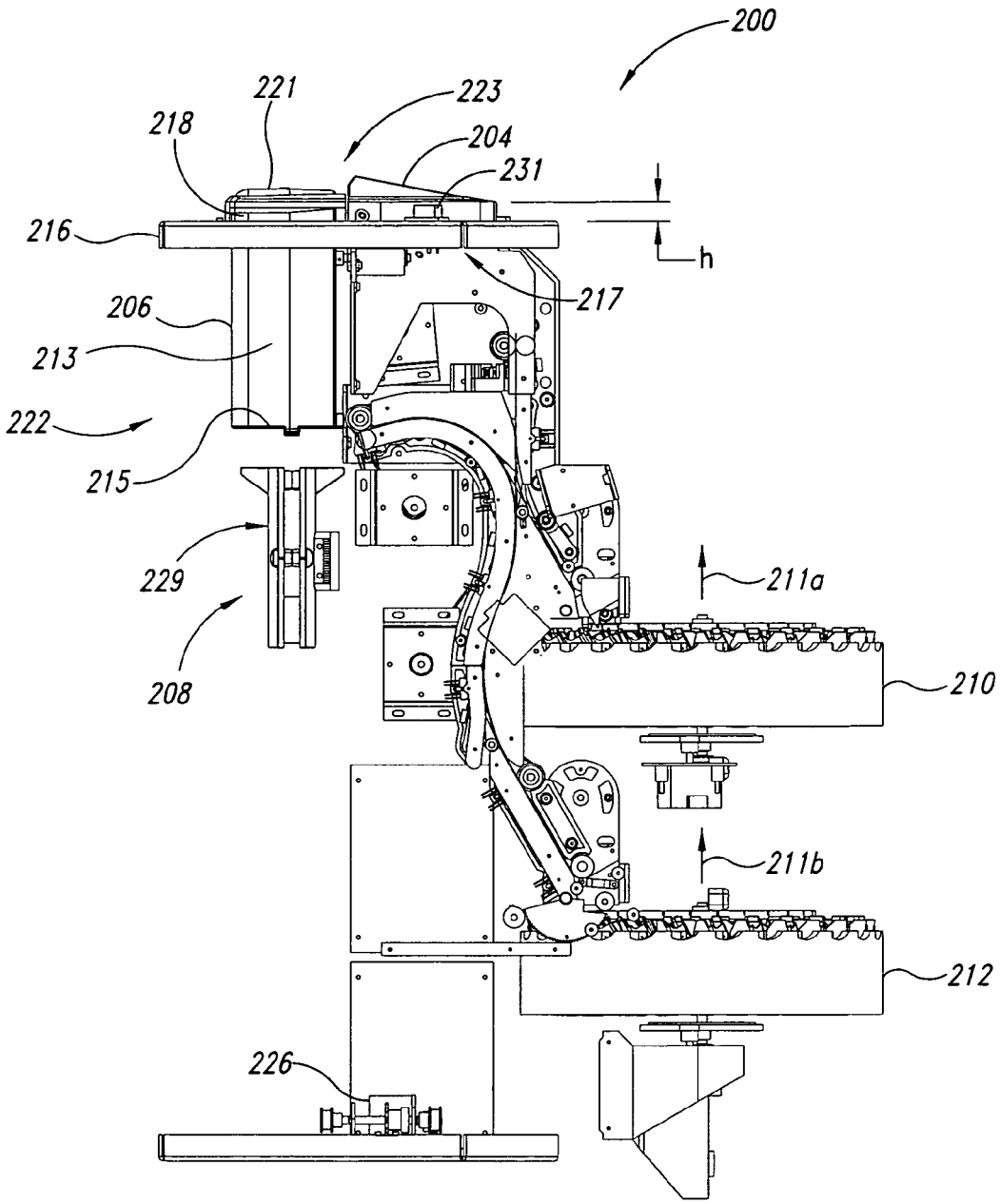
FIG. 2B is a left, side, elevational view of the playing card handling system of FIG. 2A, having a playing card output receiver in a lowered position, such that a ceiling of the playing card output receiver limits access from an exterior of the playing card handling device to playing cards in the playing card output receiver.

The playing card handling system 200 includes a structural frame 202, a playing card input receiver 204, a playing card output receiver 206, a card elevator mechanism 208, a first intermediary playing card receiver 210, and an optional, second intermediary playing card receiver 212. The playing card handling system 200 may be partially or fully enclosed by a housing (not shown) and/or by the gaming table 102 (FIG. 1A). The first and second intermediary playing card receivers 210, 212 may take the form of carousels, each pivotally mounted about respective vertical axes 211*a*, 211*b* (FIG. 2B). The vertical axes 211*a*, 211*b* may advantageously be coaxial, thereby minimizing the area or "footprint" of the playing card handling system 200.

The playing card input receiver 204 is sized and positioned to receive the collected cards 114 which are to be arranged, sorted, shuffled (e.g., randomized) or otherwise handled. The collected cards 114 may be collected from the gaming table 102 during play or after a card game or round has been played. The playing card input receiver 204 may be carried or formed by a plate 216, which may be in turn be carried by, coupled to, or otherwise connected to the gaming table 102. The playing card input receiver 204 may include a card input ramp 214 on to which the collected cards 114 may be fed by a dealer or other person, as individual cards or as a group of cards. In one embodiment, the card input ramp 214 is coated with a low friction material, for example TEFLON®, to reduce friction between the ramp 214 and the collected cards 114 that come into contact with the card input ramp 214. An input passage 217 extends through the plate 216 and the table surface 104 to allow passage of the collected cards 114 from the playing card input receiver 204 to the playing card transport path 120*a* (FIG. 1A) of the playing card handling system 200.

The playing card output receiver 206 is sized to receive a plurality of deliverable cards 118. As illustrated, the playing card output receiver 206 may take the form of a cartridge or rectangular box with a floor 215, a ceiling 221 generally disposed over the floor 215, and at least one side member 213 coupling the ceiling 221 to the floor for movement therewith. The playing card output receiver 206 is open, for example, on one or more sides to allow placement and removal of the deliverable cards 118 on the floor 215. The playing card output receiver 206 may pass through an output passage 219 that extends through the plate 216 and the table surface 104 (FIG. 1A) of the gaming table 102, to allow the card elevator mechanism 208 to deliver the deliverable cards 118 to the gaming table 102 as dealable cards 130.

It is understood that the plate 216 can be molded as a monolithic part or alternatively can be separate components that are coupled to each other and/or to the structural frame 202 by mechanical means. In one embodiment, the plate 216 seats against and/or attaches to an underside of the gaming table 102. In one embodiment, the playing card handling system 200 is located completely below the playing surface 104 of the gaming table 102. In another embodiment, a vertical sidewall 218 formed around the playing card input receiver 204 and the output passage 219 has a height "h." The height "h" corresponds to a thickness of the gaming table top such that the top portions of the playing card input receiver 204 and the output passage 219 may be flush with or extend just a little bit above (e.g., low profile) the surface 104 of the gaming table 102 (FIG. 1A). The surface 104 of the gaming table 102 typically comprises a felt cover on top of a foam pad, both of which are positioned on top of a sheet of composite, wood, or other type of material. One type of suitable surface 104 is described in detail in U.S. patent application Ser. No. 10/981,132. Some embodiments may omit the plate 216, and form the passages 217, 219 only through the surface 104 of the gaming table 102. Still other embodiments may not locate the card handling system 110 under the surface 104 of the playing table 102, thus such embodiments may omit the passages 217, 219 through the table surface 104.

Depending upon the embodiments and/or the type of card game, the deliverable cards 118 may be delivered individually or as a group of cards. Embodiments of the playing card handling system 200 may be user configurable to provide deliverable and/or dealable cards 118, 130 having any specified number of playing cards, and/or any specified suit of cards, and/or any specified rank(s) of cards, and/or other cards such as bonus cards or the like.

The ceiling 221 may be moved from a closed position 223 (FIGS. 2A-2C) to an opened position 225 (FIG. 2D), where in the closed position 223 the ceiling 221 is disposed over the output passage 219 so as to limit or preclude access or a view into the output passage 219, and where in the opened position 225 the ceiling 221 is spaced from the output passage 219 so as to not limit nor preclude access or a view into the output passage 219. As best illustrated in FIG. 2D, the ceiling 221 may be slideably coupled to the frame or other portion of the playing card handling system 200 for movement between the closed and the opened positions 223, 225, respectively.

To conserve space, in one embodiment the playing card input receiver 204 and the output passage 219 are positioned adjacent to one another.

Figure 2C:
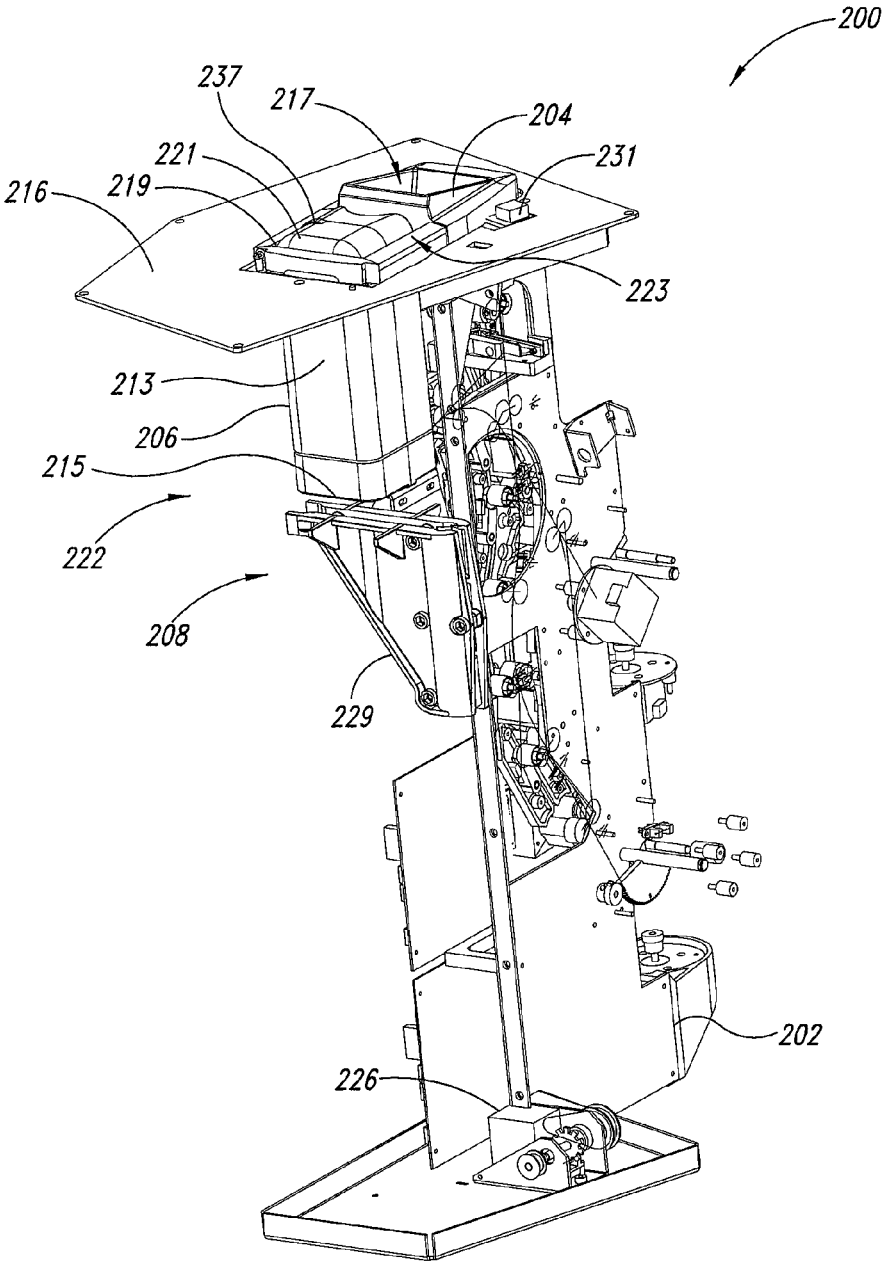
FIG. 2C is a rear, top, right side, isometric view of the playing card handling system of FIG. 2A with the playing card output receiver in the lowered position.
Figure 2D:
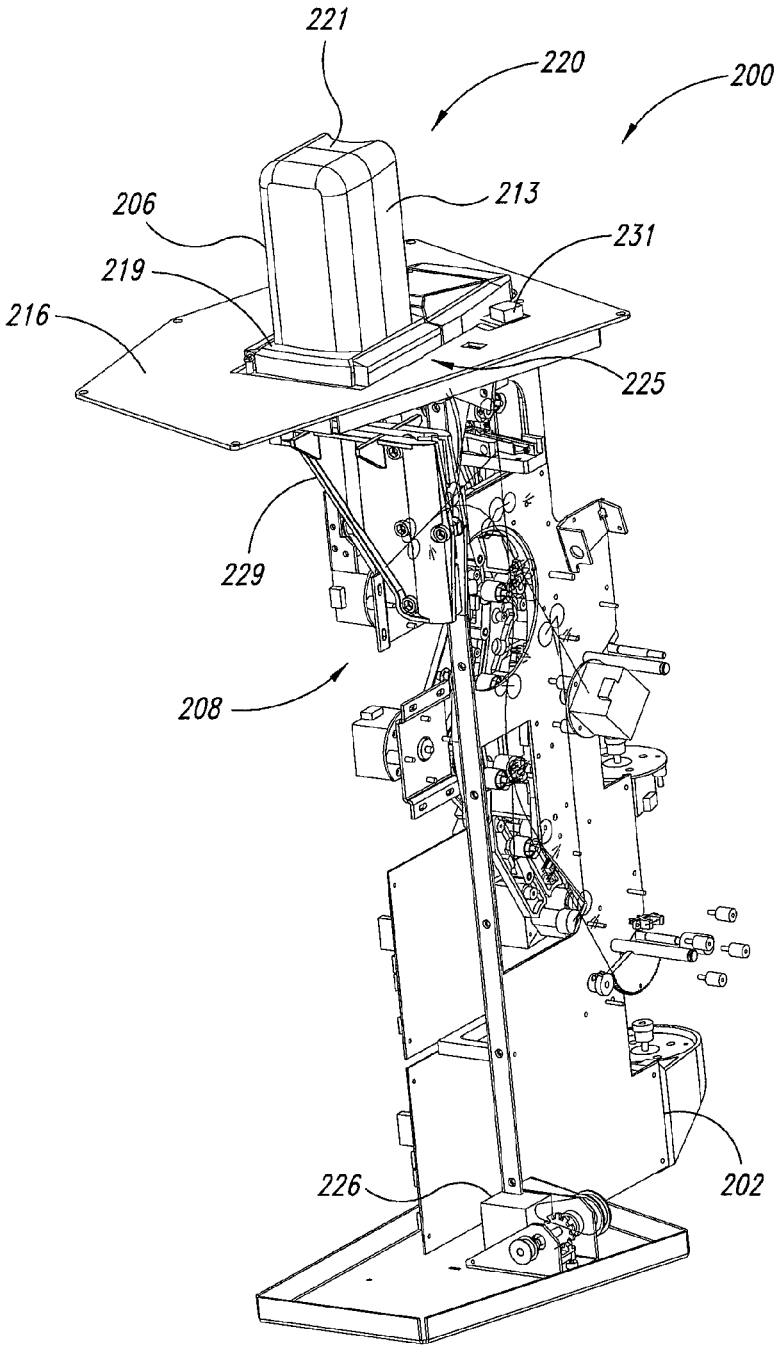
FIG. 2D is a rear, top, right side, isometric view of the playing card handling system of FIG. 2A having playing card output receiver in a raised or card delivery position such that the ceiling is positioned to provide access from the exterior of the playing card handling device to playing cards in the playing card output receiver.

FIGS. 2C and 2D show that the playing card output receiver 206 is moveable between a raised position 220 and a lowered position 222. In the raised position 220, at least a portion of the playing card output receiver 206 is positioned to permit the dealable cards 130 to be withdrawn from the playing card output receiver 206 by a dealer or another person at the gaming table 102. For example, the raised position 220 may, for example, be spaced sufficiently above the plate 216 to expose all or some of the playing cards above the surface 104 of the gaming table 102 (FIG. 1A). In the lowered position 222, the playing card output receiver 206 is positioned such that the playing cards cannot be withdrawn from the playing card output receiver 206. For example, the ceiling 221 of the playing card output receiver 206 may be positioned flush with, or spaced below the surface 104 of the gaming table 102 and/or below a top of the plate 216. Employing the ceiling 221 of the playing output receiver 206 to control access may advantageously provide a security benefit since access from the exterior is inherently limited when the playing card output receiver 206 is in the lowered position 222, and inherently not limited when the playing card receiver 206 is in the raised position 220.

The elevator mechanism 208 moves the playing card output receiver 206 between the raised and the lowered positions 220, 222. The elevator mechanism 208 may, for example, comprise a linkage 229 and an elevator motor 226 coupled to drive the linkage 229. Some of the Figures employ a partially exploded view, showing the playing card output receiver 206 spaced from linkage 229 of the card elevator mechanism 208 to better illustrate the components. In use, the playing card output receiver 206 will be physically connected or coupled to the linkage 229. In one embodiment, the first motor 226 is a DC stepper motor. Alternatively, the elevator motor 226 may take the form of a servo-motor. The elevator mechanism 208 may employ any suitable linkage, including but not limited to a belt, sprocket chain, gear, scissors linkage or the like (not shown for clarity). Activation of the elevator motor 226 moves the linkage 229 and the playing card output receiver 206 relative to the structural frame 202.

Figure 5:
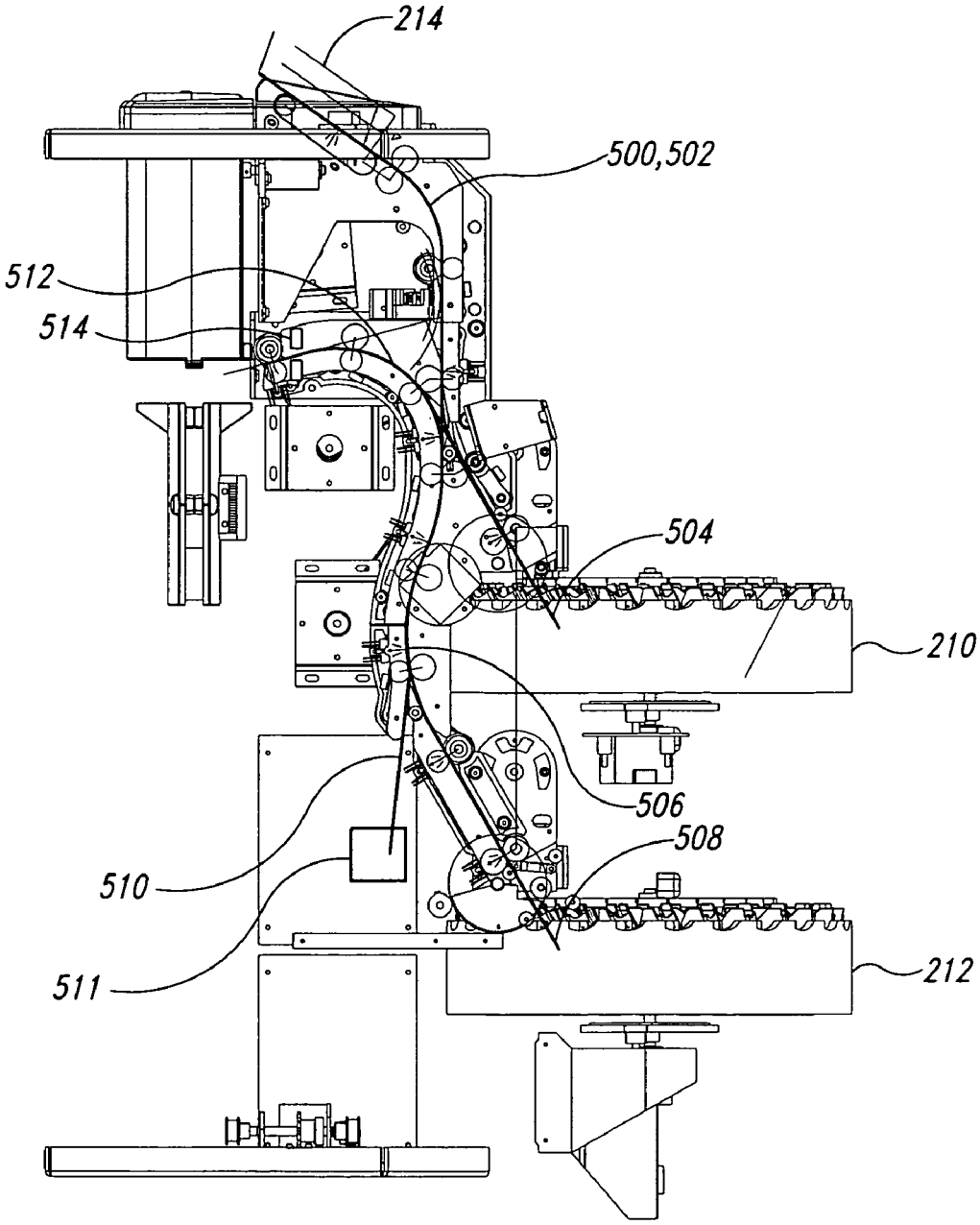
FIG. 5 is a side, elevational, schematic view of the playing card handling system of FIG. 2A showing a card path having various branches.

After the playing card output receiver 206 delivers the deliverable cards 118 to the gaming table 102, the card elevator mechanism 208 returns the playing card output receiver 206 to the lowered position 222. The lowered position 222 may be aligned with an elevator branch 512 (FIG. 5).

In some embodiments, one or more external switches 231 are positioned to be accessible from an exterior of the card handling system 200. The external switches 231 may, for example, be carried by the plate 216, the surface 104 of the gaming table 102, or a housing (not shown) of the card handling system. The external switches 231 may be selectively activated to cause the elevator mechanism 208 to move the playing card output receptacle 206 to the lowered position 222. Additionally, or alternatively, the external switches 231 may be selectively activated to cause the elevator mechanism 208 to move the playing card output receptacle 206 to the raised position 220.

One or more lowered position sensors 235 (FIG. 2C) may detect when the playing card output receiver 206 is at the lowered position 222. The lowered position sensors 235 may be coupled to the structural frame 202. The lowered position sensors 235 may take a variety of forms including, but not limited to a proximity sensor, optical eye type sensor, light sensor, infrared sensor, pressure sensor, or magnetic sensor such as a Reed switch, and/or positional or rotational encoder. The lowered position sensors 235 may sense the position of the playing card output receiver 206, or the linkage 229 or shaft of elevator motor 226.

Some embodiments may employ an interlock or lockout feature. The lockout feature prevents the elevator mechanism 208 from moving the playing card output receptacle 206 to the raised position 220 until the playing card output receptacle 206 is loaded with a sufficient number of (e.g., a threshold number) deliverable cards 118. For example, the lockout feature may keep the playing card output receptacle 206 in the lowered position 222 until at least one hundred and twelve cards (e.g., a threshold number for two standard decks) have been loaded in the playing card output receptacle 206.

The lockout feature may be implemented in hardware, controller executable instructions, or both. For example, the lockout feature may employ a latch 237 or other physical structure to retain the playing card output receptacle 206 in the lowered position 222 until a sufficient number (e.g., a threshold number) of deliverable cards 118 are loaded. Also for example, the lockout feature may employ software or firmware instructions stored in a memory or hardwired (e.g., ASIC) to prevent the elevator motor 226 from moving the playing card output receptacle 206 from the lowered position 222 until a sufficient number (e.g., a threshold number) of deliverable cards 118 are loaded.

The lockout feature may determine the number of deliverable cards 118 in the playing card output receptacle 206 in a variety of ways. For example, a controller (discussed below) may track the number of cards that have been directed to the playing card output receptacle 206. Alternatively, a counter may track playing cards as they pass to the playing card output receptacle 206. The counter may, for example, take the form of a rotational encoder or the like. Alternatively, a load sensor 227 (FIG. 2C) may be positioned to determine an approximate level of the deliverable cards 118 as they accumulate within the playing card output receptacle 206. For example, a reflective or transmissive sensor, or even a pressure transducer, is coupled to a portion of the playing card output receptacle 206. After a predetermined number (e.g. a threshold value) of deliverable cards 118 have accumulated within the playing card output receptacle 206, the elevator motor 226 is activated to move the playing card output receptacle 206 upward until the playing card output receptacle 206 is in the raised position 220. By way of example, if a transmissive sensor is used, movement of the playing card output receptacle 206 upward re-establishes an uninterrupted path between the light source and the light receiver of the transmissive sensor; whereas this path will eventually be interrupted again as more deliverable cards 118 are moved to the playing card output receptacle 206.

Figure 3A:
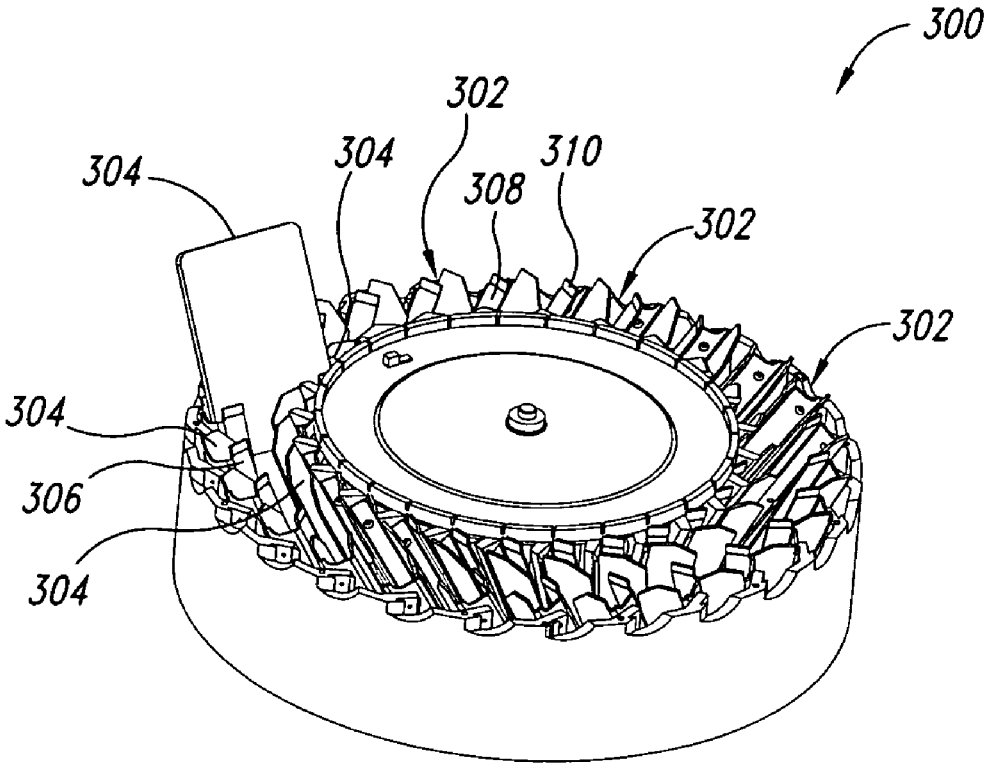
FIG. 3A is a rear, top, left side, isometric view of a storage device in the form of a carousel, according to one illustrated embodiment.

FIG. 3A is a rear, top, left side, isometric view of an intermediary card receiver or storage device system 300 comprised of the first carousel 210 and the second carousel 212, according to one illustrated embodiment. The first carousel 210 may be structurally identical or structurally distinct with respect to the second carousel 212. In the illustrated embodiment, the first carousel 210 is structurally identical to the second carousel 212. It is understood, however, that although the carousels 210, 212 are structurally identical, the carousels may have different purposes and controlled differently from one another. Further, although carousels 210, 212 are shown in the illustrated embodiment, it is understood that the intermediary card receiver or storage device system 300 may be comprised of other types, sizes, and/or shapes, for example racks, trays, or arrays. The carousels 210, 212 may advantageously employ rotational motion, in contrast to racks or trays, which typically require translation. For purposes of describing the general structural features of the carousels 210, 212, the structural features of the first carousel 210 will be described in detail with the understanding that these same structural features apply to the second carousel 212, unless specified otherwise.

The first carousel 210 includes a plurality of card receiving compartments 302. In the illustrated embodiment, the first carousel 210 has twenty-six (26) card receiving compartments 302 and each receiving compartment 302 is capable of receiving at least twelve (12) inventory cards 124, although other types of cards may be received in the receiving compartments 302 as described below. Thus, the combined capacity of the first carousel 210 and the second carousel 212 may hold up to twelve (12) standard decks of inventory cards 124 (e.g., fifty-two (52) standard playing cards per standard deck). The number of card receiving compartments 302, as well as the number of inventory cards 124 that can be received in each card receiving compartment 302, can be greater or lesser than the illustrated embodiment. In addition, the number of storage devices (e.g., carousels) 210, 212 may be greater or lesser than the two shown in the illustrated embodiment.

In one embodiment, the number of receiving compartments 302 per carousel 210, 212 is at least fifty-two (52) receiving compartments 302. In another embodiment, there are fifty-three (53) receiving compartments 302, where the $53^{rd}$ receiving compartment receives a specialty-type card 304, which is described in more detail below.

Referring back to the illustrated embodiment, an alternative thereof comprises first and second carousels 210, 212 each having twenty-seven (27) card receiving compartments 302, wherein one of the receiving compartments 302 is reserved for the specialty-type card 304, such as a bonus card or the like, which is purposefully stamped or marked, and/or an out-of-service card. An out-of service card is a playing card that may be later placed into a trash receiving compartment (e.g., the $27^{th}$ or extra receiving compartment) because the card was bent, marked, unreadable, put in-play too many times, and/or otherwise damaged or worn. A bonus card may be marked by the playing card handling system 110, 200 or pre-marked. The marking may be a stamp that, in accordance with the game or casino rules, allows the participant who receives the marked card to obtain a voucher and/or coupon for dinner, a show, hotel accommodations, or a variety of other discounted and/or free products or services. A specialty-type card, on the other hand, can be a wild card, which is usable by the participant to improve the participant's card-hand for the current card game. The process of how a specialty-type card can be integrated into the play of the card game is described below. A card stamping device 514 (FIG. 5) is positioned to stamp selected transitional cards 128 before they enter the playing card output receiver 206.

In the one embodiment, each card receiving compartment 302 is associated with or assigned a value (e.g., rank and suit) that corresponds to the type of cards used for game play. For example, the first card receiving compartment 302 of the carousel 210 may be assigned to receive and hold the ace of clubs (A♣), the second card receiving compartment 302 may be assigned to receive and hold the king of clubs (K♣), and so on, until all card values usable in the card game have been uniquely assigned to a respective receiving compartment 302. In some embodiments, other card types, such as, but not limited to the specialty-type cards 304 described above, may be uniquely assigned to the card receiving compartments 302.

By way of example and according to the above-described embodiment wherein each card receiving compartment 302 can hold up to twelve cards, twelve traditional card decks may be loaded into to the carousels 210, 212. One card receiving compartment 302 of the carousel 210, for example is assigned the ace of clubs (A♣), and thus the one card receiving compartment 302 could receive and hold up to twelve aces of clubs.

Furthermore, the card receiving compartments 302 may be associated with other card characteristics (e.g., color, size, shape, etc.). For example, bent and/or damaged cards may identified and put into one of the card receiving compartments 302 that is associated with such card characteristics. As another example, one of the card receiving compartments 302 may be associated with "imposter" cards, such as a card added to the card game, wherein the added card did not originate from the dealable cards 130. Upon detection, the imposter card can be placed into a reject card receiving compartment 302 and removed from play.

Embodiments of the playing card handling system 110, 200 may be configured to manage any type of card based upon a defined card characteristic. For example, but not limited to, the well-known game of UNO® employs a variety of cards using colors, text and/or numerals to identify cards. The various values of the UNO® brand cards can each be assigned and placed into unique card receiving compartments 302.

Further, in FIG. 3A, each receiving compartment 302 comprises a card support wall 304 and a guide wall 306. The card support wall 304 includes inner and outer portions according to the illustrated embodiment, but the card support wall 304 may also be a continuous wall. The guide wall 306 is spaced apart from the card support wall 304, thus forming the card receiving compartment 302.

The guide wall 306 includes a lower portion 308 and an upper portion 310. The lower portion 308 is substantially parallel to the card support wall 304. The upper portion 310 may be bent and/or tapered and may facilitate the insertion of the inventory cards 124 in the assigned receiving compartments 302, especially when a number of inventory cards 124 are already present in one of the receiving compartments 302. In addition, the upper portion 310 may help to guide the inventory cards 124 into the receiving compartment 302 while accounting for positional discrepancies of the carousel 210. Positional discrepancies may be caused by the control system, dimensional tolerances of the carousel and/or carousel driving components, and/or other factors.

Figure 3B:
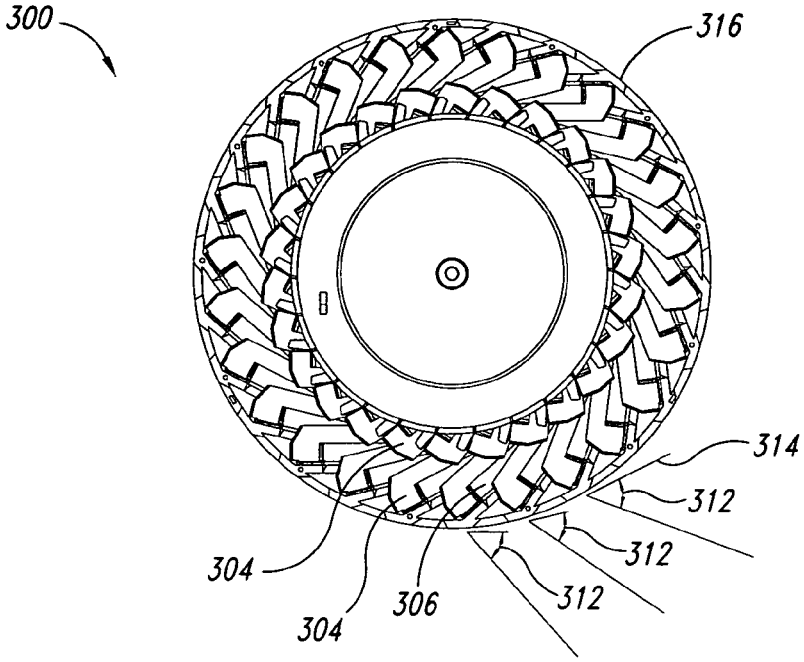
FIG. 3B is a top, plan view of the carousel of FIG. 3A.
Figure 3C:
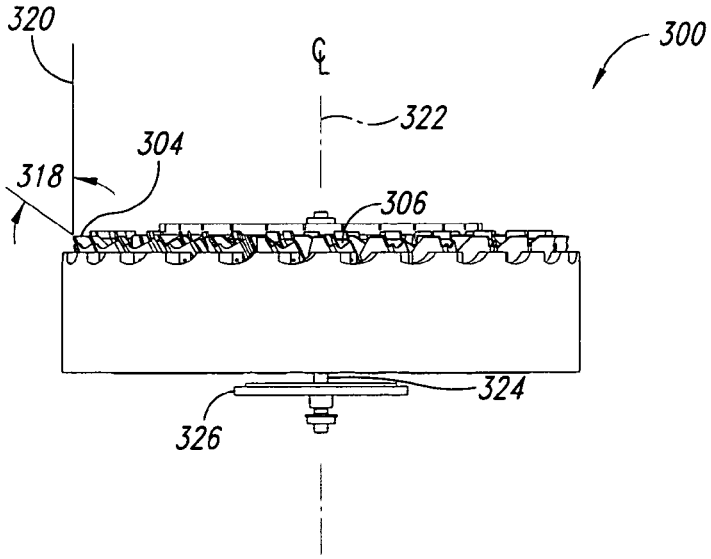
FIG. 3C is a side, elevational view of the carousel of FIG. 3A.

FIG. 3B shows the card support wall 304 and the guide wall 306 are positioned at a first angle 312 relative to a tangent line 314 taken along an outer perimeter 316 of the first carousel 210. In addition, FIG. 3C shows that the card support wall 304 and the guide wall 306 may be sloped, thus forming a second angle 318 with a line 320 that is substantially parallel with a centerline or rotational axis 322 of the first carousel 210. The first angle 312 and the second angle 318, as well as other structural aspects of the card support wall 304 and the guide wall 306 are presented for illustrative and exemplary purposes. It is understood that the any of these aspects can be modified and/or adjusted and yet still fall within the scope and spirit of the described embodiments.

Still referring to FIG. 3C, the first carousel 210 is rotationally mounted on a shaft 324, which is coupled to a carousel gear 326. The carousel gear 326 is rotationally coupled to a drive gear, a toothed belt, and/or a sprocket (not shown). The rotational position, speed, acceleration, and/or direction of the carousel 210 is achieved through the operation of a motor (not shown in Figure) that is coupled to and thus determines the position of the carousel gear 326 and hence, the carousel 210. It will be apparent to one of skill in the art that there are a variety of ways to drive the carousels 210, 212. Methods of controlling the rotational position, speed, acceleration, and/or direction of the carousels 210, 212, as well as other operational features, are either known in the art or are described in more detail below.

Additionally or alternatively, the carousels 210, 212 may be modular and/or may be removable and replaceable. A modular carousel is one that can be of a different size, have a different card-holding capacity, and/or be a different shape than the carousels 210, 212 in the illustrated embodiment. Further, the modular carousel can be removable and replaceable, for example to quickly change carousels so that a different type of card game can be played at the gaming table 102. In one embodiment, a plurality of carousels are vertically spaced apart from one another and generally aligned with one another along each carousel's respective axis of rotation. Such an embodiment may advantageously allow the playing card handling system 110, 200 to have a more compact installation envelope or "foot print," which means that the playing card handling system 110, 200 could fit under smaller gaming tables 102 and/or within compartments with space constraints.

Figure 4:
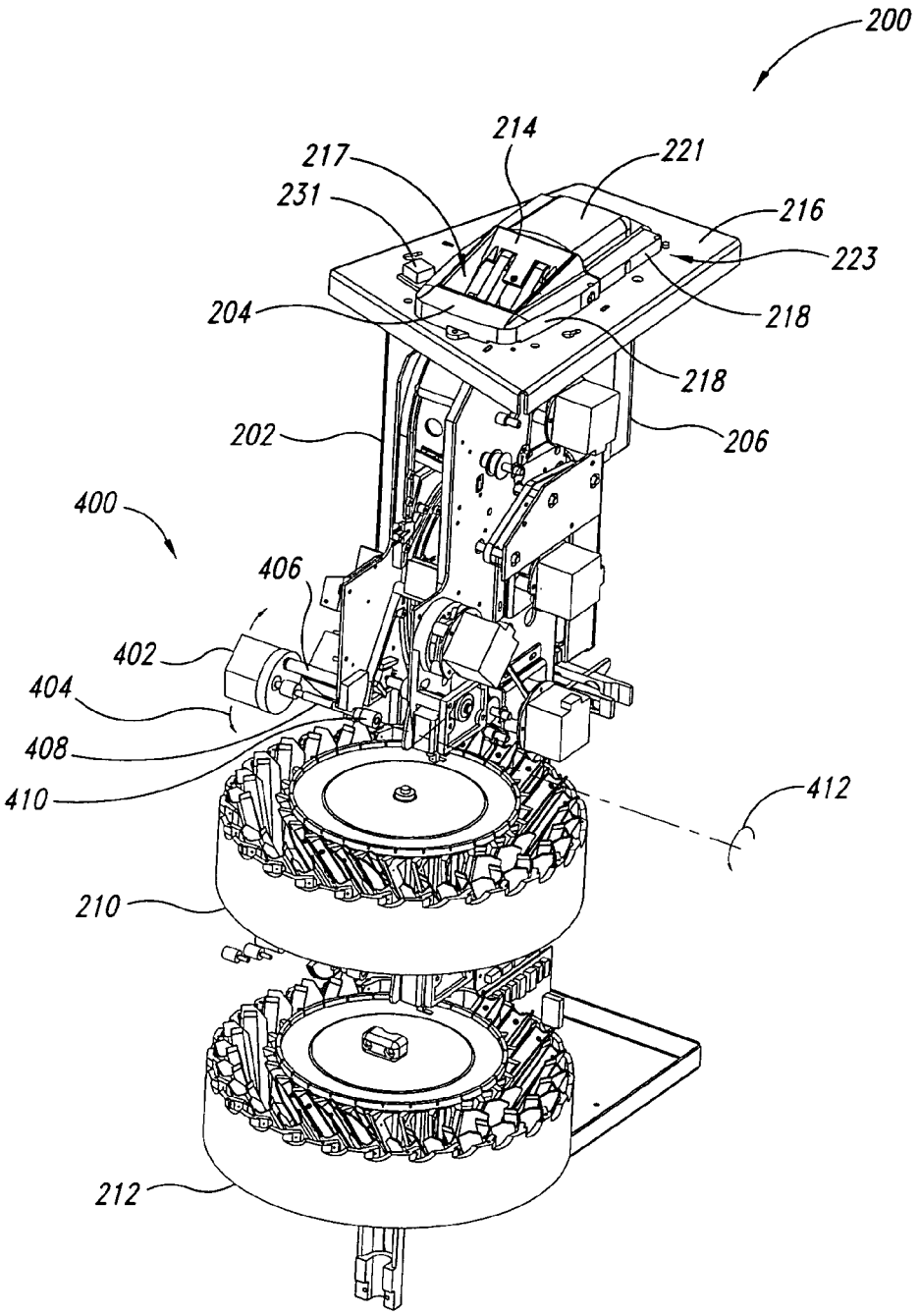
FIG. 4 is a front, top, right side, isometric view of the playing card handling system of FIG. 2A.

FIG. 4 shows a first card selector 400 having a card selector body 402 that is rotatable through an arc 404 to remove inventory cards 124 from the first carousel 210. The card selector body 402 is coupled to a lever arm 406, which allows the card selector body 402 to be moved through the arc 404. The length of the lever arm 406 determines the radius of the arc 404.

The card selector 400 further includes a shaft 408 having a friction pad or roller 410. The shaft 408 extends from card selector body 402 and is rotationally coupled thereto. The friction roller 410 is rotationally fixed to a portion of the shaft 408, wherein rotation of the shaft 408 causes the rotation of the friction roller 410. As the card selector body 402 is moved into position to select an inventory card 124, the shaft 408 and hence the friction roller 410 rotate in a first direction 412. As the friction roller 410 makes contact with the inventory card 124, the inventory card 124 is urged into a designated card path of the playing card handling system 200, in which the designated card paths are described in more detail below. During operation of the playing card handling system 110, 200 the first card selector 400 is controllable to be in contact with or spaced apart from the inventory cards 124 in the receiving compartments 302 of carousel 210. It is understood and appreciated that another card selector, similar in structural design and operation to the first card selector 400, can be used to select inventory cards 124 from other carousels, for example carousel 212. Further, more than one card selector 400 can be used for a single carousel, for example two card selectors 400 located on opposite sides of the carousel 210. Multiple card selectors 400 can augment and hasten the card selection process.

FIG. 5 generally shows a card path 500 having a number branches 502-512. An input branch 502 receives the collected cards 114 from the playing card input receiver 204 (FIG. 2A). As discussed above in relation to FIGS. 1A and 1B, once the collected cards 114 enter the input branch 502, now referred to as transitional cards 128. The input branch 502 directs the transitional cards 128 to a first carousel branch 504 or an intermediate branch 506. Transitional cards 128 directed to the first carousel branch 504 are received in the first carousel 210, whereas transitional cards 128 directed to the intermediate branch 506 may be further directed to a second carousel branch 508 or to an optional exit branch 510. Transitional cards 128 directed to the second carousel branch 508 are received in the second carousel 212, whereas transitional cards 128 directed to the optional exit branch 510 may be received in the reject receiving compartment 511. As an alternative to having the reject receiving compartment 511 and the exit branch 510, damaged transitional cards 128 can be selectively routed to other receiving compartments 302 in one of the respective carousels 210, 212 as described above.

The card path 500 further includes an elevator branch 512 arranged to receive transitional cards 128 from either the first carousel branch 504 or the second carousel branch 508. The transitional cards 128 received by elevator branch 512 may have originated from the collected cards 114 or the inventory cards 124. In addition, transitional cards 128 directed along the elevator branch 512 are eventually received in the playing card output receiver 206. It is understood and appreciated that the arrangement and/or interaction between the various branches of the card path 500 can be altered and/or re-configured to achieve a variety of objectives.

Figure 6:
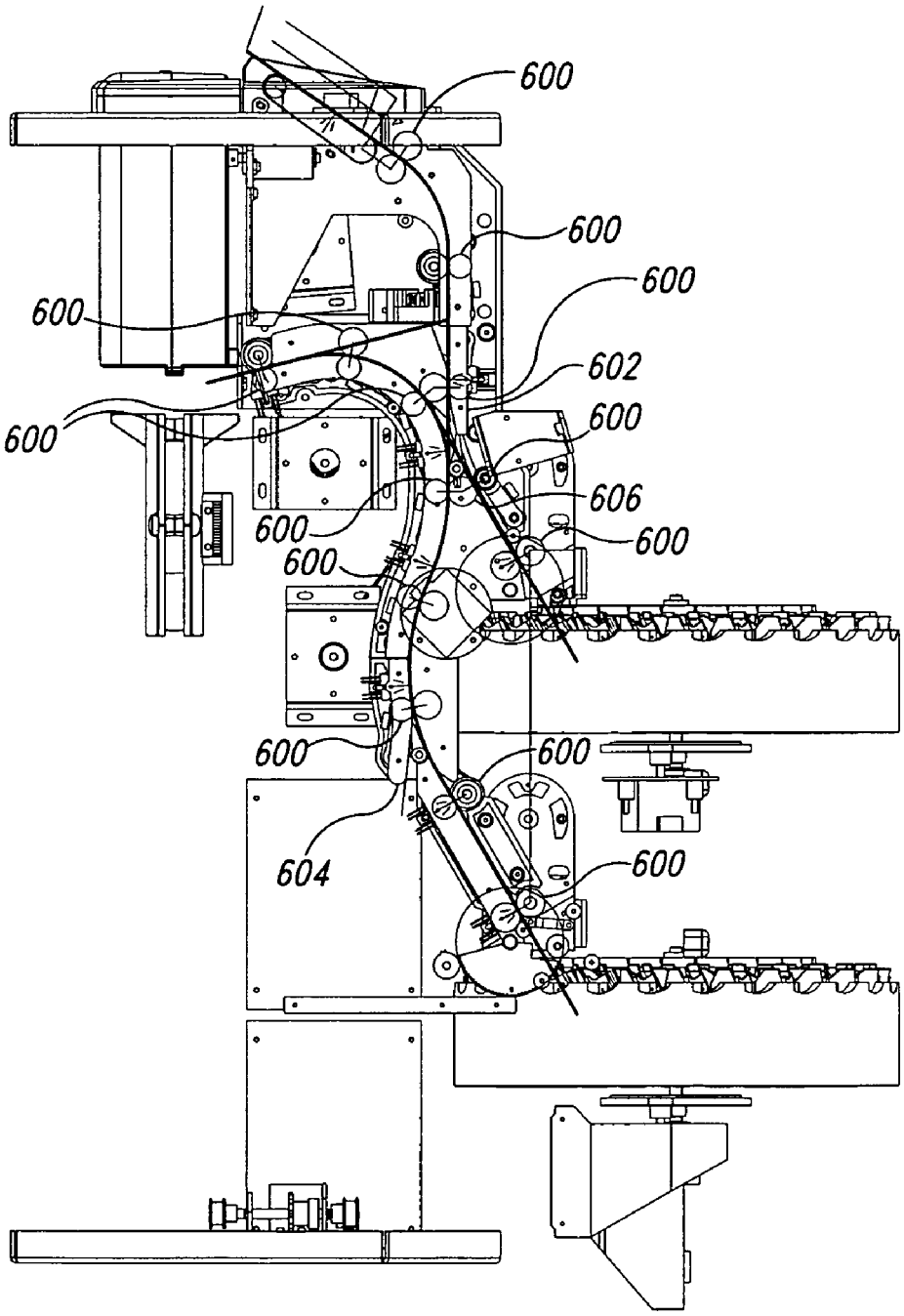
FIG. 6 is a side, elevational, schematic view of the playing card handling system of FIG. 2A showing rollers for moving cards through the card path of FIG. 5.

FIG. 6 shows a number of roller pairs 600, a first diverter 602, and a second diverter 604 that direct and/or guide the transitional cards 128 through the various branches 502-512 of the card path 500. The roller pairs 600 are positioned at various points or each respective branch 502-512. For each roller pair 600, the individual rollers rotate in opposite directions and can be bi-directional. The card manager interface system 910 (FIG. 9) controls the rotational speed and/or direction of the roller pairs 600 as the transitional cards 128 are moved to, from, and along the various branches 502-512 of the card path 500. In some instances, the roller pairs 600 may include a common roller 606, which may occur for example, when the roller pairs 600 are positioned proximate to converging/diverging branches 502-512 of the card path 500.

The roller pairs 600 are driven by a number of motors (refer to FIG. 8 for the best view of the motors), which may take the form of direct current (DC) stepper motors and/or servomotors. In one embodiment, the motors are coupled to at least one roller of the roller pairs 600. The card manager interface system 910 (FIG. 9) provides a signal, for example one DC pulse to the motor, which in turn causes the roller pair 600 to rotate in a selected direction by one step. In one embodiment, one step corresponds to approximately 1.80° of rotation of the at least one roller of the roller pair 600. Thus, one-hundred steps or pulses cause at least one roller to rotate a half of a turn (i.e., 180 degrees). In the above-described embodiment, the motors can be operated at about 1,800 steps per second. One skilled in the art will appreciate and understand that this rate can be adjusted to be faster or slower than 1,800 steps per second depending on where the transitional cards 128 are within the card path 500, depending on the complexity and interaction of the branches 502-512, and/or depending on other design or optimization factors. Accordingly, it is understood that DC stepper motors can be operated at any step rate.

Alternative embodiments may employ other types of motors and/or motor control systems to drive roller pairs 60.

Figure 9:
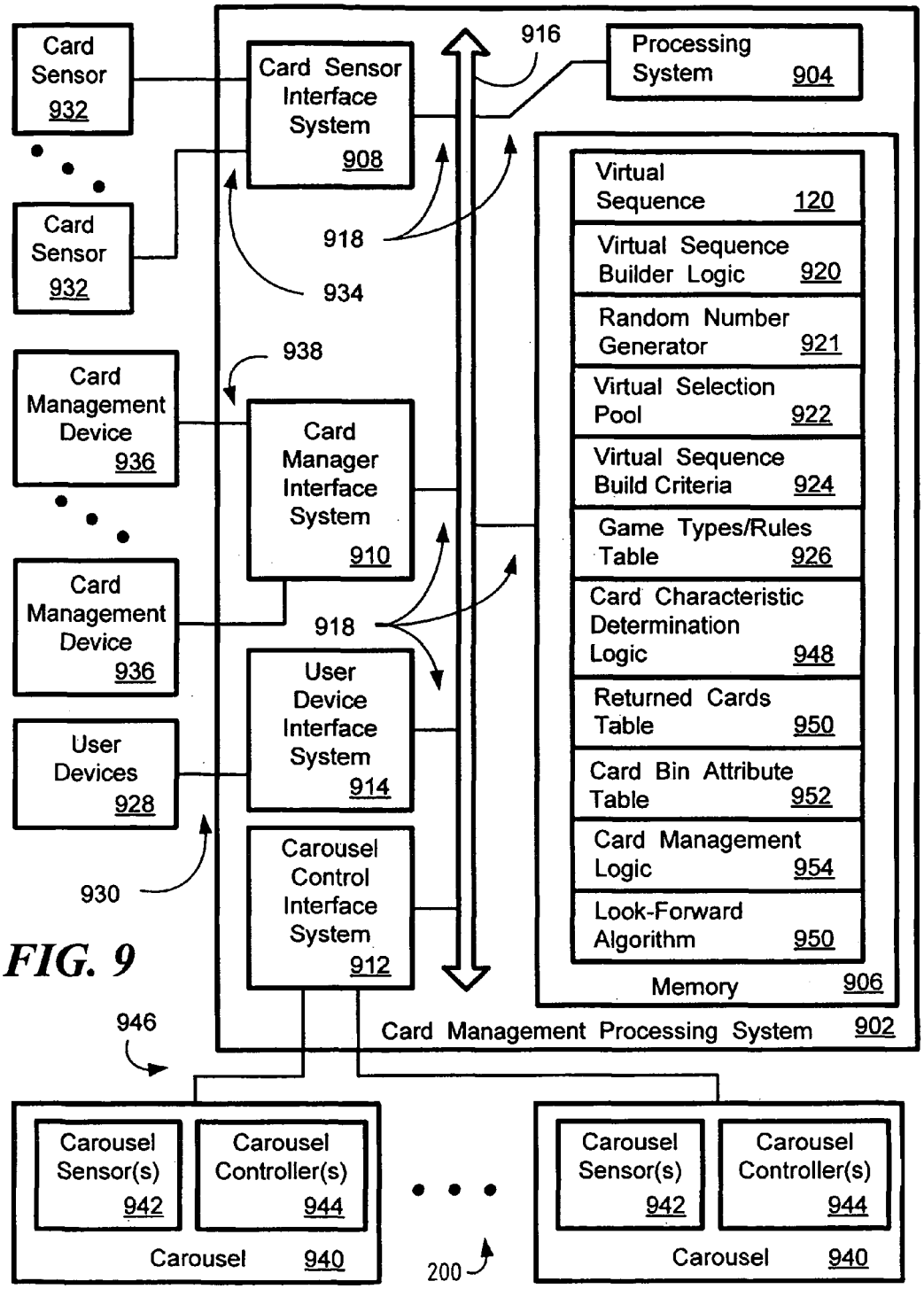
FIG. 9 is a simplified block diagram illustrating an embodiment of a card management processing system, which controls various operating functions of the playing card handling system of FIG. 1.

Operating in conjunction with the roller pairs 600 is the first diverter 602 and the second diverter 604. The first diverter 602 comprises a rotatable lever that is controllable to direct transitional cards 128 to the first carousel branch 504 or to the intermediate branch 506. The second diverter 604 comprises a rotatable lever that is controllable to direct transitional cards 128 to the second carousel branch 508 or to the optional exit branch 510. The diverters 602, 604 are controlled by the card manager interface system 910 (FIG. 9). In one embodiment, the card manager interface system 910 provides an electronic signal to solenoids that are respectively coupled to the diverters 602, 604. Each solenoid moves its respective diverter 602, 604 back and forth between two possible positions of the diverter 602, 604. It is understood, however, that one skilled in the art may opt to use other actuation devices in lieu of the exemplary solenoids, and that these other devices fall within the spirit and scope of the embodiments described herein. Additional diverters may be included for embodiment with more than two carousels 210, 212 and/or additional card branches 502-512.

Figure 7:
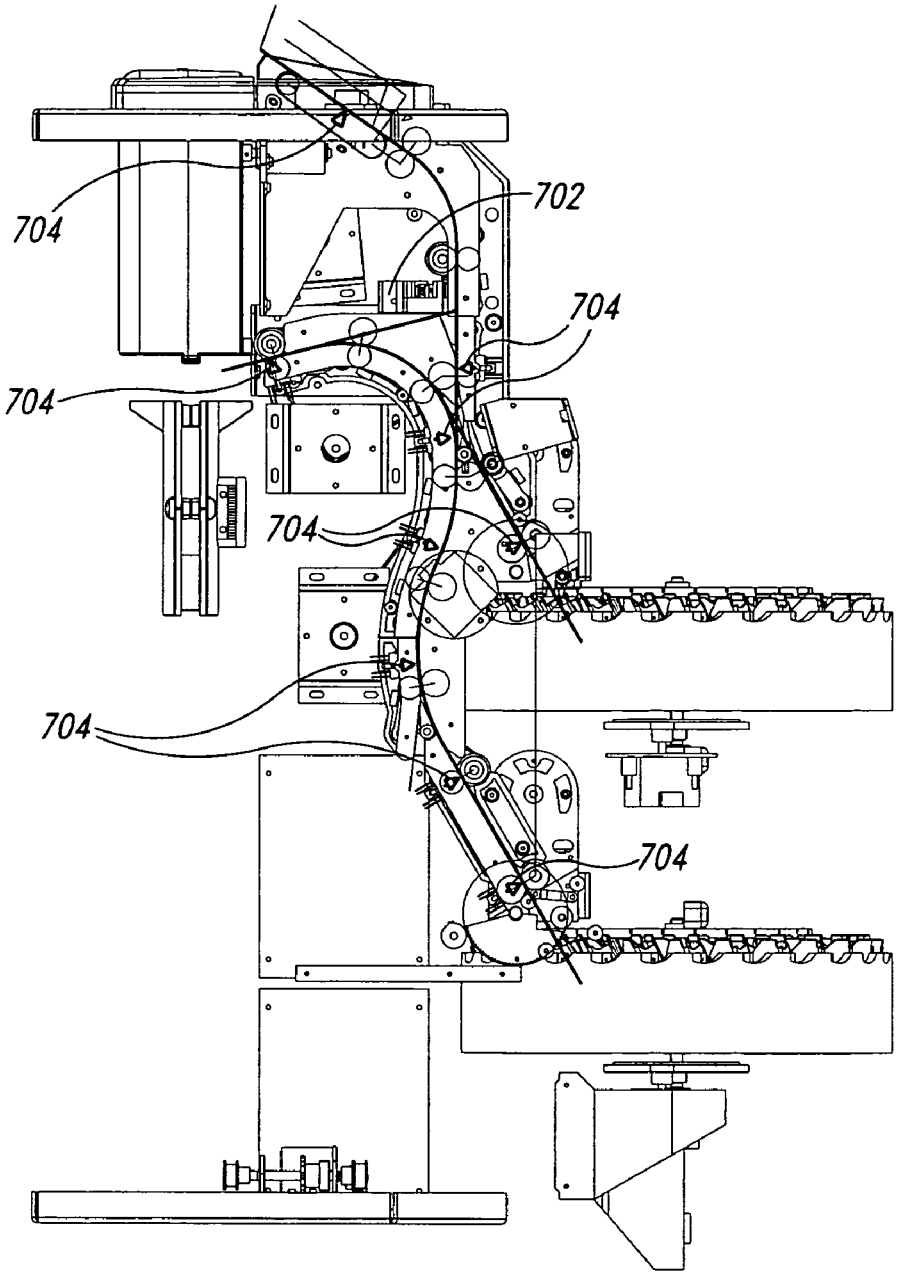
FIG. 7 is a side, elevational, schematic view of the playing card handling system of FIG. 2A showing a number of card sensors.

FIG. 7 shows a number of sensors operable to read a characteristic associated with the card and/or cards that are present in the playing card handling system 110. A first sensor 702 is an optical reader positioned to read, scan, and/or image either a human-readable and/or a machine-readable symbol carried by the transitional card 128. Playing cards having human-readable and/or machine-readable symbols are described in detail in U.S. patent application Ser. No. 10/934,785. In another embodiment, the first sensor 702 electromagnetically communicates with the transitional card 128 to determine a value (e.g., the rank and/or suit) of the transitional card 128. For example, one type of playing card that can be electro-magnetically read by the sensor 110 is described in U.S. patent application Ser. No. 10/823,051.

The sensors 704 are positioned along the card path 500 (FIG. 5) and cooperate with one another to determine an expected length and/or position of the transitional card 128 and/or to check whether the transitional card 128 is present in a respective card branch 502-512 (FIG. 5). In one embodiment, the sensors 704 are reflective sensors that send and/or receive light reflected off the transitional card 128 when the transitional card 128 is in a certain position along the card path 500. In another embodiment, the sensors 704 are transmissive sensors that send light across the card path 500 and receive the light with a light receiver. When the transitional card 128 moves in front of the receiver, the optical signal is interrupted and the transmissive sensor can communicate the presence of the transitional card 128. Additionally or alternatively, the sensors 704 may be some combination of reflective and transmissive sensors. It is understood and appreciated that in alternative embodiments, other types of sensors and/or mechanical systems, for example a touch sensitive device or a lever actuated device, may be used to detect the presence or absence of the transitional card 128.

At least some of the sensors 704 are spaced from an adjacent sensor 704, located either upstream or downstream along the card path 500 (FIG. 5). A distance that is approximately equal to a length of one transitional card 128 separates the adjacent sensors 704. Thus, if standard playing cards are used, which have a length of approximately 3.50 inches, it is understood that the adjacent sensors 704 are operably positioned approximately 3.50 inches apart.

One possible advantage of spacing the adjacent sensors 704 approximately one card length from each other is that the data from the adjacent sensors 704, in cooperation with information from a respective drive train, can be used to check the length of the playing card 704. In one embodiment, the length of the transitional card 128 (e.g., a standard playing card is 3.50 inches long) is correlated to a number of steps and/or degrees of rotation of a stepper motor and/or roller shaft. If, for example, the sensors 704 are transmissive sensors, then these transmissive sensors 704 will generate either a card-present or a card-absent signal depending on whether the transitional card 128 is or is not interrupting the light beam between the light source and the light receiver of the transmissive sensor 704.

Accordingly, the upstream sensor 704 will generate a card-present signal as the leading edge of the transitional card 128 interrupts the light beam. At this time, the number of degrees of rotation of the motor shaft and/or roller shaft can be tracked. As the transitional card 128 progresses along the card path 500 (FIG. 5), the leading edge is detected by the downstream sensor 704, which generates yet another card-present signal. Contemporaneously, the trailing edge of the transitional card 128 moves past the upstream sensor 704, causes the upstream sensor 704 to generate a card-absent signal. The time between the card-present and the card-absent signals can be compared to the number of degrees of rotation of the motor shaft and or roller shaft and the rotational speed thereof to check the length of the transitional card 128. Thus, if a situation occurs such as two transitional cards 128 overlapping one another (e.g., stuck together), the playing card handling system 110 is capable of detecting this situation at various locations along the card path 500. Once such a situation is detected, the upstream and downstream rollers can be operated to separate the overlapping cards and possibly re-read one or both cards. Alternatively, the overlapping cards can be directed to the reject receiving compartment 511 depending on the embodiment.

Figure 8:
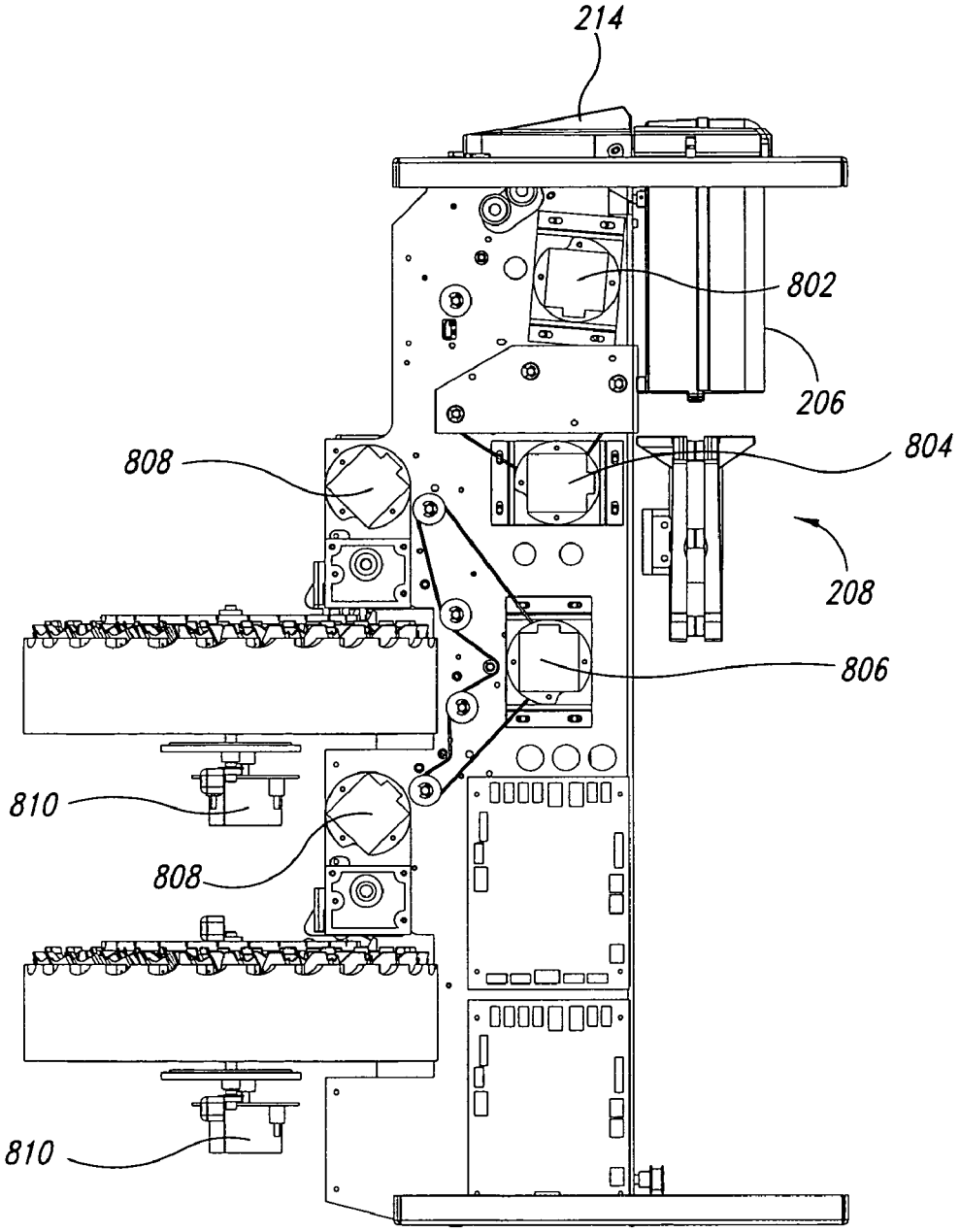
FIG. 8 is a side, elevational, schematic view of the playing card handling system of FIG. 2A showing a number of controllable motors.

FIG. 8 shows a number of motors used to operate various components within the playing card handling system 110, 200. As discussed above, the motors may be stepper motors, which can be of a variety of sizes, styles, and types, all of which are known in the art. The various motors and their functions will be briefly described herein.

A card ingress receptacle motor 802 operates at least one belt positioned below the playing card input receiver 204 to move the collected cards 114 into the card path 500 of the playing card handling system 110, 200. An elevator input motor 806 operates a number of rollers 600 to move transitional cards 128 from the card path 500 to the playing card output receiver 206. A carousel feed motor 806 operates a number of rollers 600 to move the transitional cards 128 along the card path 500 and into the respective receiving compartments 302 of the carousels 210, 212. Card removal motors 808 the card selector 400 and various components thereof to pick, select, and/or remove inventory cards 124 from the receiving compartments 302 of the carousels 210, 212. The card removal motors 808 may include both primary and secondary motors to control various operations of the card selector 400. Carousel position motors 810 operate to rotate and to stop the rotation of the carousels 210, 212.

Operation of the Card Management Processing System

FIG. 9 is a simplified block diagram illustrating an embodiment of a card management processing system 902 which controls various operating functions of the playing card handling system 110, 200. The card management processing system 902 comprises a processing system 904, a memory 906, a card sensor interface system 908, a card manager interface system 910, a carousel control interface system 912 and a user device interface system 914.

For convenience, processing system 904, memory 906, card sensor interface system 908, card manager interface system 910, carousel control interface system 912 and user device interface system 914 are illustrated as communicatively coupled to each other via communication bus 916, via connections 918, thereby providing connectivity between the above-described components. Alternatively, the above-described components are connectively coupled in a different manner than illustrated in FIG. 9. For example, one or more of the above-described components may be directly coupled to each other or may be coupled to each other via intermediary components (not shown).

A plurality of logic and data modules, described in greater detail hereinbelow, reside in memory 906. Such logic and data modules are retrieved by processing system 904 as required during the various operations.

The interface systems, described in greater detail hereinbelow, communicate information to and from the processing system 904 in a format suitable for the processing system 904, and communicate information to and from various external devices, also described in greater detail hereinbelow, in a format suitable for such external devices.

For convenience, the interface systems described below are illustrated by a single block. However, such interface systems may be a plurality of individual interface devices, each interface coupled to one or more related external devices. Furthermore, the interface systems are illustrated as residing within the card management processing system 902. The interface systems, or individual interface devices associated with one of the described interface systems, may reside external to the card management processing system 902. For example, a sensor may be configured to sense a characteristic of a card (e.g., standard or non-standard rank and/or suit markings or other identifiers, whether optical, electrical, magnetic or otherwise). Output of the sensor may be an analog signal, such as a voltage or a current, that corresponds to the detected card characteristic. A device coupled to the sensor may convert the analog signal from the sensor into a signal that is communicated directly to the card management processing system 902. All such modifications and variations of sensors and/or card management devices, and modifications and variations of interface systems and/or devices, are intended to be included within the scope of this disclosure and intended to be protected by the accompanying claims.

Figure 1B:
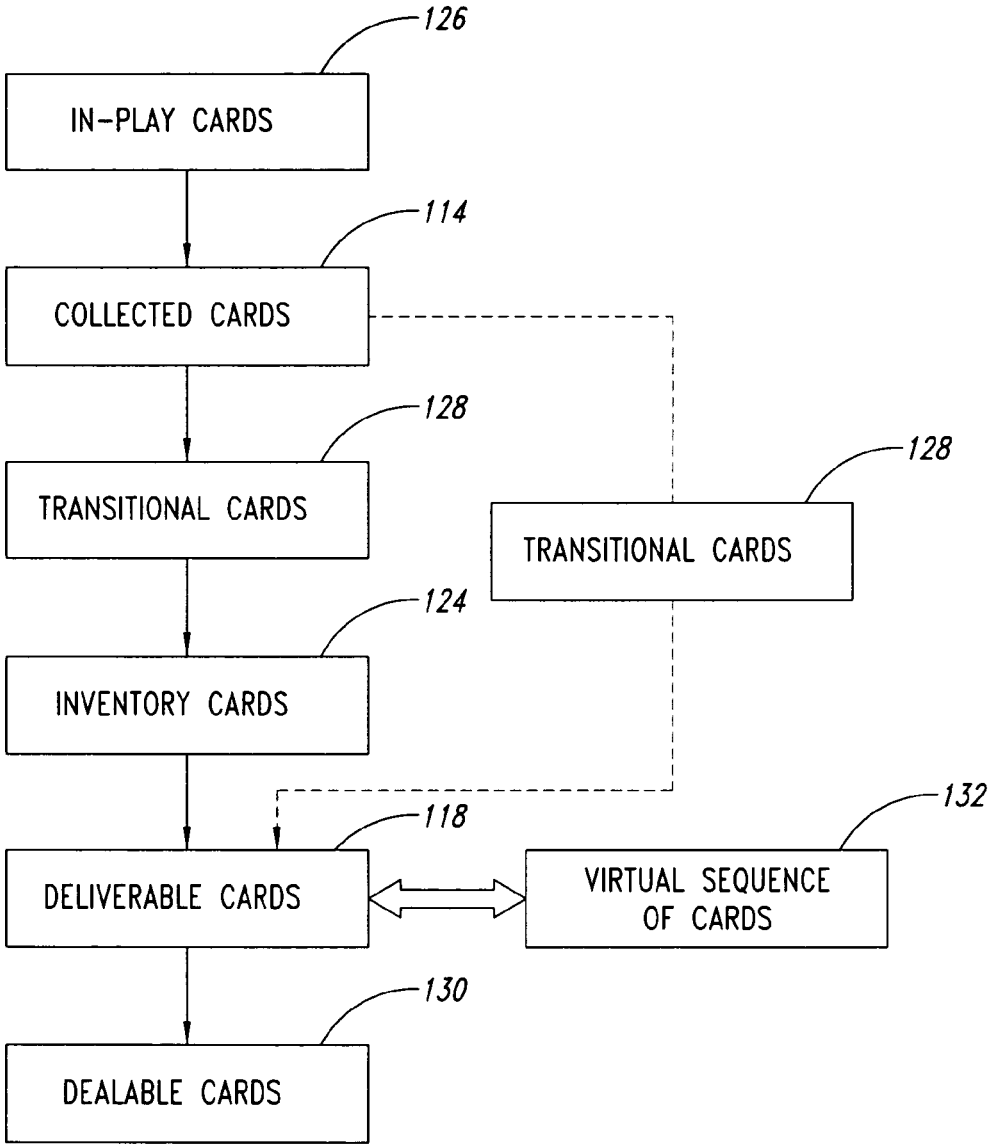
FIG. 1B is a flowchart showing various states of the playing cards within the gaming environment of FIG. 1A.

The virtual card builder logic 920 residing in memory 906 determines a plurality of virtual cards (i.e., domain or set) that are used to build a virtual sequence 136 (see also FIGS. 1A, 1B). A random number generator (RNG) 921 or the like may define a sequential order of virtual cards, wherein the virtual cards have values and/or characteristics that correspond to the resulting dealable cards 130 and inventory cards 124 that are used to play the card game. As used herein and in the claims, the term random number generator includes pseudo-random number generators and the like, which are capable of generating a number sufficiently random to meet an applicable criteria, for example criteria set by a governmental or quasi-governmental gambling authority. As previously discussed, playing cards can be assigned a value that is indicative of the card rank and the card suit. In one embodiment, a virtual selection pool 922 is generated with values that correspond to a standard 52-card deck of playing cards. The virtual cards from the virtual selection pool 922 are generated by the virtual card builder logic 920 based upon the particulars of the algorithms used by the random number generator 921 to generate the virtual sequence 136, which may be stored in memory 906.

A virtual sequence criteria 924 is used to define parameters that the virtual card builder logic 920 uses to generate the virtual sequence 136. An exemplary parameter may be a specified number of standard 52-card decks that are to be used to construct the virtual sequence 136. Individual, virtual cards are removed from the virtual selection pool 922 and arranged according to a sequence, computationally generated with a random number generator 921.

By way of example, the virtual sequence criteria 924 may specify that eight (8) standard 52-card decks comprise the virtual selection pool 922. Accordingly, the virtual card builder logic 920 uses the virtual selection pool 922 of four-hundred-sixteen virtual cards (corresponding to 8 decks of 52 physical cards each), where there are eight virtual cards of each particular value (e.g., rank/suit combination). Accordingly, in this example, there are initially eight aces-of-spade values (A♠), eight kings-of-spade values (K♠), eight queens-of-spade values (Q♠), and so on.

As the virtual sequence 136 is generated, the number of available virtual cards in the virtual selection pool 922 is accordingly reduced. In the example above, if the first virtual card is the A♠, then the total population of available virtual cards in the virtual selection pool 922 decreases from 416 to 415. The next virtual card is then selected from the remaining 415 cards, of which there are only seven A♠ remaining (along with eight each of the other values available in eight (8) standard 52-card decks). It is appreciated that subsequent virtual card selections will be made from only those virtual cards presently available in the virtual selection pool 922. Consequently, the virtual sequence 136 is generated and stored in memory 904. This virtual sequence 136 may be viewed to correspond to a randomly shuffled, actual group of playing cards. Returning to the above example, the virtual sequence 136 would correspond to eight standard 52-card decks that are physically shuffled together.

In another embodiment, the size of the virtual selection pool 922 is not reduced as virtual cards are selected during generation of the virtual sequence 136. That is, for each selection of a virtual card, the probability of a particular card value being selected remains constant. For example, if a group of deliverable cards 118 is to be constructed from a standard 52-card playing deck, the probability of the first card having a value of the A♠ is $1/52$. When the second virtual card (and subsequent virtual cards) is selected for the virtual sequence 136, the probability of the second virtual card (and virtual subsequent cards) having a value of the A♠ remains at $1/52$. That is, the selection of virtual cards from the selection sequence or pool 132 is operating similar to the manner in which an electronic slot machine is operating (wherein the probability of a symbol occurrence on the payout line remains constant as reel spins are simulated). In this situation, the virtual selection pool 922 could be simplified to correspond to one of each of the values of cards in the game. (For example, the virtual selection pool for a standard 52-card playing deck would be 52 virtual cards, wherein each virtual card uniquely corresponds to a unique rank and suit combination.)

The virtual sequence criteria 924 may also define other parameters that the virtual card builder logic 920 uses to add, delete, or modify the value of at least one of the virtual cards in the virtual selection pool 922. For example, one of the parameters may set a specified number of "wild" cards that are to be added into the virtual selection pool 922. The "wild" cards could be the two Joker cards that typically accompany the standard 52-card deck. The wild cards may be used by the participants to augment or enhance their hand of cards.

In the above example where the initial virtual selection pool 922 of virtual cards is based upon eight card decks, the sixteen Jokers (e.g., 2 Jokers per deck times 8 decks of cards) could be added to the virtual selection pool 922 to increase the total population of initially-available virtual cards to 432. Alternatively, any desired number of Jokers, or other specialty-type cards, could be added to the virtual selection pool 922 in accordance with the rules (parameters) of the particular card game and/or casino rules. Specialty-type cards may be redeemable for prizes or bonuses, and may or many not have the identity of the prize displayed on the card. Such cards may also include unique identifiers to assist in redemption.

Other types of parameters may be specified in the virtual sequence criteria 924. For example, different types of card games may be defined in the optional game type/rules table 926. For example, rules for the card game UNO® may reside in the game type/rules table 926. UNO® cards are defined by colors, text and/or numerals and do not resemble the cards of a standard 52-card deck. If the card management processing system 902 is instructed to build a virtual sequence 136 for the card game of UNO®, information defining the UNO® cards can be retrieved from the optional game type/rules table 926. This information may then be used to modify one or more of the parameters in the virtual sequence criteria 924. For example, the characterization of a card may be changed from rank and suit to the colors, text and/or numerals of UNO® cards. Accordingly, the virtual selection pool 922 would be constructed from the specified number of UNO® decks using UNO® virtual cards.

User device interface system 914 provides an interface means to one or more external user devices 928 configured to receive input or instructions from an individual such as a dealer, pit boss, or other casino employee. Any suitable user device 928 may be configured to communicate with the card management processing system 902, via connection 930. Non-limiting examples of external user devices 930 include key boards, memory media devices (such as flash cards, floppy disks, compact disks (CDs), micro disks, or the like), touch sensitive visual screens, or another processing system. Furthermore, connection 930 is illustrated for convenience as a hardwire connection to the user device interface system 914. In other embodiments, connection 930 may be replaced with another suitable media, such as, but not limited to, a radio frequency media, an infrared media, or other wireless media. If another media is employed by alternative embodiments, the user device interface system 914 could be configured to receive information from the external user device 928 via the other media. The user device interface system 914 would then reconfigure the information to a medium suitable for communication over communication bus 916. Additionally, the user device interface system 914 may be configured to receive information from a plurality of user devices 928 in other embodiments. In yet other embodiments, the playing card handling system 110, 200 may output information of interest to various external devices, via the user device interface system 914.

Card sensor interface system 908 is configured to receive information from the various sensors of the playing card handling system 110, 200. For convenience, card sensor interface system 908 is illustrated as being coupled to a plurality of card sensors 932, via connections 934. The card sensor interface system 908 may be configured to receive information from other types of sensors. Such card sensors and other types of sensors are described in greater detail above. Thus, the card sensor interface system 908 is configured to receive information from card sensors 932, and then reconfigure the received information into a medium suitable for communication over the communication bus 916. Furthermore, connections 934 are illustrated for convenience as a hardwire connection to the card sensor interface system 908. In other embodiments, one or more of the connections 934 may be replaced with another suitable media, such as, but not limited to, a radio frequency media, an infrared media, or other wireless media.

Card manager interface system 910 is configured to provide control signals or information to various devices or subsystems of the playing card handling system 110, 200. For example, the elevator motor 226, described above, is operated to raises the playing card output receiver 206 (FIGS. 2A-2E) such that the dealer or a card player may access the dealable cards 130. The elevator motor 226 then lowers the playing card output receiver 206 after the dealable cards 130 are removed so that the card management process may continue to build another group of deliverable cards 118. The card manager interface system 910 provides signals to the elevator motor 226 to cause movement of the playing card output receiver 206 relative to the structure 202.

For convenience, the card manager interface system 910 is illustrated as being communicatively coupled to a plurality of card management devices 936, via connections 938. The card management devices 936 are generally electro-mechanical devices that are actuatable by an electrical signal. The card manager interface system 910 is configured to receive instructions for the card management devices 936 from processing system 904, and is configured to generate and communicate the electrical signal to a card management device 936 using a suitable signal format. In some situations, the electrical signal may directly control an electro-mechanical devices, such as when a suitable operating voltage and/or current is provided. In other situations, the electrical signal may be a digital or analog control signal communicated to another controller which actuates the electro-mechanical device. Furthermore, connections 938 are illustrated for convenience as a hardwire connection to the card manager interface system 910. In other embodiments, one or more of the connections 938 may be replaced with another suitable media, such as, but not limited to, a radio frequency media, an infrared media, or other wireless media.

Storage device control interface system 912 is configured to receive information from the various storage device sensors 942 and to provide electrical signals to the various controllers 944, via connections 946, residing in the plurality of carousels 940. In one embodiment, carousels 940 correspond to the two carousels 210, 212 (FIGS. 2A-D) or another suitable storage device. Sensors 942 and controllers 944 are described in greater detail below (see, for example, FIG. 12). Connections 946 are illustrated for convenience as a hardwire connection to the card manager interface system 910. In other embodiments, one or more of the connections 946 may be replaced with another suitable media, such as, but not limited to, a radio frequency media, an infrared media, or other wireless media.

In accordance with the various embodiments described herein, sensor devices are employed to determine the characteristics and/or value of an individual card. For example, in the game that employs a standard 52-card deck, each card is uniquely identifiable by a unique value, its rank and suit symbols. Sensor means are employed to detect information from each card that may be used to identify the card. For example, one embodiment employs machine-readable symbol reader systems such as a bar code reader system to read machine-readable symbols such as bar code information printed on each card (typically using a non-visible medium such as ultraviolet sensitive ink or the like). Alternatively, or additionally, machine-readable symbol reader systems may read standard markings from the cards, such as rank symbols, suit symbols and/or pips. As the card passes in proximity to the sensor configured to detect the information on the card, the sensor communicates the information corresponding to the detected bar code to the above-described card sensor interface system 908. The card sensor interface system 908 then formats and communicates the information to processing system 904.

Processing system 904 retrieves and executes the card characteristic determination logic 948 to analyze the detected attributes and/or characteristics of the sensed card. Accordingly, the physical card is uniquely identifiable. For example, if a bar code reader system is employed to read barcode information on a sensed card, the card characteristic determination logic 948 can determine the unique character of the card. Thus, if a traditional 52-card deck is being used for a card game, the sensed physical card can then be uniquely identified by its rank and suit symbols (for example, the A♠ card is uniquely identifiable by the letter "A" and the symbol ♠ and have a machine-readable symbol residing thereon indicating this value). Alternatively, each playing card may carry an identifier that is unique over more than fifty-two cards.

Other types of sensors may be used to sense attributes and/or characteristics of a sensed physical card. For example, a sensor sensitive to color may be used to determine the color of the playing surface of the sensed cars, such as a color-coded UNO® card. A character recognition sensor such as, but not limited to a charge coupled device (CCD) array, may be used to sense information corresponding to characters on the playing surface of the card. The card characteristic determination logic 948 may then interpret the sensed information using one or more character recognition algorithms to determine a text and/or character attribute of the sensed card. For example, if a traditional 52-card deck is being used for a card game, the sensed text and/or character attribute of the sensed card can then be uniquely identified by its rank and suit symbols (for example, the A♠ card is identifiable by the letter "A" and the symbol ♠). Or, if a color-coded UNO® card with text is sensed, the UNO® card can be uniquely identified through a combination of text recognition and color recognition (for example, a yellow colored "Skip" card is identifiable by its yellow color and the printed text "Skip").

As noted above, the dealer or other player returns collected cards 114 (FIG. 1A) to the playing card handling system 110, 200. As a collected card 114 passes in proximity to and is sensed by the above-described sensors such that the card characteristic determination logic 948 determines the unique identifier of the sensed collected card 114, the identifying information for the sensed collected card 114 is stored in the returned cards table 950. Accordingly, a log of the sequence of collected cards 114 is generated and stored in the returned cards table 950. Such information may be useful for security purposes, player tracking, card usage data, etc.

For example, the identity and location of each card in the deliverable cards 118 (FIG. 1B) are known. As in-play cards 126 are placed in play, the processing system 904 (FIG. 9) may anticipate which cards are expected to be in play at the gaming table 102. Accordingly, the processing system 906 may execute logic to anticipate what playing cards may be expected to be discarded during the current card game. If a player mistakenly or purposefully retains one of the in-play cards 126, the retained card will not end up in the group of collected cards 114. The processing system 906 may then recognize that one of the in-play cards 126 was not returned, which may result in some form of communication to the dealer or another authority. Similarly, an imposter card inserted during or after the card game can also be recognized by the processing system 904. The processing system 906 may then generate and communicate an appropriate signal to the dealer or another authority indicating the presence of the imposter card.

As noted herein, the plurality of card receiving compartments 302 of the carousels 210, 212 (FIG. 2) are uniquely associated with a card value. For example, one of the card receiving compartments 302 may be uniquely associated with the A♠. Such association may be formed during operation, either just prior to, during, or shortly following placement of the particular card into a particular receiving compartment 302. The advantageously allows the placement of the card in the nearest empty compartment increasing operational speed. Allowing bidirectional movement of the carousels 210, 212 (e.g., rotation in clockwise and counterclockwise direction), also increases operational speed. When the A♠ is returned to the playing card handling system 110, 200 as a collected card 114, the processing system 904 executes the card characteristic determination logic 948 to identify the collected card 114. For example, if the A♠ card is the collected card 114 and is identified accordingly, the A♠ card is returned to the appropriately assigned card receiving compartment 302. After the A♠ card is returned to the appropriate card receiving compartment 302, that A♠ card is now referred to as an inventory A♠ card 112. Thus, the card receiving compartment attribute table 952 is a definable table wherein card receiving compartments 302 (FIG. 3) are uniquely assigned a particular card type or card value. It is appreciated that any characteristic of a card may be used to associate a card and its assigned card receiving compartment 302. Since the information corresponding to the associated card characteristic and the card receiving compartment 302 is stored in the card receiving compartment attribute table 952, any card may be identified and stored and/or retrieved from its assigned card receiving compartment 302 by the various embodiments as described herein. If not all card receiving compartments 302 are assigned in a game, those card receiving compartments 302 may be later defined as needed and/or not used during game play.

As noted above, embodiments of the playing card handling system 110 perform various operations on the physical cards using a variety of electro-mechanical devices. Also, various sensors provide information to the card management processing system 902. The various logical processes, comprising software and/or executable code, are generally represented by the card management logic 954. The card management logic 954 may be comprised of a plurality of unique logic segments or programs, and/or may be comprised of a multi-function, integrated logic segment or program, as described herein.

When logic 908 is implemented as software and stored in memory 906, one skilled in the art will appreciate that logic 920, 948, 954 and/or 956, or that the information of 922, 924, 926, 950 and or 952, can be stored on any computer-readable medium for use by or in connection with any computer and/or processor related system or method. In the context of this document, a memory 906 is a computer-readable medium that is an electronic, magnetic, optical, or other another physical device or means that contains or stores a computer and/or processor program. Logic 920, 948, 954, and/or 956, and/or the information of 922, 924, 926, 950 and or 952 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions associated with logic 920, 948, 954, and/or 956, and/or the information of 922, 924, 926, 950 and or 952. In the context of this specification, a "computer-readable medium" can be any means that can store, communicate, propagate, or transport the program associated with logic 920, 948, 954, and/or 956, and/or the information of 922, 924, 926, 950 and or 952 for use by or in connection with the instruction execution system, apparatus, and/or device. The computer-readable medium can be, for example, but not limited to, an electronic, magnetic, optical, electromagnetic, infrared, or semiconductor system, apparatus, device, or propagation medium. More specific examples (a nonexhaustive list) of the computer-readable medium would include the following: an electrical connection having one or more wires, a portable computer diskette (magnetic, compact flash card, secure digital, or the like), a random access memory (RAM), a read-only memory (ROM), an erasable programmable read-only memory (EPROM, EEPROM, or Flash memory), an optical fiber, and a portable compact disc read-only memory (CDROM). Note that the computer-readable medium, could even be paper or another suitable medium upon which the program associated with logic 920, 948 and/or 954, and/or the information of 922, 924, 926, 950 and or 952 is printed, as the program can be electronically captured, via for instance optical scanning of the paper or other medium, then compiled, interpreted or otherwise processed in a suitable manner if necessary, and then stored in memory 906.

The above-described card processing management system 902 may, in one embodiment, reside within the playing card handling system 110, 200 as an internal, integrated component. In another embodiment, the card processing management system 902 may be external to the playing card handling system 110, 200 as a stand alone device. Or, if external, the card processing management system 902 may be part of another system having other functionality. In such embodiments, the 934, 934, 938 and/or 946 could include suitable convenient plug-in connector devices to facilitate coupling between the external card processing management system 902 and the playing card handling system 110, 200.

Processing system 904 (FIG. 9) is illustrated for convenience as residing in the various embodiments of the card management processing system 902. It is understood that any suitable processor system 904 may be employed. Processing system 904 may be a specially designed and/or fabricated processing system, or a commercially available processor system. Non-limiting examples of commercially available processor systems include, but are not limited to, an 80×86 or Pentium series microprocessor from Intel Corporation, U.S.A., a PowerPC microprocessor from IBM, a Sparc microprocessor from Sun Microsystems, Inc., a PA-RISC series microprocessor from Hewlett-Packard Company, or a 68xxx series microprocessor from Motorola Corporation.

Figure 10:
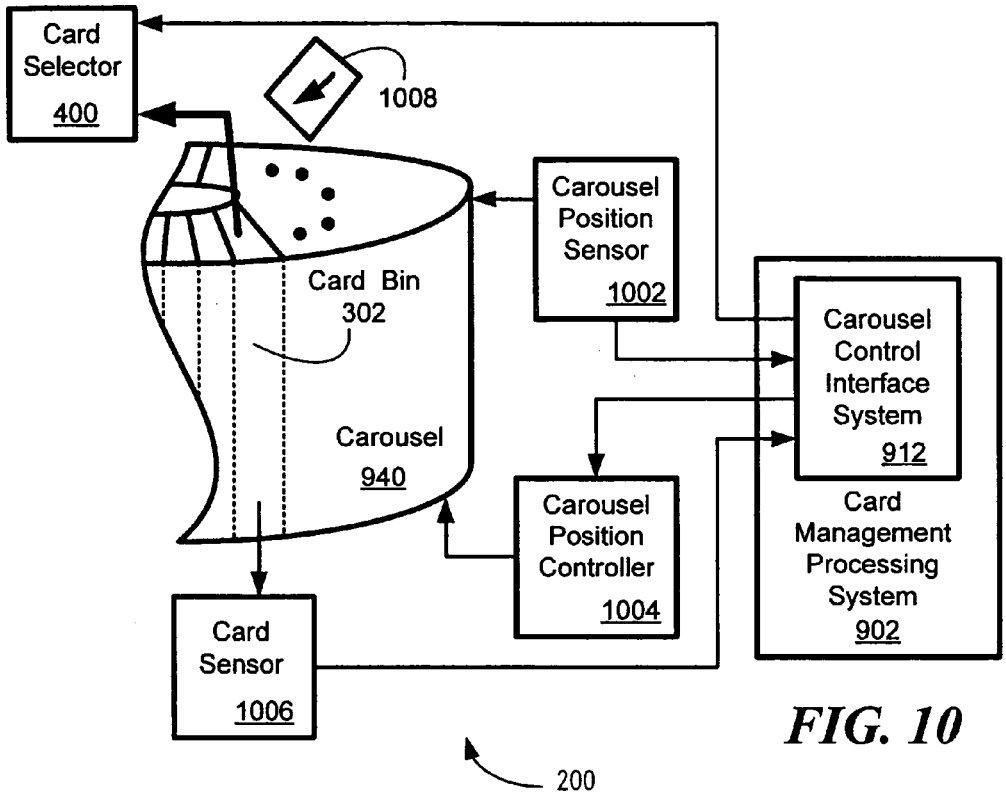
FIG. 10 is a simplified block diagram of the carousel control interface system communicatively coupled to an exemplary carousel.

FIG. 10 is a simplified block diagram of the carousel control interface system 912 communicatively coupled to an exemplary carousel 940. Carousel 940 may correspond to the above-described carousels 210, 212 (FIGS. 2A-2E). As noted herein, inventory cards 124 (FIG. 1B) are drawn from the card receiving compartments 302 (FIG. 3) by the card selector 400 (see also FIG. 4) to construct the deliverable cards 118. Similarly, collected cards 114, which are then referred to as transitional cards 128 (as they travel through the above described card paths) are inserted to their associated card receiving compartment 302 (now referred to as transitional inventory cards 128) such that the card receiving compartments 302 are restocked.

To select inventory cards 124 from an appropriate card receiving compartment 302, the carousel 940 is rotated into alignment with the card selector 400. Carousel position sensor 1002 detects position of the carousel 940. In another embodiment, upon initialization of the playing card handling system 102 or at another suitable time, carousel position sensor 1002 detects at least one fixed point on the carousel 940. As the carousel subsequently rotates, the position of any card receiving compartment 302 relative to the carousel position sensor 1002 is computationally determinable (in accordance with code instructions or logical instructions of the card management logic 954, FIG. 9).

To select any particular inventory card 124, that particular inventory card 124 is determined based upon the current virtual card of the virtual sequence 136 that is to be constructed. Once identified, the inventory card 124 needs to be selected from its corresponding card receiving compartment 302. The card management logic 954, using information in the card receiving compartment attribute table 952, determines the relative location of card receiving compartment 302 associated with the desired inventory card 124. Carousel position controller 1004 (which may correspond to the above-described motor coupled to the carousel gear 326 in one exemplary embodiment) is configured to rotate the carousel 940 such that the appropriate card receiving compartment 302 is moved into alignment with the card selector 400. Then, card selector 400 may select the desired inventory card 124 from the card receiving compartment 302. (One exemplary above-described embodiment employs a friction roller 410, residing in the selector body 402 and which is rotationally fixed to a portion of the shaft 408. Friction roller 410 is rotated by the shaft 408, wherein the rotation of the friction roller 410 selects the desired inventory card 124 from the card receiving compartment 302. Other suitable card selecting devices, system or means may be used by other embodiments.)

In some situations, a desired inventory card 124 may not reside in the corresponding card receiving compartment 302. Card sensor 1006 senses at least the presence or absence of an inventory card 124 in its corresponding card receiving compartment 302. Information corresponding to the presence or absence of the inventory card 124 in its respective card receiving compartment 302 is communicated to the card management processing system 902, via the carousel control interface system 912. As described in greater detail hereinbelow, the playing card handling system 110, 200 must then wait for the desired card to be returned into the system as a collected card 114.

To deliver a transitional card 128 into the appropriate card receiving compartment 302 the carousel 940 is rotated into alignment with the carousel branch 1008 (which corresponds to the above-described first and second carousel branches 504, 508). The current transitional card 128 is identified based upon detected characteristics of the transitional card 128. Once identified, the transitional card 128 needs to be inserted into its corresponding card receiving compartment 302. The card management logic 954, using information in the card receiving compartment attribute table 952, determines the relative location of card receiving compartment 302 associated with the incoming transitional card 128. Carousel position controller 10204 (which may correspond to the above-described motor coupled to the carousel gear 326 in one exemplary embodiment) is configured to rotate the carousel 940 such that the appropriate card receiving compartment 302 is moved into alignment with the carousel branch 1008 which will deliver the transitional card 128 into the appropriate card receiving compartment 302.

In one embodiment, the carousel position controller 1004 is a motor or the like configured to rotate the carousel 940, where a suitable electrical signal such as a voltage or a current is received from the carousel control interface system 912. In another embodiment, the carousel position controller 1004 is a motor and a controller, where a suitable control signal is received from the carousel control interface system 912. A gear, chain or belt system may be used to couple the carousel position controller 1004 to the carousel 940 in some embodiments. On other embodiments a shaft of a motor of the carousel position controller 1004 is coupled to a shaft of the carousel 940 (or may be the same shaft). Any suitable coupling means, system or method may be used to couple the carousel position controller 1004 with the carousel 940 to effect rotation of the carousel 940.

It is appreciated that with embodiments having a plurality of card carousels 940, each of the plurality of card carousels 940 are simultaneously and independently controllable by the look-forward algorithm 956. For example, a "next" inventory card 124 to be retrieved from a first carousel may be retrieved by adjusting the position of the carousel 940 such that the card selector 400 is in proximity to the card receiving compartment 302 wherein the "next" inventory card 124 resides. Concurrently, another carousel 940 may have the "next+1" inventory card 124 in one of its card receiving compartments 302, wherein the "next+1" inventory card 124 is to be selected after the above-described "next" inventory card 124 is selected and transported to the group of deliverable cards 118. While the position of the carousel having the "next" inventory card 124 is adjusted, the playing card handling system 902 may concurrently and/or independently cause the position of the other carousel having the "next+1" inventory card 124 to be adjusted. Then, shortly after the "next" inventory card 124 is selected, the "next+1" inventory card 124 can be selected since the other carousel 940 having that card is already in position for selection of the "next+1" inventory card 124.

Alternatively, a collected card 114 (now a transitional card 128), that is being transported to its designated card receiving compartment 302, has its value read by one of the card sensors 932. Upon identification of the value, the position of the destination carousel 940 may be adjusted so that its card receiving compartment 302 is in proper position so that the collected card 114 may be deposited into its receiving compartment 302 (now referred to as an inventory card 124). Concurrently, another carousel 940 may have its position adjusted for operation on an inventory card 124 in one of its receiving compartments 302, or may have its position adjusted to receive another identified transitional card 128 (previously a collected card 114).

Summarizing, the look-forward algorithm 956 (FIG. 9) is configured to monitor physical cards in the various stages of transport over branches 502-515 (FIG. 5), and coordinate the transport of physical cards with positioning of carousels and/or with construction of the deliverable cards 118. That is, when a transitional card 128 is available for redirecting to the playing card output receiver 206 for inclusion as a member of the deliverable cards 118, the transitional card 128 may be said to be in a "window of opportunity" for diversion from its destination carousel 940 (where it would otherwise be an inventory card 124) to the playing card output receiver 206.

Figure 11:
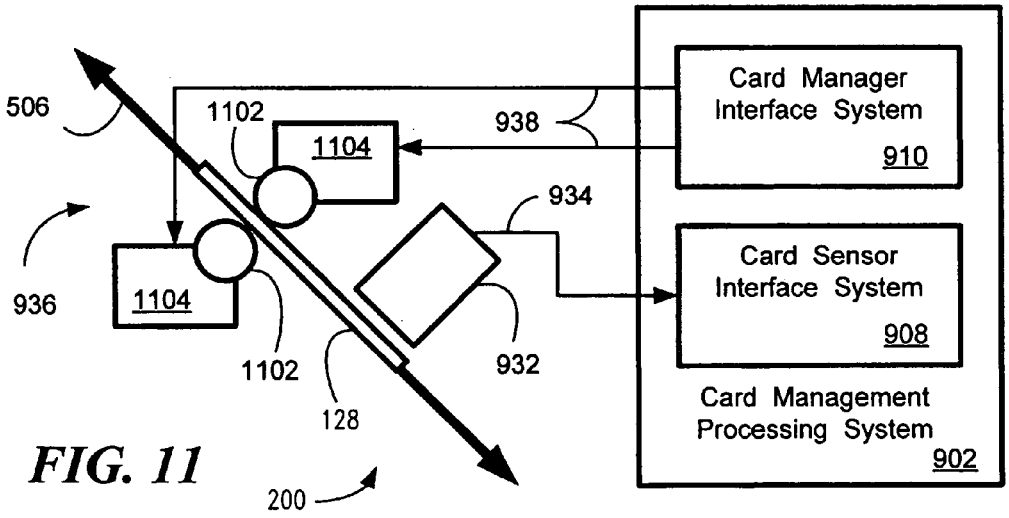
FIG. 11 is a simplified block diagram of the card manager interface system communicatively coupled to an exemplary card management device and a card sensor interface system coupled to an exemplary cards sensor.

FIG. 11 is a simplified block diagram of the card manager interface system 912 communicatively coupled to an exemplary card management device 936 and a card sensor interface system 908 coupled to an exemplary cards sensor 932. As noted herein, collected cards 114 (FIG. 1B) are received after they have been played, and are transported (now referred to as transitional cards 128) along various carousel branches (see FIG. 5) to be inserted to their associated card receiving compartment 302 (thereby referred to as inventory cards 124) such that the card receiving compartments 302 are restocked. (In some situations, the transitional card 128 may be redirected directly to the group of deliverable cards 118 if that value of that particular transitional card 128 corresponds to the value of the next card to be added into the group of deliverable cards 118.)

Card sensor 932 detects attributes and/or characteristics of the sensed physical transitional card 128 as it moves along intermediate branch 506 (or another branch). Information corresponding to the detected attributes and/or characteristics is communicated to the card management processing system 902, via the card sensor interface system, such that the unique identity of the current transitional card 128 is determined.

Card management device 936 is illustrated as a roller device for convenience. Two rollers 1102 control movement of the transitional card 128 along various carousel branches (see FIG. 5). Movement of the rollers 1102 are controlled by motors 1104, by electrical signals from the card management processing system 902, via the card manager interface system 910. Thus, the transitional card 128 may be moved along the card sensor 932 such that information may be read from the transitional card 128. If the information is not correctly read and/or interpreted, the card management device 936 may draw back the transitional card 128 across the card sensor 932 for another sensing of the attributes and/or characteristics of the transitional card 128.

In other embodiments, the card management device 936 may be any suitable device, system or means that controls movement of a transitional card 128 such that card sensor 932 sensed the attributes and/or characteristics of the transitional card 128. For example, a single roller 1102 and motor 1104 could be employed in another embodiment. Another embodiment may use a conveyor system or the like.

Figure 12:
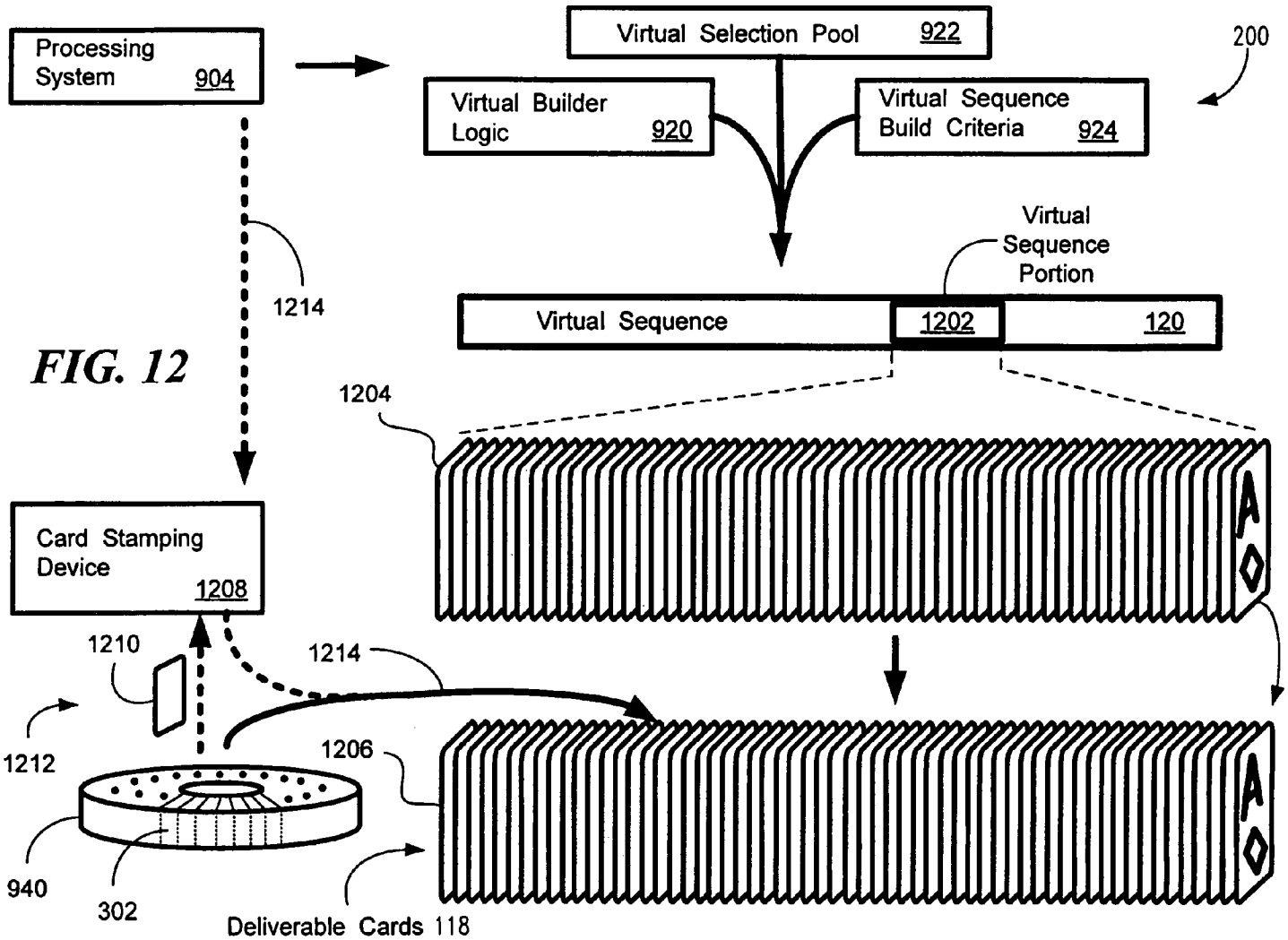
FIG. 12 is a conceptual diagram facilitating an explanation of the generation of a virtual card sequence and the subsequent construction of a corresponding group of deliverable cards.

FIG. 12 is a conceptual diagram facilitating an explanation of the generation of a virtual sequence 136 and the subsequent construction of a corresponding group of deliverable cards 118. Processing system 904 (see also FIG. 9) retrieves and executes the virtual card builder logic 920 to first generate or determine a virtual selection pool 922 based upon parameters in the virtual sequence build criteria 924.

Other parameters may be used to generate the virtual selection pool 922. For example, the game rules table may specify the type of card game that is to be played using the group of deliverable cards 118. The selected game may influence the types and/or number of virtual cards 1204 used in the virtual selection pool 922.

Then, in one embodiment, processing system 904 uses a random number generator 921 or the like to randomly select virtual cards 1204 in a serial fashion. These selected virtual cards 1204 are serially organized into the virtual sequence 136.

In another embodiment, processing system uses a random number generator 921 to sequentially order virtual cards 1204 by generating a series of random numbers, the largest random number corresponding to the number of virtual cards 1204 in the virtual selection pool 922, each number corresponding to the value of a virtual card. A data table or the like uniquely associating each virtual card 1204 with one of the numbers enables the processing system 904 to sequence the virtual cards 1204 into virtual sequence 136.

In yet another embodiment, virtual cards are selected from an unmodified virtual selection pool 922 each time a virtual card is selected. Similar to an electronic slot machine, the probability of any particular value being selected for a virtual card remains constant for each selection.

In some embodiments, a portion of the virtual sequence 136 (referred to as the virtual sequence portion 1202) may be selected from the virtual sequence 136. The virtual sequence portion 1202 is used to identify physical cards 1206 that will be selected from the inventory cards 124 and/or the transitional cards 117 (FIG. 1B) as the group of deliverable cards 118 are constructed.

For example, but not limited to, one of the parameters used to generate the virtual selection pool 922 may specify that eight (8) standard 52-card decks are to be used to create a virtual selection pool 922, Accordingly, the generated virtual selection pool 922 will initially comprises 416 virtual cards 1204.

Another parameter may, in this example, specify that the deliverable cards 118 contain a total of 208 physical cards 1206 (corresponding to four standard 52-card decks). Thus, 208 virtual cards 1204 from the virtual selection pool 922 will be used to generate the virtual sequence portion 1202. The generated virtual sequence portion 1202 will then be used to construct the group of deliverable cards 118.

In some embodiments, the number of virtual cards 1204 of the virtual sequence portion 1202 may be the same as the number of virtual cards 1204 of the virtual sequence 136. This may occur if the parameter defining the number of card decks used to construct the virtual selection pool 922 is the same as the number of decks specified for the virtual sequence portion 1202. Casino rules, governmental regulatory rules and/or game rules may stipulate this condition.

In yet other embodiments, the virtual selection pool 122 is based upon virtual cards identified by value or another indicator. As virtual cards 1204 are sequentially selected during generation of the virtual sequence 136, the likelihood or probability of selecting one of a particular virtual card from the virtual selection pool remains constant. For example, if a group of deliverable cards 118 is to be constructed from a standard 52-card playing deck, the probability of the first card having a value of the A♠ is 1/52. When the second virtual card (and subsequent virtual cards) is selected for the virtual sequence 136, the probability of the second virtual card (and virtual subsequent cards) having a value of the A♠ remains at 1/52.

Alternatively, processing system 904 may generate the virtual selection pool 922 using a first parameter (corresponding to a first number of virtual cards 902) and then generate another number of virtual cards 1204 (from the virtual cards 1204 of the virtual selection pool 922) to construct the virtual sequence 136, stopping the construction of the virtual sequence 136 when the number of virtual cards 1204 specified for the group of deliverable cards 118 equals the number of selected virtual cards 1204.

After generation of the virtual sequence portion 1202, physical cards 1206 are retrieved from the inventory cards 124 residing in a carousel 940 and/or from an identified collected card 114 (FIG. 1B). Each of the sequentially retrieved physical cards 1206 correspond to a respective one of the virtual cards 1204 in the virtual sequence portion 1202. The retrieved physical cards 1206 are transported (generally denoted by the line 1214) in serial fashion to construct the group of deliverable cards 118.

For example, in FIG. 12 the first card of the virtual sequence portion 1202 is illustrated as the Ace of Diamonds (A♢). The virtual A♢ card 1204 is used to define the first physical card 1206 of the group of deliverable cards 118. Accordingly, one of the available physical A♢ cards is selected from the carousel receiving compartments 302 and placed in a suitable receptacle, such as the playing card output receiver 206, as the first physical card 1206. The process of sequentially retrieving physical cards 1206 based upon a specified virtual card 1204 of the virtual sequence portion 1202 continues until the group of deliverable cards 118 has been constructed. Then, the group of deliverable cards 118 are transported to a location where the dealer or another participant or casino employee may access the group of deliverable cards 118.

In some situations, after generation of the virtual sequence portion 1202, the virtual cards 1204 may be additionally processed again in accordance with another parameter. In one exemplary embodiment, an optional card stamping device 1208 is configured to intercept (generally denoted by the dashed-line 1212) a physical card 1210 that is being transported to the group of deliverable cards 118. Instructions for printing a message and/or symbol on the intercepted physical card 1210 are communicated from the processing system 904 (generally denoted by the dashed-line 1212) to the card stamping device 1208. Then, after stamping or otherwise marking the intercepted physical card 1210 with an ink or the like, the intercepted card 1210 can be returned to the card path 1214 for insertion into the group of deliverable cards 118 in its proper sequenced location.

For example, one of the parameters of the virtual card builder logic 920 or the virtual sequence build criteria 924 (or another parameter residing elsewhere) may specify that one or more of the physical cards are to be made a "bonus" card. The bonus card may reward a player with a desirable gift or the like (e.g., a free hotel room, a complimentary dinner, etc.) Accordingly, information indicating to the player receiving the bonus card is stamped onto the bonus card. The information may be in any suitable format, including textual information and/or a special symbol. It is appreciated that the number of, and types of, rewards gifted to a player(s) receiving a bonus card are unlimited. All such variations are intended to be within the scope of this disclosure.

The physical cards 1206, that are to referred to as bonus cards (and marked by the card stamping device 1208), may be identified by specifying a virtual card 1204 in the generated virtual sequence portion 1202 and/or the generated virtual selection pool 922 based upon a specified criteria or based upon a random criteria. Or, physical cards 1206 may be selected as they are being transported to the group of deliverable cards 118 based upon a specified criteria or based upon a random criteria. It is appreciated the number of possible methods of identifying and selecting a physical card 1206 for stamping is limitless. All such variations are intended to be within the scope of this disclosure.

Furthermore, selection of virtual cards 1204 and/or physical cards 1206 may be comprised of one or more sub-portions of generated virtual sequence portion 1202 and/or the group of deliverable cards 118, respectively. For example, a last sub-portion of the generated virtual sequence portion 1202 and/or the group of deliverable cards 118 may have selected virtual cards 1204 or selected physical cards 1206, respectively, to entice a player(s) to continue playing in hopes of receiving one of the bonus cards.

In some embodiments, during generation of the virtual sequence portion 1202 and/or the generated virtual selection pool 922, parameters which establish the selection criteria used by the random number generator 921 (or the like) of the virtual card builder logic 920 are changed during the generation process. That is, parameters impacting the probability of card selection, and thus affecting game odds, may be modified. For example, in a game played by a plurality of players, one of the players may optionally select to receive cards having a higher or lower odds of winning than the odds for the other players. (Of course, payout would likely be adjusted accordingly.) For example, Player A may wish to play a hand and/or a game based upon a virtual selection pool 922 constructed under a criteria of eight (8) traditional 52-card desks. Player B may wish to play a hand and/or a game based upon a virtual selection pool 922 constructed under a criteria of one (1) traditional 52-card desk. As another example, Player C may wish to have the opportunity to have wild cards introduced into his hand. Accordingly, various embodiments of the playing card handling system 110 are configured to accommodate special parameters during the above-described processes that result in a constructed group of deliverable cards 118.

In some situations, the virtual sequence 136 may have a limited number of a particular value of a virtual card. For example, but not limited to, the virtual sequence 136 may be limited to having only eight A♠ card values, even if the virtual selection pool 922 was based upon ten standard 52-card playing decks. Or, the virtual sequence 136 may be limited to having only a particular rank or suit. For example, but not limited to, the virtual sequence 136 may be limited to having only eight A card values (of the four suits). Or, virtual sequence 136 may be limited to having at most one half of the virtual cards having the ♠ suit.

In some of the above-described embodiments, the processing system 904, may selectively modify selected ones of the above-described parameters as a plurality of virtual card sequence portions 1202 are generated. The plurality of virtual card sequence portions 1202, one designated for each different player, may be joined, thereby creating a sequence of virtual cards 1204 that is used to construct a group of deliverable cards 118. The group of deliverable cards 118 would then have a plurality of sub-groups therein, each sub-group designated for a particular player based upon the selected modified parameter. In some embodiments, a divider card (such as, but not limited to, an unmarked and/or colored card) may be selected from a card receiving compartment 302 and placed between successive sub-groupings of physical cards to ensure that players receive hands based upon the selected modified parameter.

The above-described process of building a group of deliverable cards 118 (FIG. 1B) [which may be generally described as generating a virtual sequence 136 from the virtual selection pool 922, defining a virtual sequence portion 1202 from the virtual sequence 136, and then retrieving inventory cards 124 and/or transitional cards 128 to construct the deliverable cards 118], and the above-described process of returning collected cards 114 to the carousel receiving compartments 302 of the carousels 940 (FIGS. 9 and 12), were described as separate processes for convenience. In most embodiments, the processes of building a group of deliverable cards 118 and transporting collected cards 114 to the compartments 302 of the carousels 940 operate concurrently. That is, the card management processing system 902 is configured to control flow of a plurality of physical cards along the branches 502-515 (FIG. 5) in an integrated manner. Thus, embodiments may be configured to simultaneously build groups of deliverable cards 118, restock carousels 940 with inventory cards 124, receive collected cards 114, sense and/or evaluate transitional cards 128, operate on transitional cards 128, etc. Such operational flexibility is enabled because the transport of physical cards over the various branches 502-515, and/or card transport at individual points along the branches 502-515, and/or control of the carousel(s) 940, are independently controllable. Accordingly, processing system 904, when executing the various logic 920, 948, 954, and/or 956, and/or operating on the information of 922, 924, 926, 950 and or 952, may concurrently perform a plurality of different operations.

For example, a collected card 114 may be input into the input branch 506 (thereby becoming a transitional card 128). Concurrently, a selected inventory card 124 (referred to now as a transitional card 128) may be in transport along one of the carousel branches 504 or 508 as it is being selected (removed from its card receiving compartment 302) from the carousel 940 (FIG. 10) by that receiving compartment's card selector 400. Thus, two physical cards are being transported concurrently in this simplified example. Various card sensors 932 (FIG. 9) communicate information to the card management processing system 902 such that the processing system 904 tracks location of the two physical cards on a real-time (or near real-time) basis.

In other embodiments, a plurality of physical cards may be concurrently tracked and/or transported along the various the branches 502-515. For example, a third physical card may concurrently be transported in the exit branch 510 for deposit into a trash receiving compartment or the like. Or, another physical card may concurrently be transported in the intermediate branch 506 having cards sensors 932 and card management devices 936 configured to detect that two or more transitional cards 128 are in contact with each other (i.e., stuck together) and need separation from each other so that further processing of the transitional cards 128 may occur. Or, a transitional card 128 may be in proximity to one of the above-described diverters 602, 604 (FIG. 6), wherein actuation of a diverter 602, 604 may divert the transitional card 128 from going into is assigned card receiving compartment 302 such that the transitional card is transported to, for example, the group of deliverable cards 118. In various embodiments, these above-described scenarios, and other card tracking and/or transport scenarios, may all occur concurrently.

As another example of concurrently managing transportation of physical cards over the various branches 502-515, a "look-forward" algorithm 950 may be included in memory 906 (FIG. 9). Processing system 904 determines a "next" virtual card of the virtual sequence portion 1202 (FIG. 12), which defines the "next" physical card 1206 that is to be added to the group of deliverable cards 118. As noted herein, the "next" physical card 1206 may be retrieved from one of the card receiving compartments 302, or may be a transitional card 128 that may be diverted. During transport of a transitional card 128 to its assigned card receiving compartment 302, when the transitional card is in proximity to one of the above-described diverters 602, 604 (FIG. 6), the transitional card 128 may be considered to be within a "window of opportunity" such that the transitional card 128 may be successfully diverted to the group of deliverable cards 118 being constructed.

Diverting the transitional card 128 directly to the group of deliverable cards 118 may be done more quickly than retrieving the "next" physical card from one of the carousel receiving compartments 302 because the diverted transitional card 128 is readily available and may have a relatively short distance to travel to playing card output receiver 206. In comparison, if an inventory card 124 is retrieved from a card receiving compartment 302, it is likely that the position of the receiving compartment must be changed to bring the card selector (FIGS. 4 and 10) into position such that the inventory card 124 can be selected out of the card receiving compartment 302. Then, the selected inventory card 124 (now referred to as a transitional card 128) must be transported all the way to the playing card output receiver 206 (FIGS. 2A-2E). Thus, the process of retrieving an inventory card 124 may take longer that diverting a suitable transitional card 128. By diverting the transitional card 128 to the playing card output receiver 206 so that the transitional card 128 may be used as the "next" card of the deliverable cards 118, the overall process of managing cards by the playing card handling system 110, 200 may be quickened.

Additionally, virtual card operations may be concurrently performed by various embodiments. For example, one or more virtual selection pools 922 (FIG. 9) may be concurrently generated based upon different parameters. Or, processing system 904 may be operating in a parallel mode wherein one or more virtual sequences 132 are being constructed from one or more one or more virtual selection pools 922. Processing system 904 may be generating a plurality of virtual sequence portions 1202 from one or more virtual sequences 132. Or, all of, or some of, the above-described virtual card operations may be occurring concurrently.

It is appreciated that the various possibilities of concurrently managing, tracking or transporting physical cards through the playing card handling system 110, and/or concurrently performing virtual card operations, are too numerous to describe in detail herein. Such embodiments performing a plurality functions are intended to be within the scope of this disclosure and be protected by any accompanying claims.

As noted herein, carousels or storage devices having card compartments may be interchangeable. Thus, the playing card handling system 110, 200 may be adding physical cards to and/or removing physical cards from some of the carousels or storage devices, which other carousels or storage devices are being removed and/or replaced with other carousels or storage devices.

The above-described "random number generator" which constructs the virtual sequence 136 may be implemented by a variety of algorithms. In one embodiment, the random number generator 921 (FIG. 9) may computationally generate virtual cards of the virtual sequence 136 or the virtual sequence portion 1202 (FIG. 12). That is, a number associated with a value of a physical card may be directly generated in a random manner. In another embodiment, the random number generator 921 may generate a random series of numbers, wherein the range of numbers that may be generated may correspond to the total number of virtual cards of the virtual selection pool. Such virtual cards could be associated with the generated numbers through the use of a look-up table or the like. In another embodiment, a random number generator 921 could generate values corresponding to characteristics which identify a physical card. For example, in the case of a standard 52-card deck, a first value corresponding to a card suit, and another value corresponding to card rank could be separately generated, thereby defining a card having a particular value. It is appreciated that other algorithms, commonly referred herein as "random number generator" algorithms for convenience, may be used to generate, process and/or define virtual cards 1204 as described herein, and that such algorithms are too numerous and/or too complex to describe in detail herein. All such algorithms are intended to be included within the scope of this disclosure and to be protected by any accompanying claims. While referred to herein and in the claims as being a random number or random number generator, such terms encompass numbers and generators that are not truly random in the mathematical sense, such as those often referred to as being pseudo-random.

Other embodiments of a playing card handling system 110 are configured to operate on physical cards 1206 (FIG. 12) without the use of the random number generator 921 (FIG. 9). For example, one or more predefined virtual sequences 132 and/or virtual sequence portions 1202 may be used to construct a group of deliverable cards 118. Thus, predefined virtual sequences 132 and/or virtual card sequence portions 1202 can be specified so that a corresponding group of deliverable cards 118 may be constructed at will. The predefined sequence may be stored in a look-up table or the like. Also, the group of deliverable cards 118 may be constructed repetitively.

For example, in certain types of card tournaments, such as in a duplicate bridge tournament, players at a gaming table 102 play predefined hands. As that game is completed, the players move to the next gaming table 102 and each player plays the same respective hand that was previously played at that gaming table 102. That is, all gaming tables 102 at the duplicate bridge tournament have a unique set of hands (groups of cards) that all of the tournament players and/or teams play. Accordingly, embodiments of the playing card handling system 110 may repeatedly construct and deliver the necessary hands which must be identical from game to game. The definition of the hands (corresponding to four virtual card sequence portions 1202) may be determined as virtual cards by a remote device. The information determined by the remote device would provided to one or more of the card management processing systems 902, via the user device interface 912 (FIG. 9). Alternatively, the hands may be defined and/or generated by the management processing systems 902 such that the unique hands are repetitively constructed for tournament play.

As another hypothetical example wherein a playing card handling system 110, 200 may be configured to operate on physical cards 1206 (FIG. 12) without the use of the random number generator 921 (FIG. 9), the playing card handling system 110 may be used to create sorted groups of playing cards. That is, the physical cards may be directly sorted in a predefined manner. For example, one or more sorted standard 52-card decks may be created from a plurality of collected cards 114. Consider a hypothetical scenario wherein 520 mixed playing cards are input to the playing card handling system 110. Up to ten sorted groups of deliverable cards 118 corresponding to sorted standard 52-card decks could then be created from the 520 mixed playing cards.

As another hypothetical example wherein a playing card handling system 110, 200 may be configured to operate on physical cards 1206 (FIG. 12) without the use of the random number generator 921 (FIG. 9), the playing card handling system 110, 200 may be used to inspect groups of physical cards. For example, a standard 52-card deck could be provided to embodiments of the playing card handling system 110, 200 such that various card sensors 400 (FIG. 4) sense physical characteristics of the cards. Non-limiting examples of physical characteristics include, but are not limited to, card appearance, card quality and/or card value. As physical cards are individually inspected, the card may then be transported directly to the playing card output receiver 206 (FIGS. 2A-D). If the assembled and inspected group of deliverable cards 118 created from the inspected cards is acceptable, the playing card output receiver 206 could return the group of deliverable cards 118 to the user. In other embodiments, problem cards could be identified and/or removed, and if removed, replaced by an acceptable inventory card 124. Reports providing information relating to the inspected physical cards may be output to a user device 928 (FIG. 9) by some embodiments. It is appreciated that such an inspection process may be completed relatively quickly since in some embodiments the carousels 940 or other card compartment structures may not be in use.

It is appreciated that the various types of scenarios wherein a playing card handling system 110, 200 is configured to operate on physical cards 1206 (FIG. 12) without the use of the random number generator 921 will be apparent in light of the teachings herein. Any such scenarios, methods and or systems are intended to be included within the scope of this disclosure and to be protected by any accompanying claims.

Figure 13:
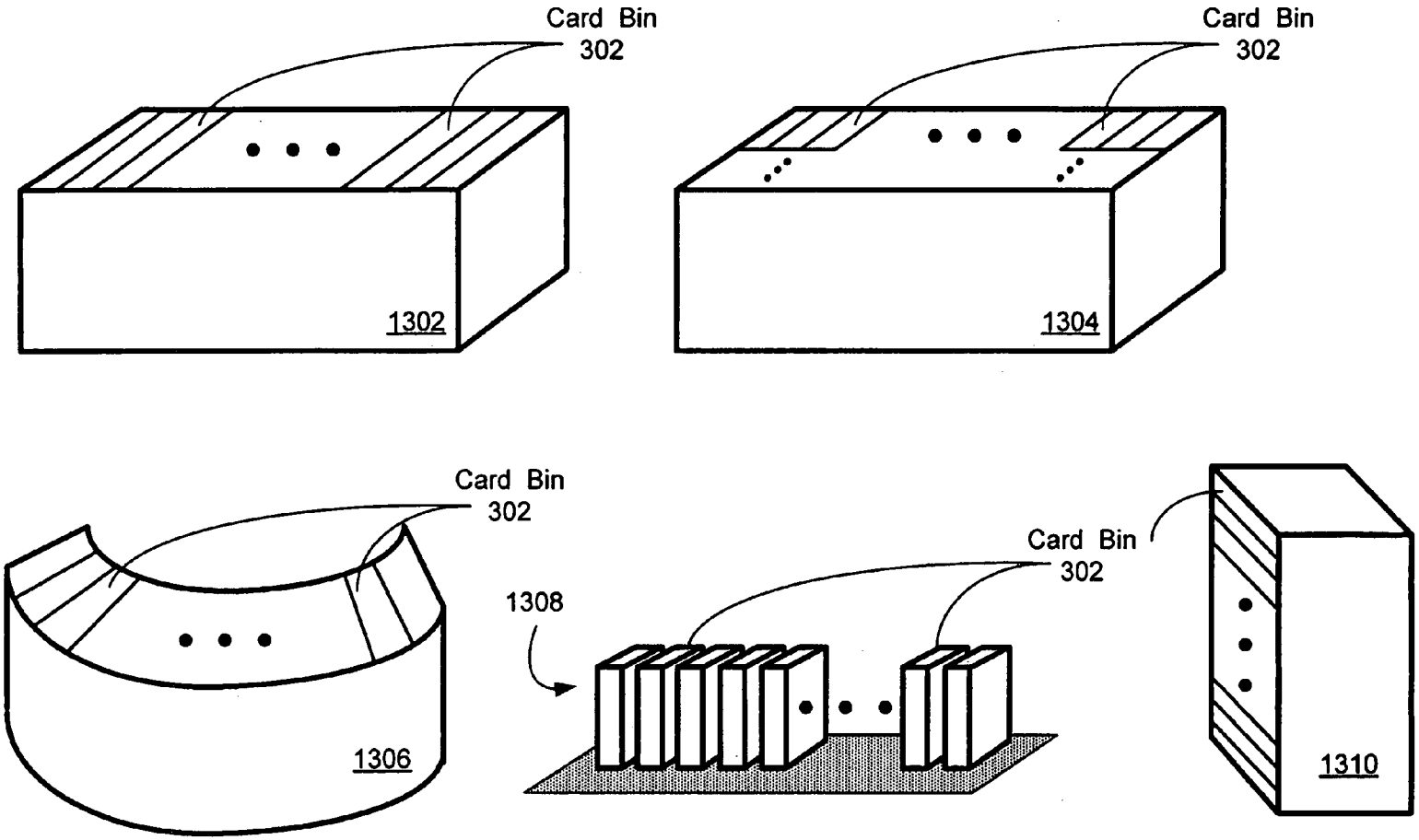
FIG. 13 illustrates selected alternative embodiments of card storage devices.

As noted herein, the term "carousel" as used herein is intended to be a generic term for a structure that comprises an endless plurality of physical playing card receptacles, referred to as card receiving compartments for convenience, particularly suited for rotational movement. FIG. 13 illustrates selected alternative embodiments of card storage devices. Rack 1302 is a rectangular structure having a plurality of card receiving compartments 302 disposed therein suitable for translation. Rack 1304 is a another type of rectangular structure having a matrix of card receiving compartments 302 disposed therein suitable for translation. Storage device 1306 is an arc-like structure having a plurality of card receiving compartments 302 disposed therein suitable for pivoting. Rack 1308 is a conveyor type structure having a plurality of card receiving compartments 302 disposed thereon suitable for translation. Rack 1310 is a vertically-oriented rectangular structure having a plurality of card receiving compartments 302 disposed therein. It is appreciated that the various types of structures and/or orientations employing card receiving compartments 302 are too numerous to describe in detail herein. Furthermore, if such structures are moved to orient a selected card receiving compartment 302 with a card selector 400 (FIG. 4), the structure may be moved in any suitable direction, orientation and/or manner. Any such structure and/or orientation comprising a plurality of card receiving compartments 302 configured to be a repository for inventory cards 124 are intended to be included within the scope of this disclosure.

As noted herein, the bonus cards and/or specialty cards may be defined and/or selected after generation of the virtual sequence 136. In alternative embodiments, bonus cards and/or specialty cards may be defined concurrently with other parameters or criteria used to build the virtual selection pool 122. Accordingly, such bonus cards and/or specialty cards would be selected with the same probability as any other virtual card in the virtual selection pool. Furthermore, in other embodiments, additional bonus cards and/or specialty cards could be later added after generation of the virtual sequence 136 as described herein.

FIGS. 14, 15, 16 and 17 are flow charts 1400, 1500, 1600, and 1700, respectively, illustrating possible operation of the logic modules 920, 948 and/or 954 of FIG. 9 as related to the various functions relating to card management. The flow charts 1400, 1500, 1600 and 1700 show the architecture, functionality, and operation of a possible implementation of the software for implementing the logic modules 920, 948, 954, and/or 956. In this regard, each block may represent a module, segment, or portion of code, which comprises one or more executable instructions for implementing the specified logical function(s). It should also be noted that in some alternative implementations, the functions noted in the blocks may occur out of the order noted in FIGS. 14-17 or may include additional functions. For example, two blocks shown in succession in FIGS. 16-17 may in fact be executed substantially concurrently, the blocks may sometimes be executed in the reverse order, or some of the blocks may not be executed in all instances, depending upon the functionality involved, as will be further clarified hereinbelow. Furthermore, some blocks of one of the flow charts 1400, 1500, 1600, and 1700 may be interchanged with the blocks of one of the other flow charts and/or may be added to one of the other flow charts. All such modifications and variations are intended to be included herein within the scope of this disclosure.

Furthermore, it is appreciated that the simplified illustrative flow charts 1400, 1500, 1600 and 1700 of FIGS. 14-17, respectively, describe only selected ones of the many above-described processes for card management. Because of the numerous variations described herein, specific flow charts are not provided for each of the various alternative embodiments and methods described herein.

Figure 14:
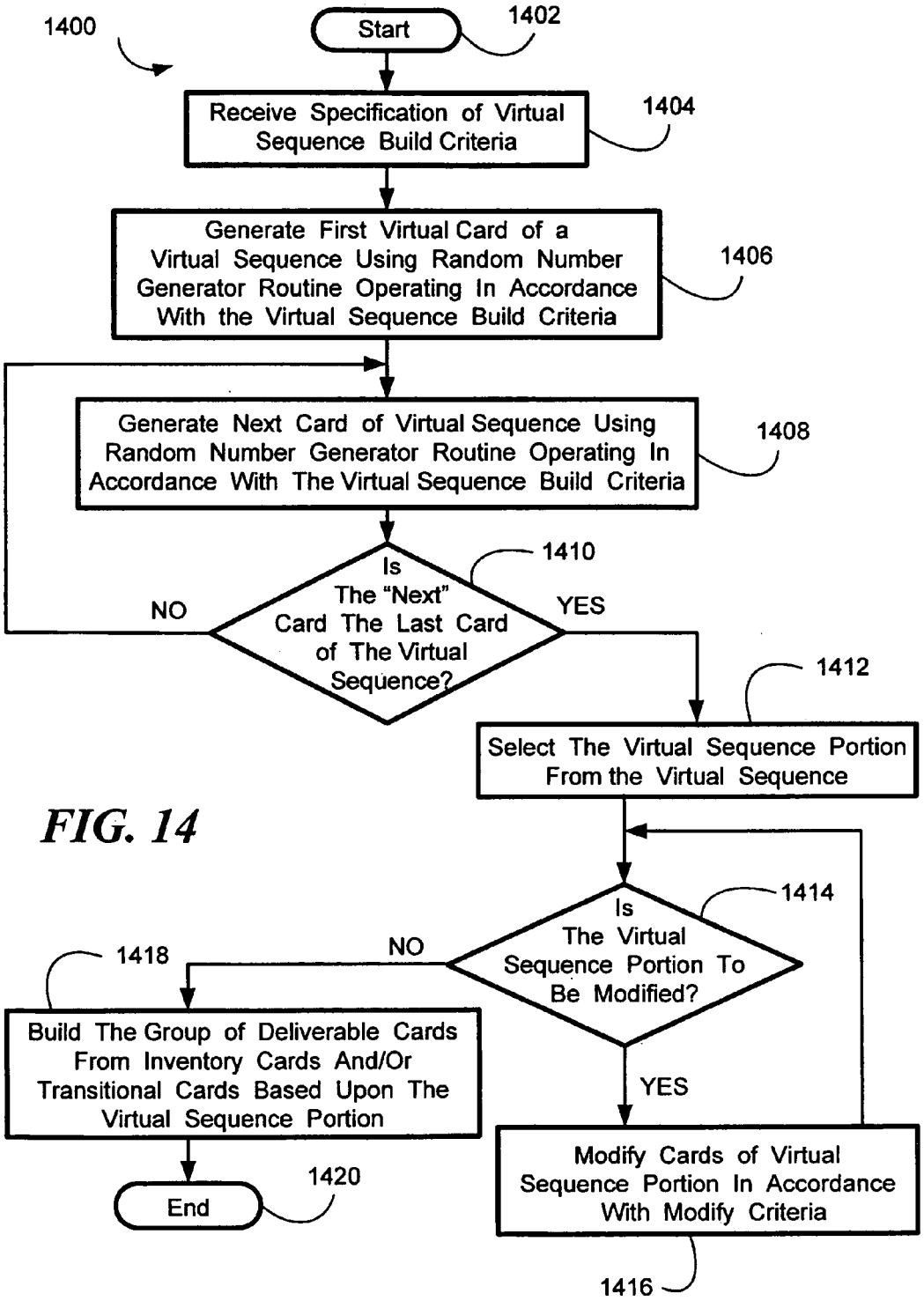
FIG. 14 is a flow chart illustrating a process of the generation of a group of deliverable cards.

FIG. 14 is a flow chart 1400 illustrating a process of the above-described generation of a group of deliverable cards 118. The process starts at block 1402. At block 1404, the card management logic 954 (FIG. 9) receives specifications corresponding to the virtual sequence build criteria 924. Such criteria and/or parameters are described hereinabove.

At block 1406 the random number generator 921 generates a first virtual card of the virtual sequence 136 in accordance with the virtual sequence build criteria. This first virtual card is selected from one of the virtual cards available from the above-described virtual selection pool 922. Any of the above-described random number generator algorithms 921 may be used by various embodiments. Alternatively, the virtual sequence may not be random, but rather may be a sorted sequence, for example one from a look-up table.

At block 1408 the random number generator 921 generates the next virtual card of the virtual sequence 136 in accordance with the virtual sequence build criteria 924. This next virtual card is selected from one of the remaining virtual cards available from the above-described virtual selection pool 922. Thus, the first virtual card selected at block 1406 is not available for selection at block 1408.

At block 1410, a determination is made whether the generated next virtual card is the last card of the virtual sequence 136. If not (the NO condition), the process loops back and selects another "next" card. This looping continues until the last card of the virtual sequence 136 has been generated. As noted above, the last virtual card may correspond to a selected size (total number of virtual cards) of the virtual sequence 136. The size of the virtual sequence may be equal to the total number of virtual cards available form the virtual selection pool 922, or may be a lesser number of virtual cards.

If, at block 1410, the last card of the virtual sequence 136 has been generated (the YES condition), the process continues to block 1412. At block 1412 the virtual sequence portion 1202 (FIG. 12) is selected from the virtual sequence 136. As noted above, the virtual sequence portion 1202 may correspond to all of the virtual sequence 136, or a selected portion of the virtual sequence 136. If a portion is selected, the portion may be drawn from anywhere in the virtual sequence 136 at random or based upon some specified parameter. Furthermore, a plurality of virtual sequence portions 1202 may be selected from the virtual sequence 136. In some situations, the plurality of selected portions may overlap virtual cards of the virtual sequence 136, or may be contiguous with virtual cards of the virtual sequence 136, and/or may be separated by unselected virtual cards of the virtual sequence 136. In some embodiments, blocks 1410 and 1412 may be combined so that the virtual sequence portion 1202 is directly selected from the virtual selection pool 922.

After the virtual sequence portion(s) 1202 have been determined, the process may end in some embodiments. In such embodiments, the process proceeds to block 1418, described below.

In other embodiments, it may be desirable to perform other operations on the determined virtual sequence portion(s) 1202. Thus, the process continues to block 1414 where a determination is made whether one or more of the virtual cards of the virtual sequence portion 1202 are to be modified (the YES condition).

For example, but not limited to, bonus cards may be selected to be marked as described above. In some embodiments, such operations may be performed at a virtual level. If a virtual card of the virtual sequence pool is to be modified, the corresponding physical card 1206 may be modified as the group of deliverable cards are being constructed. Accordingly, the process continues to block 1414.

At block 1414, a determination is made whether one or more of the virtual cards of the virtual sequence portion 1202 are to be modified in accordance with at least one criteria and/or parameter. For convenience, the process then returns to block 1414 in the event that additional modifications are desired.

The process continues to block 1418 when the determination is made that one or more of the virtual cards of the virtual sequence portion 1202 are not to be modified (the NO condition), or if it is determined that no other modifications are to be performed. Based upon the modified virtual sequence portion (or the unmodified virtual sequence portion if no modifications are performed), the playing card handling system 110, 200 constructs the group of deliverable cards 118. The group of deliverable cards 118 is constructed by selecting physical inventory cards 124 and/or transitional cards as described hereinabove. The process then ends at block 1420.

It is appreciated that the logic of blocks 1414 and 1416 may be performed separately as a separate process to modify physical cards. For example, rather than selecting a virtual card for modification at block 1416, a physical card may be modified at block 1416 in accordance with blocks 1414 and 1416, or another suitable logical process.

Figure 15:
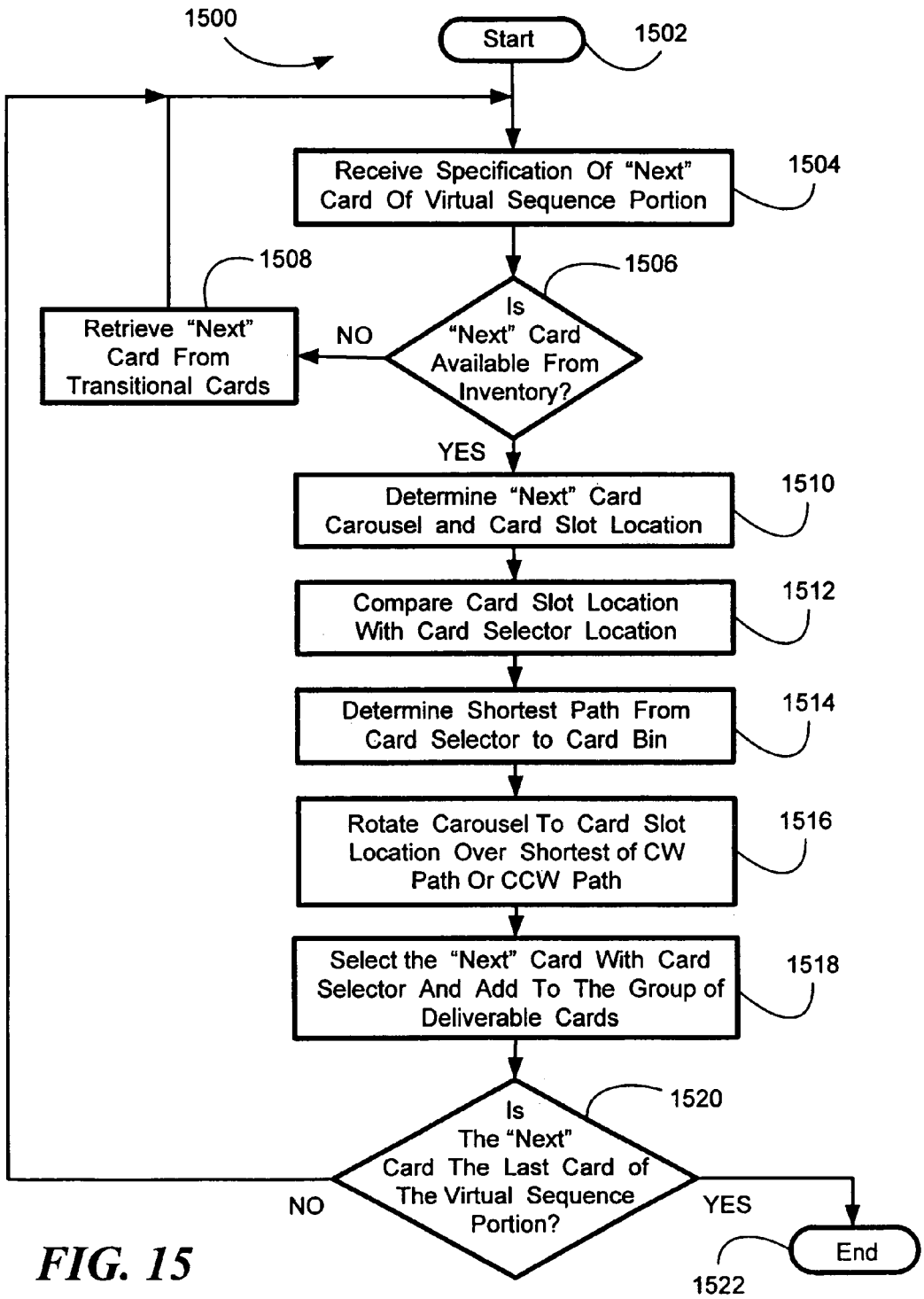
FIG. 15 is a flow chart illustrating a process of the selection of the inventory cards of FIG. 1B from the card storage devices of FIGS. 1-12.

FIG. 15 is a flow chart 1500 illustrating a process of the above-described selection of inventory cards 124 (FIG. 1B) from carousels 940 (FIG. 9). The process starts at block 1502. At block 1504, the card management logic 954 (FIG. 9) specifies a "next" card of the current virtual sequence portion 1202. At block 1508*a* determination is made whether the specified "next" card can be selected from a card receiving compartment 302 of a carousel 940 as described hereinabove (see also FIGS. 10 and 11). That is, can the "next" card be an inventory card 124?

If not (the NO condition), the process continues to block 1508 wherein the "next" card is, at some point, selected from a transitional card 128 as described hereinabove (see also FIGS. 10 and 11). If a transitional card 128 is selected, the process proceeds back to block 1504 where the "next+1" card is specified.

At block 1506, if a determination is made that the specified "next" card may be selected from an inventory card 124 residing in a card receiving compartment 302 of a carousel 940 (the YES condition), the process proceeds to block 1510. At block 1510, the card management processing system 902 determines the location of the specified "next" card. If a plurality of carousels 940 are employed, the carousel 940 having the card receiving compartment 302 assigned to the specified "next" card is identified. Also, the location of the card receiving compartment 302 in the identified carousel 904 is identified.

Then, at block 1512 the identified location of the card receiving compartment 302 associated with the specified "next" card is compared with the relative location of the card selector 400 (FIGS. 4 and 10) that will select the specified "next" card. At block 1414 the shortest path for the card selector to access the identified card receiving compartment 302 is determined.

At block 1516, in embodiments employing carousels 940, the carousel 940 is rotated in a counter-clockwise (CCW) or a clockwise (CW) direction such that the carousel 940 movement is minimized. Accordingly, the selection of the shortest path results in the fastest alignment of the card selector 400 and the card receiving compartment having the inventory card 124 associated with the specified "next" card. In other embodiments employing racks, the rack may be translated in an appropriate direction (e.g., left, right, up, down, or forward, back).

As discussed herein, a variety of other card storage devices 1302-1310 (FIG. 3), for example, may be used for retaining inventory cards 124 in their specified card receiving compartments 302. In such embodiments, the above-described blocks 1510-1516 would be modified as necessary to accommodate the particular structures of that embodiment. Furthermore, in some embodiments wherein the carousel 940 (or card storage devices 1302-1310) remain stationary and the card selector 400 moves to the identified card receiving compartment 302 holding the identified inventory card 124, the above-described blocks 1510-1516 would be modified as necessary.

Once the card selector 400 is in alignment with the identified card receiving compartment 302 holding the identified inventory card 124 (the "next" card), the inventory card 124 is selected at block 1518 and is added (transported to) the group of deliverable cards 118. The process then proceeds to block 1520 where a determination is made whether the selected "next" card is the last card of the virtual sequence portion 1202. That is, the selected "next" card is the last card to be added to the group of deliverable cards 118. If so (the YES condition), the process proceeds to block 1522 and ends. If another card is to be identified and selected (the NO condition), the process returns to block 1504 for the "next+1" card.

It is appreciated that the above-described process of selecting an inventory card 124 from a receiving compartment in accordance with the flow chart 1400 may be modified to be applicable with the above described process of flow chart 1600 wherein the embodiment is using the look-forward algorithm 950 to determine if the "next" card can more quickly be selected from a transitional card 128.

Figure 16:
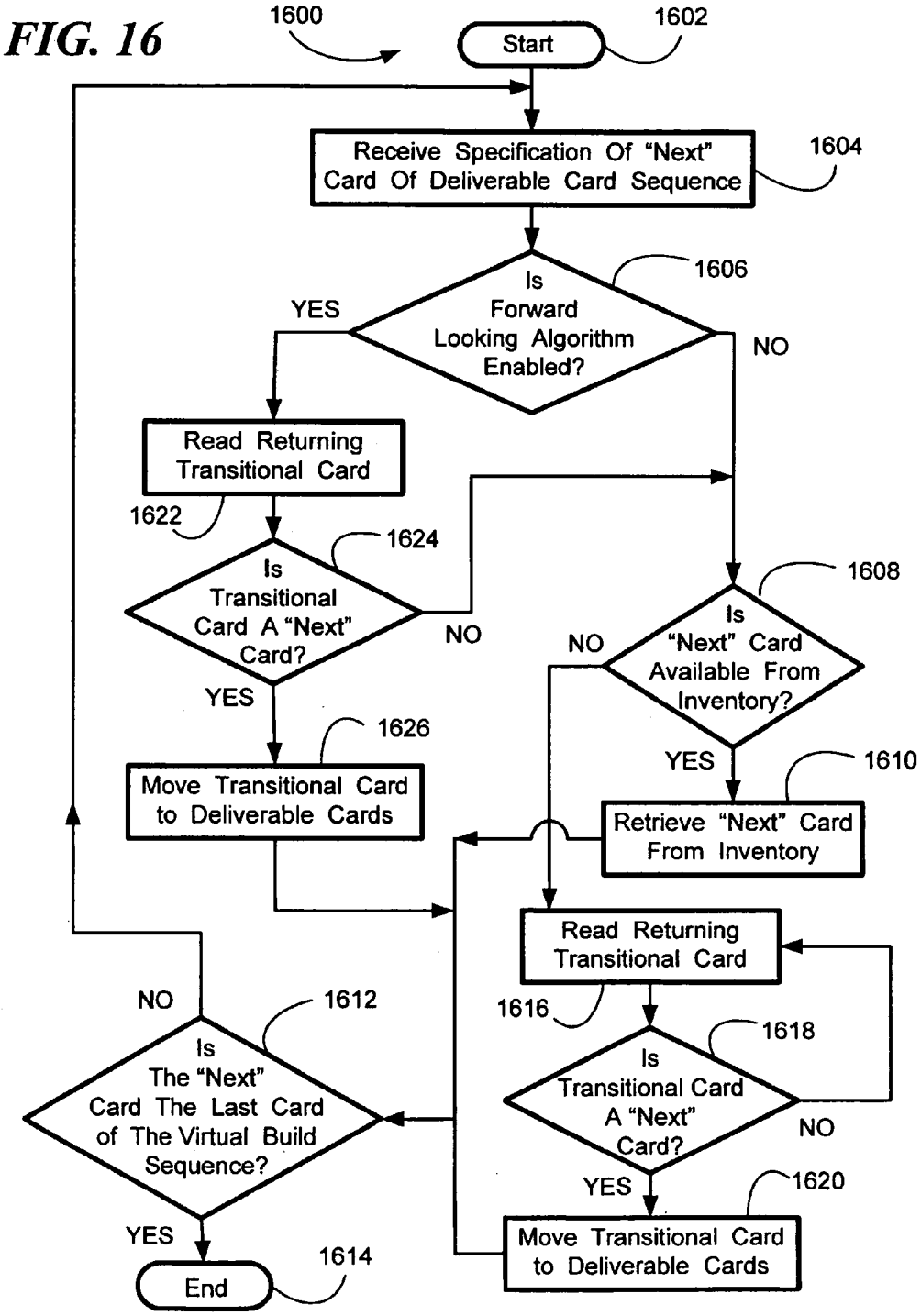
FIG. 16 is a flow chart illustrating a process of the look-forward algorithm.

FIG. 16 is a flow chart 1600 illustrating a process of the above-described look-forward algorithm 950 (FIG. 9). The process starts at block 1602. At block 1604, the card management logic 954 receives a specification for a "next" card of a deliverable card sequence. The specification may be based on the corresponding "next" card of the virtual sequence portion 1202 that is being used as the basis for the construction of the group of deliverable cards 118. At block 1606 a determination is made whether the look-forward algorithm 950 is enabled. If not (the NO condition), the process proceeds to block 1608 where a determination is made whether the "next" card is available from the card inventory 112 residing in the carousel(s) 940.

If an inventory card 124 is available (the YES condition at block 1608), the "next" physical card is retrieved at block 1610 from the card receiving compartment 302 having the requested inventory card 124 (and is transported to and added to the group of deliverable cards 118).

Then, the process proceeds to block 1612 where a determination is made whether the retrieved "next" card is the last card of the virtual build sequence. If so (the YES condition), the process ends at block 1614 since the construction of the group of deliverable cards 118 has been completed. However, if a block 1612 the retrieved "next" card is not the last card of the virtual build sequence, the process returns to block 1604 wherein the "next+1" card is specified.

Returning now to block 1608, if a determination is made that the desired "next" card is not available as an inventory card 124, the process proceeds to block 1616 to read a returning collected card 114, which may now, alternatively, be referred to as a transitional card 128. Then, at block 1618, the transitional card 128 is read (sensed by a sensor and the information is analyzed by the card management processing system 902) to determine the value of the sensed transitional card 128. At block 1618, a determination is made whether the current transitional card 128 is the desired "next" card. If not (the NO condition), the process continuously loops back to block 1616 until a read transitional card 128 corresponds to the desired "next" card (the YES condition). Then, at block 1620 the transitional card 128 corresponding to the desired "next" card is transported to and added to the group of deliverable cards 118. The process then proceeds to block 1612 and continues as described above.

If at block 1606 the look-forward algorithm 950 is enabled (the YES condition), the process proceeds to block 1622. At block 1622, the transitional card 128 is read (sensed by a card sensor 932 so that the information may be analyzed by the card management processing system 902) to determine the value of the sensed transitional card 128. At block 1624, a determination is made whether the value of the current transitional card 128 corresponds to the value of the desired "next" card. If not (the NO condition), the process proceeds to block 1608 and continues as described above.

If at block 1624 the value of the read transitional card 128 corresponds to the value of the desired "next" card (the YES condition), the process proceeds to block 1626 where the transitional card 128 corresponding to the desired "next" card is transported to and added to the group of deliverable cards 118. The process then proceeds to block 1612 and continues as described above.

Figure 17:
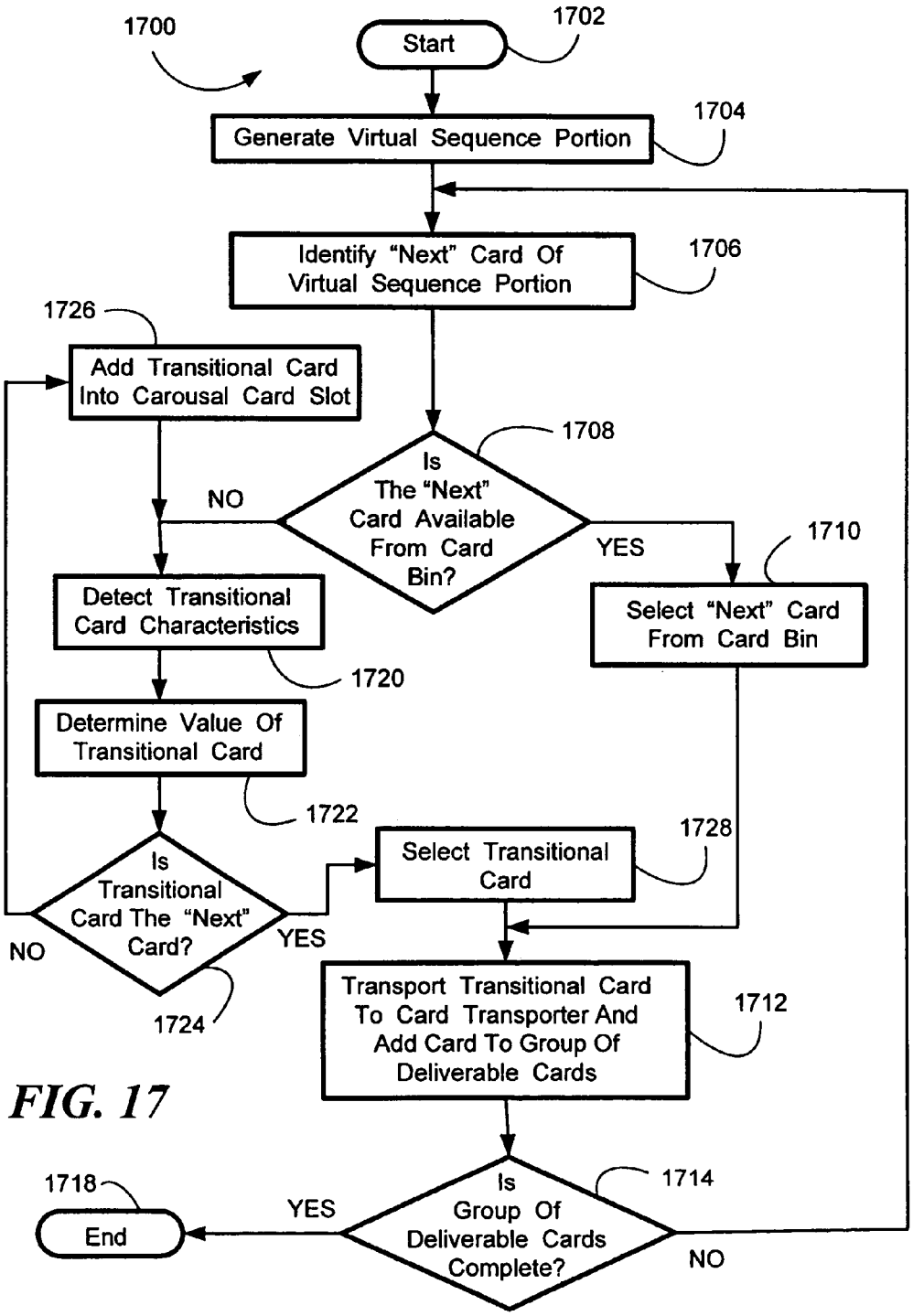
FIG. 17 is a flow chart illustrating a process of the generation of a group of deliverable cards from the inventory cards residing in the compartments of the card storage device or from the transitional cards (if inventory cards are not available).

FIG. 17 is a flow chart 1700 illustrating a process of the above-described generation of a group of deliverable cards 118 (FIG. 9) from the inventory cards 124 residing in carousels 940 or from transitional cards 128 (if inventory cards 124 are not available). This exemplary process is used by embodiments wherein the above-described look-forward algorithm 950 is omitted.

The process starts at block 1702. At block 1704, the card management logic 954 (FIG. 9) generates a virtual sequence portion 1202 under any of the above-described processes, parameters and/or criteria. After the virtual sequence portion 132 has been defined, at block 1706, the value of the first virtual card of the specified virtual sequence is identified. For convenience, this first card is referred to as a "next" card on Flow chart 1700. (As the process loops back to block 1706, as described in greater detail below, subsequently retrieved cards are then the "next" cards in the virtual sequence portion 1202).

At block 1708, a determination is made whether the value of the identified "next" card corresponds to the value of an inventory card 124 that is available from a card receiving compartment 302. If an inventory card 124 is available (the YES condition), the process proceeds to block 1710, wherein the inventory card 124 (corresponding to the "next" card) is selected from its card receiving compartment 302.

At block 1712, the selected inventory card 124 is added to the group of deliverable cards 118 by transporting the selected inventory card 124 to the playing card output receiver 206 where the group of deliverable cards 118 is being constructed. (The selected inventory card 124, after it has been selected from its card receiving compartment 302, may be referred to as a transitional card 128 since the selected inventory card 124 is now being transported to the playing card output receiver 206.)

At block 1714, a determination is made whether construction of the group of deliverable cards 118 has been completed. If so (the YES condition), the process proceeds to block 1718 and ends. If additional cards are to be added to the group of deliverable cards 118 (the NO condition), the process returns to block 1706 wherein the "next" card is identified in accordance with the virtual sequence portion 1202. Thus, as long as inventory cards 124 are available to construct the group of deliverable cards 118, the above-described process loops through blocks 1706, 1708, 1710, 1712 and 1714 until the construction of the group of deliverable cards 118 has been completed.

However, if at block 1708, a determination is made that the value of the identified "next" card does not correspond to the value of an available inventory card 124 (the NO condition), the process proceeds to block 1720. That is, a determination is made that there is no inventory card 124 available. Accordingly, at block 1720, characteristics of a transitional card 128 are detected. At block 1722, based upon the detected characteristics, the value of the transitional card 128 is determined. At block 1724, a determination is made whether the value of the transitional card 128 corresponds to the value of the "next" card (as identified in accordance with the virtual sequence portion 1202 at block 1706).

If the value of the transitional card 128 does not correspond to the value of the "next" card (the NO condition), the process proceeds to block 1726 wherein the transitional card 128 is transported to the appropriate card receiving compartment 302. The process loops through blocks 1720, 1722, 1724 and 1726 until the value of the transitional card 128 corresponds to the value of the "next" card (the YES condition).

Transitional cards 128 are evaluated until the value of the transitional card 128 corresponds to the value of the "next" card (the YES condition of block 1724). As noted above, these evaluated transitional cards 128 correspond to an incoming stream of collected cards 114. Then, the transitional card 128 is selected at block 1728. The process then proceeds to block 1712. That is, when a collected card 114 is finally collected from the gaming table 102 that matches the identified "next" card in accordance with the virtual sequence portion 1202 at block 1706, that collected card 114 (now referred to as a transitional card 128) is selected for transportation to the playing card output receiver 206 so that the card can be added to the group of deliverable cards 118.

In some situations, such as at the end of a series of games or if construction of the group of deliverable cards 118 has been completed, collected cards 114 may be returned to the playing card handling system 110 such that the collected cards 114 are transported to their appropriate card receiving compartment 302, thereby restocking the carousels 940 with inventory cards 124. That is, the supply of available inventory cards 124 may be restocked from collected cards 114 by independently looping through the steps 1720, 1722, 1724 and 1726.

As noted above, as long as inventory cards 124 are available to construct the group of deliverable cards 118, the above-described process loops through blocks 1706, 1708, 1710, 1712 and 1714 until the construction of the group of deliverable cards 118 has been completed. The process of the restocking the supply of available inventory cords 112 from collected cards 114 (by looping through the steps 1720, 1722, 1724 and 1726) may occur concurrently with the process of selecting inventory cards 124 to construct the group of deliverable cards 118. That is, the two above-described processes may occur independently and/or concurrently (or serially, depending upon the embodiment). Then, if an inventory card 124 is not available when needed, the playing card handling system 110 evaluates collected cards 114 until the needed collected card 114 is identified.

Figure 18A:
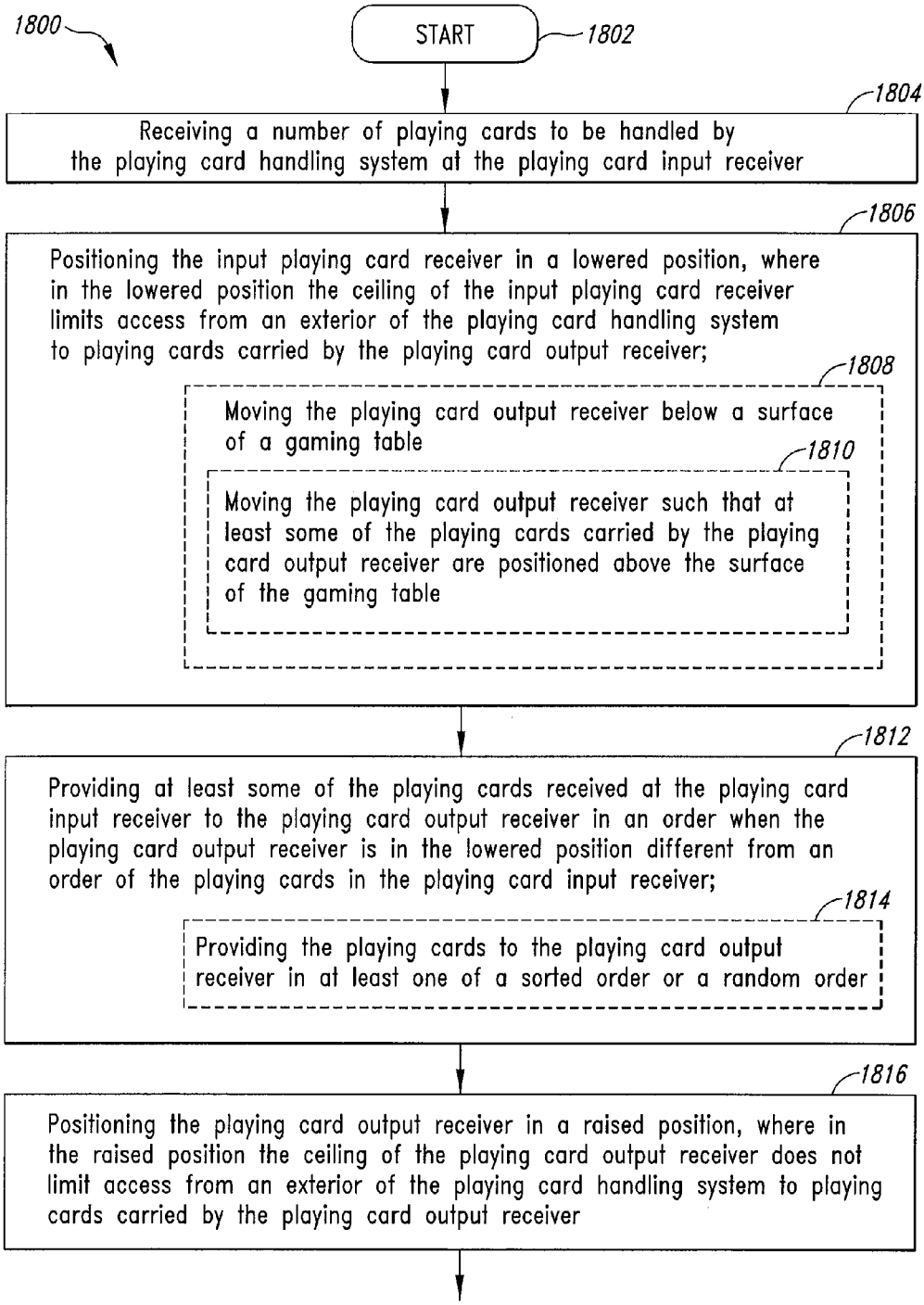
FIGS. 18A and 18B are a flow chart illustrating a process of operating a playing card handling system that comprises a playing card input receiver and a playing card output receiver having a playing card support surface and a ceiling disposed relatively above the playing card support surface.
Figure 18B:
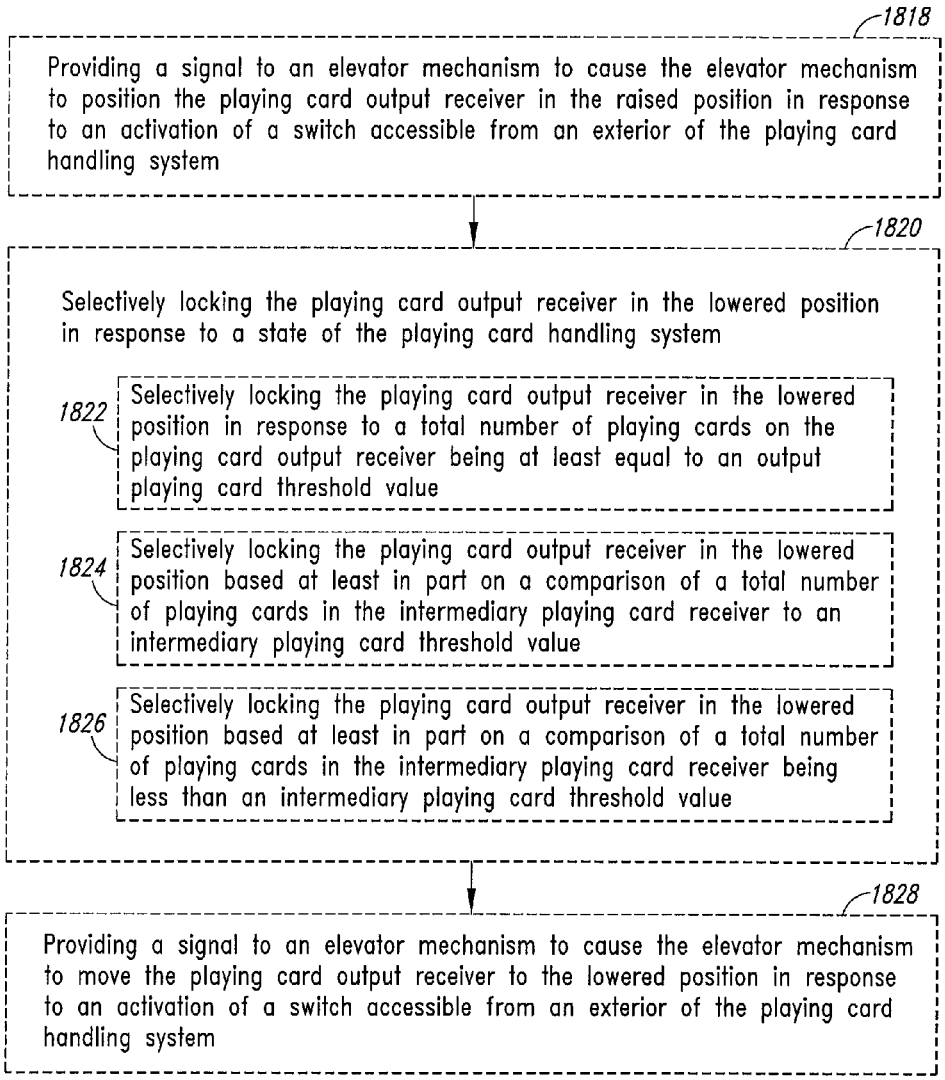

FIGS. 18A and 18B are a flow chart 1800 illustrating a process of operating a playing card handling system that comprises a playing card input receiver and a playing card output receiver having a playing card support surface and a ceiling disposed relatively above the playing card support surface.

The process starts at block 1802. At block 1804, the playing card input receiver receives a number of playing cards to be handled by the playing card handling system.

At block 1806, the input playing card receiver is positioned in a lowered position, where in the lowered position the ceiling of the input playing card receiver limits access from an exterior of the playing card handling system to playing cards carried by the playing card output receiver.

Block 1806 includes an optional block 1808. At optional block 1808, the playing card output receiver is moved below a surface of a gaming table. Optional block 808 includes an optional block 1810, and at optional block 1810, the playing card output receiver is moved such that at least some of the playing cards carried by the playing card output receiver are positioned above the surface of the gaming table.

Block 1812, at least some of the playing cards received at the playing card input receiver are provided to the playing card output receiver in an order when the playing card output receiver is in the lowered position different from an order of the playing cards in the playing card input receiver. Block 1812 includes an optional block 1814. At optional block 1814, the playing cards are provided to the playing card output receiver in at least one of a sorted order or a random order.

At block 1816, the playing card output receiver is positioned in a raised position, where in the raised position the ceiling of the playing card output receiver does not limit access from an exterior of the playing card handling system to playing cards carried by the playing card output receiver.

At optional block 1818, a signal is provided to an elevator mechanism to cause the elevator mechanism to position the playing card output receiver in the raised position in response to an activation of a switch accessible from an exterior of the playing card handling system.

At optional block 1820, the playing card output receiver is selectively locked in the lowered position in response to a state of the playing card handling system.

Optional block 1820 includes optional blocks 1822, 1824, and 1826. At optional block 1822, the playing card output receiver is selectively locked in the lowered position in response to a total number of playing cards on the playing card output receiver being at least equal to an output playing card threshold value.

At optional block 1824, the playing card output receiver is selectively locked in the lowered position based at least in part on a comparison of a total number of playing cards in the intermediary playing card receiver to an intermediary playing card threshold value.

At optional block 1826, the playing card output receiver is selectively locked in the lowered position based at least in part on a comparison of a total number of playing cards in the intermediary playing card receiver being less than an intermediary playing card threshold value.

At optional block 1828, a signal is provided to an elevator mechanism to cause the elevator mechanism to move the playing card output receiver to the lowered position in response to an activation of a switch accessible from an exterior of the playing card handling system.

Advantages of the Playing Card Handling System

It is appreciated that construction of the group of deliverable cards 118, processing of virtual cards 1204 (of the virtual selection pool 922, the virtual sequence 136, and/or the virtual sequence portion 1202) concurrently with the transportation of collected cards 114 to carousel receiving compartments 302 allows a series of card games to progress in an uninterrupted, or nearly uninterrupted, manner. That is, when one or more game of cards is completed such that the supply of in-play cards 126 are exhausted, a group of deliverable cards 118 are readily available so that game play may continue. Furthermore, various embodiments may be configured to optimize or minimize the total number of individual physical cards 1206 at a gaming table 102.

The playing card handling system 110, 200 may advantageously permit a theoretical hold to be set for a gaming table 102. The theoretical hold represents the advantage of the house (e.g., casino) for a particular game. The theoretical hold is typically based on the combination of the card game rules, the casino rules, if any, and assumes that the participants play with perfect strategy. Because participants rarely play with perfect strategy, hence the term "theoretical hold."

It is customary in most casinos to set a theoretical hold of at least 0.5%, which may be referred to as a "positive hold" and means that the house would earn 0.5% of every dollar wagered for the particular game. For some games, like Let-It-Ride® for example, the theoretical hold can be as high as 30%.

According to at least one embodiment described herein, the playing card handling system 110, 200 can be used to advantageously set or "dial-in" the theoretical hold at a particular gaming table 102. One way of dialing in the theoretical hold is to create the virtual sequence 136 based on a large number of cards, for example 100,000 decks (i.e., 5,200,000 cards). This generated virtual sequence 136 can be computationally evaluated to locate subsets therein that have the requisite theoretical hold. The computational evaluation would locate groupings of cards that had a plurality of certain card values, like a larger number of twos and threes, and/or that had a sequence that favored the house. Accordingly, the casino could entice players to play at a table with a larger than customary theoretical hold by providing large incentives for participants that did well against the house on such a table.

By way of another non-limiting example, the casino could set the theoretical hold to favor the participants, instead of the house. This type of gaming table 102 would have a "negative theoretical hold." One reason for having a negative theoretical hold would be to attract beginner players that may not want to wager a lot, but are also not willing to lose a lot either. Thus, the gaming table 102 with the negative hold 102 would provide beginning players a chance to play the game for awhile, learn the game, and hopefully walk away feeling successful and possibly ready to play at more challenging tables. Based on the foregoing, the playing card handling system 110 could advantageously be used to set the theoretical hold within a range of −10% to 40%, for example. The negative percentages represent theoretical holds that favor the participants, while the positive percentages represent theoretical holds that favor the house. It is appreciated that aforementioned theoretical hold range is not meant to limit the scope of this application and it is understood that the value of the theoretical hold for a particular gaming table 102 is solely within the discretion of the house.

The various embodiments described above can be combined to provide further embodiments. All of the above U.S. patents, U.S. patent application publications, U.S. patent applications, foreign patents, foreign patent applications and non-patent publications referred to in this specification and/or listed in the Application Data Sheet, including but not limited to: U.S. provisional patent application Ser. Nos. 60/716,538, filed Sep. 12, 2005; 60/791,549, filed Apr. 12, 2006; 60/791,554, filed Apr. 12, 2006; 60/791,398, filed Apr. 12, 2006; and 60/791,513, filed Apr. 12, 2006; and U.S. nonprovisional patent application Ser. No. 10/981,132, filed Nov. 3, 2004; Ser. No. 10/934,785, filed Sep. 2, 2004; and Ser. No. 10/823,051, filed Apr. 13, 2004, are incorporated herein by reference, in their entirety.

These and other changes can be made to the invention in light of the above-detailed description. In general, in the following claims, the terms used should not be construed to limit the invention to the specific embodiments disclosed in the specification and the claims, but should be construed to include all card manipulation devices and systems and the operational aspects that operate in accordance with the claims. Accordingly, the invention is not limited by the disclosure, but instead its scope is to be determined entirely by the following claims.

The invention claimed is:

1. A playing card handling system, comprising:

a playing card input receiver sized and positioned to receive a number of playing cards to be handled by the playing card handling system;

a playing card output receiver sized and positionable to receive a number of playing cards handled by the playing card handling system, the playing card output receiver comprising a playing card support surface, a ceiling at least partially disposed relatively over the playing card support surface, and at least one member physically extending from the ceiling to the playing card support surface for movement therewith;

at least one playing card transport path between the playing card input receiver and the playing card output receiver, along which at least some of the playing cards pass from the playing card input receiver to the playing card output receiver;

at least one intermediary playing card receiver positioned in the at least one playing card transport path between the playing card input receiver and the playing card output receiver, wherein the at least one intermediary playing card receiver receives at least one of the number of playing cards received at the playing card input receiver via a first portion of the at least one transport path, and wherein at least one of the number of playing cards received at the playing card output receiver is transported from the at least one intermediary playing card receiver to the playing card output receiver via a second portion of the at least one transport path;

an elevator mechanism physically coupled to the playing card output receiver, to selectively move the playing card output receiver between a lowered position and a raised position, where in the lowered position the ceiling limits access from an exterior of the playing card handling system to the playing cards carried by the card support surface of the playing card output receiver and in the raised position the ceiling is at least partially disposed relatively over the playing card support surface and does not limit access from the exterior of the playing card handling system to at least some of the playing cards carried by the playing card output receiver; and means for providing playing cards to the playing card output receiver in an order, wherein the order is at least one of a sorted order or a random order.

2. A playing card handling system, comprising:

a playing card input receiver sized and positioned to receive a number of playing cards to be handled by the playing card handling system;

a playing card output receiver sized and positionable to receive a number of playing cards handled by the playing card handling system, the playing card output receiver comprising a playing card support surface, a ceiling at least partially disposed relatively over the playing card support surface, and at least one member physically extending from the ceiling to the playing card support surface for movement therewith;

at least one playing card transport path between the playing card input receiver and the playing card output receiver, along which at least some of the playing cards pass from the playing card input receiver to the playing card output receiver;

at least one intermediary playing card receiver positioned in the at least one playing card transport path between the playing card input receiver and the playing card output receiver, wherein the at least one intermediary playing card receiver receives at least one of the number of playing cards received at the playing card input receiver via a first portion of the at least one transport path, and wherein at least one of the number of playing cards received at the playing card output receiver is transported from the at least one intermediary playing card receiver to the playing card output receiver via a second portion of the at least one transport path;

an elevator mechanism physically coupled to the playing card output receiver, to selectively move the playing card output receiver between a lowered position and a raised position, where in the lowered position the ceiling limits access from an exterior of the playing card handling system to the playing cards carried by the card support surface of the playing card output receiver and in the raised position the ceiling is at least partially disposed relatively over the playing card support surface and does not limit access from the exterior of the playing card handling system to at least some of the playing cards carried by the playing card output receiver;

a switch, accessible from an exterior of the playing card handling system, to cause the elevator mechanism to raise the playing card output receiver to the raised position; and a locking mechanism to selectively lock and unlock the playing card output receiver in the lowered position in response to a state of the playing card handling system.

3. The playing card handling system of claim 2 wherein the locking mechanism selectively locks and unlocks the playing card output receiver in the lowered position in response to a total number of playing cards on the playing card output receiver being at least equal to an output playing card threshold value.

4. The playing card handling system of claim 2 wherein the locking mechanism selectively locks and unlocks the playing card output receiver in the lowered position based at least in part on a comparison of a total number of playing cards in the intermediary playing card receiver to an intermediary playing card threshold value.

5. The playing card handling system of claim 2 wherein the locking mechanism selectively locks and unlocks the playing card output receiver in the lowered position based at least in part on a comparison of a total number of playing cards in the intermediary playing card receiver being less than an intermediary playing card threshold value.

6. The playing card handling system of claim 2, further comprising:

a switch, accessible from an exterior of the playing card handling system, to cause the elevator mechanism to move the playing card output receiver to the lowered position.

7. The playing card handling system of claim 2 wherein the locking mechanism comprises a mechanical lockout mechanism.

8. The playing card handling system of claim 2 wherein the locking mechanism comprises a set of instructions stored on a memory device.

9. A playing card handling system, comprising:

a playing card input receiver sized and positioned to receive a number of playing cards to be handled by the playing card handling system;

a playing card output receiver sized and positionable to receive a number of playing cards handled by the playing card handling system, the playing card output receiver comprising a playing card support surface, a ceiling at least partially disposed relatively over the playing card support surface, and at least one member physically extending from the ceiling to the playing card support surface for movement therewith, wherein the at least one member of the playing card output receiver comprises three sidewalls, each of the sidewalls extending between the playing card support surface and the ceiling, a first and a second one of the sidewalls opposed to one another, and a third one of the sidewalls positioned between the first and the second one of the sidewalls;

at least one playing card transport path between the playing card input receiver and the playing card output receiver, along which at least some of the playing cards pass from the playing card input receiver to the playing card output receiver;

at least one intermediary playing card receiver positioned in the at least one playing card transport path between the playing card input receiver and the playing card output receiver, wherein the at least one intermediary playing card receiver receives at least one of the number of playing cards received at the playing card input receiver via a first portion of the at least one transport path, and wherein at least one of the number of playing cards received at the playing card output receiver is transported from the at least one intermediary playing card receiver to the playing card output receiver via a second portion of the at least one transport path; and an elevator mechanism physically coupled to the playing card output receiver, to selectively move the playing card output receiver between a lowered position and a raised position, where in the lowered position the ceiling limits access from an exterior of the playing card handling system to the playing cards carried by the card support surface of the playing card output receiver and in the raised position the ceiling is at least partially disposed relatively over the playing card support surface and does not limit access from the exterior of the playing card handling system to at least some of the playing cards carried by the playing card output receiver.

10. A playing card handling system, comprising:

a playing card input receiver positioned to receive a number of playing cards to be ordered by the playing card handling system;

a playing card output receiver positioned to provide a number of playing cards ordered by the playing card handling system, the playing card output receiver comprising a playing card support surface, a ceiling at least partially disposed relatively over the playing card support surface, and at least one member physically coupling the ceiling to the playing card support surface for movement therewith; and ordering means for providing the playing cards received in the playing card input receiver to the playing card output receiver in an order different from an order of the playing cards in the playing card input receiver.

11. The playing card handling system of claim 10, further comprising:

delivery means for causing a delivery of at least some of the playing cards externally from the playing card handling system.

12. The playing card handling system of claim 11 wherein the delivery means for causing a delivery of at least some of the playing cards externally from the playing card handling system comprises means for selectively moving the playing card output receiver between a lowered position and a raised position, where in the lowered position the ceiling limits access to playing cards from an exterior of the playing card handling system carried by the card support surface of the playing card output receiver and in the raised position the ceiling does not limit from the exterior of the playing card handling system access to at least some of the playing cards carried by the playing card output receiver.

13. The playing card handling system of claim 12 where in the lowered position the playing card support surface is positioned below a surface of a gaming table.

14. The playing card handling system of claim 12 where in the raised position the playing card support surface is positioned such that at least some of the playing cards carried by the playing card support surface of the playing card output receiver are spaced relatively above a surface of the gaming table.

15. The playing card handling system of claim 12, further comprising:

a switch, accessible from an exterior of the playing card handling system, to cause the elevator mechanism to move the playing card output receiver to the raised position.

16. The playing card handling system of claim 10, further comprising:

means for selectively locking and unlocking the playing card output receiver in the lowered position in response to a state of the playing card handling system.

17. The playing card handling system of claim 16 wherein the locking and unlocking means selectively locks and unlocks the playing card output receiver in the lowered position in response to a total number of playing cards on the playing card output receiver being at least equal to an output playing card threshold value.

18. The playing card handling system of claim 16 wherein the locking and unlocking means selectively locks and unlocks the playing card output receiver in the lowered position based at least in part on a comparison of a total number of playing cards in an intermediary playing card receiver to an intermediary playing card threshold value.

19. The playing card handling system of claim 10, further comprising:

a switch, accessible from an exterior of the playing card handling system, to cause the elevator mechanism to move the playing card output receiver to the lowered position.

20. The playing card handling system of claim 16 wherein the locking means comprises a mechanical lockout mechanism.

21. The playing card handling system of claim 16 wherein the locking means comprises a set of instructions stored on a memory device.

22. The playing card handling system of claim 10 wherein the playing card output receiver takes the form of a rectangular box open on one side.

23. A method of operating a playing card handling system that comprises a playing card input receiver and a playing card output receiver having a playing card support surface, a ceiling disposed relatively above the playing card support surface, and at least one member physically extending from the ceiling to the playing card support surface for movement therewith, the method comprising:

receiving a number of playing cards at the playing card input receiver, the number of playing cards to be handled by the playing card handling system;

positioning the playing card output receiver in a lowered position, where in the lowered position the ceiling of the playing card output receiver is disposed relatively above the playing card support surface and limits access from an exterior of the playing card handling system to playing cards carried by the playing card output receiver;

providing at least some of the playing cards received at the playing card input receiver to the playing card output receiver in an order when the playing card output receiver is in the lowered position different from an order of the playing cards in the playing card input receiver, where the playing cards received by the playing card output receiver are at least partially between the ceiling and the playing card support surface and are carried by the playing card support surface; and positioning the playing card output receiver in a raised position, where in the raised position the ceiling of the playing card output receiver is disposed relatively above the playing card support surface and does not limit access from an exterior of the playing card handling system to playing cards carried by the playing card output receiver.

24. The method of claim 23 wherein positioning the playing card output receiver in a lowered position includes moving the playing card output receiver below a surface of a gaming table.

25. The method of claim 24 wherein positioning the playing card output receiver in a raised position includes moving the playing card output receiver such that at least some of the playing cards carried by the playing card support surface of the playing card output receiver are positioned between the playing card support surface and the ceiling and above the surface of the gaming table.

26. The method of claim 23 wherein providing at least some of the playing cards received at the playing card input receiver to the playing card output receiver in an order when the playing card output receiver is in the lowered position different from an order of the playing cards in the playing card input receiver comprises providing the playing cards to the playing card output receiver in at least one of a sorted order or a random order.

27. The method of claim 23, further comprising:

providing a signal to an elevator mechanism to cause the elevator mechanism to position the playing card output receiver in the raised position in response to an activation of a switch accessible from an exterior of the playing card handling system.

28. The method of claim 23, further comprising:

selectively locking the playing card output receiver in the lowered position in response to a state of the playing card handling system.

29. The method of claim 28 wherein selectively locking the playing card output receiver in the lowered position in response to a state of the playing card handling system comprises selectively locking the playing card output receiver in the lowered position in response to a total number of playing cards on the playing card output receiver being at least equal to an output playing card threshold value.

30. The method of claim 28 wherein selectively locking the playing card output receiver in the lowered position in response to a state of the playing card handling system comprises selectively locking the playing card output receiver in the lowered position based at least in part on a comparison of a total number of playing cards in an intermediary playing card receiver to an intermediary playing card threshold value.

31. The method of claim 28 wherein selectively locking the playing card output receiver in the lowered position in response to a state of the playing card handling system comprises selectively locking the playing card output receiver in the lowered position based at least in part on a comparison of a total number of playing cards in the intermediary playing card receiver being less than an intermediary playing card threshold value.

32. The method of claim 23, further comprising:

providing a signal to an elevator mechanism to cause the elevator mechanism to move the playing card output receiver to the lowered position in response to an activation of a switch accessible from an exterior of the playing card handling system.

* * * * *